US010610069B2

(12) United States Patent
Laundre

(10) Patent No.: US 10,610,069 B2
(45) Date of Patent: Apr. 7, 2020

(54) TOILET SEAT AND HINGE

(71) Applicant: Kohler Co., Kohler, WI (US)

(72) Inventor: Jeffrey T. Laundre, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 16/238,767

(22) Filed: Jan. 3, 2019

(65) Prior Publication Data

US 2019/0208969 A1 Jul. 11, 2019

Related U.S. Application Data

(60) Provisional application No. 62/614,381, filed on Jan. 6, 2018.

(51) Int. Cl.
*A47K 13/26* (2006.01)
*A47K 13/12* (2006.01)

(52) U.S. Cl.
CPC ..... *A47K 13/26* (2013.01); *A47K 13/12* (2013.01)

(58) Field of Classification Search
CPC ..... A47K 13/26
USPC ..... 4/236
See application file for complete search history.

(56) References Cited

U.S. PATENT DOCUMENTS 4,319,365 A 3/1982 Bemis et al.
5,307,524 A 5/1994 Veal
5,455,466 A 10/1995 Parks et al.
5,933,875 A 8/1999 Hulsebus et al.
5,980,150 A 11/1999 Newman et al.
6,070,295 A 6/2000 Hulsebus
6,381,762 B1 5/2002 Moser
6,504,732 B2 1/2003 Abe
7,155,748 B2 1/2007 Vierkant et al.
7,203,975 B2 4/2007 Vierkant
7,293,297 B2 11/2007 Hayashi et al.
8,024,821 B2 9/2011 Chen
8,074,302 B1 12/2011 Kook
8,555,427 B2 10/2013 Stauber et al.
8,626,297 B2 1/2014 Jaax et al.
(Continued)

FOREIGN PATENT DOCUMENTS

CN 206706933 12/2017
CN 207444886 6/2018
(Continued)

*Primary Examiner* — Lori L Baker
(74) *Attorney, Agent, or Firm* — Foley & Lardner LLP

(57) ABSTRACT

A toilet seat assembly that includes a unitary hinge base and a seat and/or lid rotatably coupled to the hinge base through a pivot member. The unitary hinge base includes a base member having interconnected walls including a front wall and defining an open bottom; a first mount extending from a first portion of the front wall; a second mount extending from a second portion of the front wall; a cover assembly configured to detachably couple to at least one of the first and second mounts in a covering position; a first living hinge connecting the cover assembly to the first mount, such that the cover assembly is movable relative to the first mount through the first living hinge; and a second living hinge connecting the cover assembly to the second mount, such that the cover assembly is movable relative to the second mount through the second living hinge.

20 Claims, 53 Drawing Sheets

(56) References Cited

U.S. PATENT DOCUMENTS

| | | | | |
|---|---|---|---|---|
| 8,640,268 | B2 | 2/2014 | Shek | |
| 9,170,720 | B2 | 10/2015 | Plate et al. | |
| 9,289,103 | B2 | 3/2016 | Jensen | |
| 9,290,921 | B2 | 3/2016 | Morioka et al. | |
| 9,477,317 | B1 | 10/2016 | Clements | |
| 9,594,500 | B2 | 3/2017 | Clements | |
| 9,635,989 | B2 | 5/2017 | Mantel et al. | |
| 9,644,358 | B2 | 5/2017 | Qualls et al. | |
| 9,657,472 | B2 * | 5/2017 | Plate | A47K 13/24 |
| 2007/0056084 | A1 | 3/2007 | Watt et al. | |
| 2008/0141444 | A1 | 6/2008 | Lin | |
| 2008/0172780 | A1 | 7/2008 | Shiau | |
| 2008/0209618 | A1 | 9/2008 | Brill | |
| 2010/0083431 | A1 | 4/2010 | Hallett | |
| 2010/0237096 | A1 | 9/2010 | Wegelin | |
| 2013/0269092 | A1 * | 10/2013 | Hand | A47K 13/12 4/240 |
| 2014/0091638 | A1 | 4/2014 | Azancot et al. | |
| 2014/0215703 | A1 | 8/2014 | Chuang et al. | |
| 2014/0259337 | A1 | 9/2014 | Melvin, Jr. et al. | |
| 2014/0354225 | A1 | 12/2014 | Kitamura | |
| 2014/0373263 | A1 * | 12/2014 | Plate | A47K 13/24 4/300 |
| 2015/0313426 | A1 | 11/2015 | Cheng et al. | |
| 2015/0366418 | A1 | 12/2015 | Abdollahzadeh | |
| 2016/0201312 | A1 * | 7/2016 | Akar | E03D 7/00 4/378 |
| 2016/0338556 | A1 | 11/2016 | Payziev et al. | |

FOREIGN PATENT DOCUMENTS

| | | |
|---|---|---|
| CN | 208463894 | 2/2019 |
| EP | 2993273 A1 | 3/2016 |

* cited by examiner

TOILET SEAT AND HINGE

CROSS-REFERENCE RELATED TO PATENT APPLICATIONS

The present application claims the benefit of and priority to U.S. Patent Application No. 62/614,381, which was filed on Jan. 6, 2018, and is incorporated by reference herein in its entirety.

BACKGROUND

The present application relates generally to the field of toilet seat hinges and locks for attaching toilet seats to toilet bowls. More specifically, this application relates to hinges and locks for toilets that are configured to allow for quick release and quick assembly of the toilet seat from/to the toilet bowl. This application further relates to a docking station for toilet seat assemblies that allows a toilet seat to be easily electrically disconnected from the docking station.

SUMMARY

At least one embodiment of the application relates to a toilet seat assembly that includes a docking station, a hinge lock, a hinge body, at least one of a seat and a lid rotatably coupled to the hinge body, and an electrical component. The docking station includes a body and an electrical contact coupled to the body. The hinge lock is configured to couple the body to a toilet base, and the hinge lock includes a hollow fastener, which engages an opening in the body and has a bore. The hinge body is coupled to the body of the docking station, such that an electrical contact of the hinge body is electrically connected to the electrical contact of the docking station. The electronic component is housed on or in at least one of the hinge body, the seat, and the lid, where the electronic component is electrically connected to the electrical contact of the hinge body and is configured to receive electric power from an electrical wire configured to route through the bore in the fastener to electrically connect to the electrical contact of the docking station.

At least one embodiment of the application relates to a toilet seat assembly that includes a docking station, a hinge body, a toilet seat rotatably coupled to the hinge body, a toilet seat lid rotatably coupled to the hinge body, and an electronic component. The docking station has a body including a lower surface configured to mount to a toilet base and an upper surface; and an electrical contact coupled to the upper surface of the body and configured to receive electric power from a power source. The hinge body has an electrical contact that is electrically connected to and receives the electric power from the electrical contact of the docking station in a coupled position of the hinge body with the body of the docking station. The electronic component is housed coupled to at least one of the hinge body, the seat, and the lid, where the electronic component is configured to receive electric power from the electrical contact of the hinge body.

At least one embodiment of the application relates to a toilet seat assembly that includes a hinge member, a locating member, a fastener, at least one of a seat and a lid rotatably coupled to the hinge member, and an electronic component housed on or in at least one of the hinge member, the seat, and the lid. The hinge member includes a body having a front wall and a hinge mount extending forward from the front wall and comprising a flange with an opening therein. The locating member includes a base received in the opening of the flange of the hinge mount, a flange overhanging a portion of the flange of the hinge mount, a first bore extending through the base, and a second bore extending through the base adjacent to the first bore. The fastener engages the first bore in the locating member and is configured to engage an opening in a toilet base to secure the locating member and hinge member to the toilet base. The electronic component is configured to receive electric power from an electrical wire, which is configured to route through the second bore in the locating member and through the opening in the toilet base.

At least one embodiment of the application relates to a toilet seat assembly that includes a unitary (e.g., one-piece, integrally formed) hinge base and at least one of a seat and a lid rotatably coupled to the hinge base through at least one pivot member. The unitary hinge base includes a base member having a plurality of interconnected walls comprising a front wall and defining an open bottom; a first mount extending from a first portion of the front wall and configured to receive a first hinge lock; a second mount extending from a second portion of the front wall and configured to receive a second hinge lock; a cover assembly configured to detachably couple to at least one of the first and second mounts in a covering position; a first living hinge connecting the cover assembly to the first mount, such that the cover assembly is movable relative to the first mount through the first living hinge; and a second living hinge connecting the cover assembly to the second mount, such that the cover assembly is movable relative to the second mount through the second living hinge.

At least one embodiment of the application relates to a unitary hinge base for a toilet seat assembly. The unitary hinge base includes a base member having a plurality of interconnected walls comprising a front wall and defining an open bottom; a first mount extending from a first portion of the front wall; a second mount extending from a second portion of the front wall; a cover assembly configured to detachably couple to at least one of the first and second mounts in a covering position; a first living hinge connecting the cover assembly to the first mount, such that the cover assembly is movable relative to the first mount through the first living hinge; and a second living hinge connecting the cover assembly to the second mount, such that the cover assembly is movable relative to the second mount through the second living hinge.

At least one embodiment of the application relates to a toilet seat assembly including a hinge having a mount, a seat rotatable coupled to the hinge, and a lock for securing the mount to a toilet base. The lock includes a locating member disposed in an opening in the mount, and the locating member includes a base, a flange extending away from the base to prohibit relative rotation between the locating member and the mount, and a locking feature having a channel. The lock includes a fastener having a first portion and a second portion extending away from the first portion, where the first portion is coupled to the base of the locating member and the second portion is configured to extend through an opening in the toilet base. The lock includes a locking member that selectively secures the mount and the locating member to the toilet base. The locking member includes a base and a flange extending inwardly form the base to engage the channel in a locking position through a rotation of the locking member relative to the locating member, where the base secures the mount to the toilet base in the locking position.

At least one embodiment of the application relates to a toilet having a toilet base, a toilet seat assembly having a hinge and a seat rotatably coupled to the hinge, and a lock for securing a mount of the hinge to the toilet base. The lock includes a locating member disposed in an opening in the mount, and the locating member includes a base, a flange extending away from the base to prohibit relative rotation between the locating member and the mount, and a locking feature having a channel. The lock includes a fastener having a first portion and a second portion extending away from the first portion, where the first portion is coupled to the base of the locating member and the second portion is configured to extend through an opening in the toilet base. The lock includes a locking member that selectively secures the mount and the locating member to the toilet base. The locking member includes a base and a flange extending inwardly form the base to engage the channel in a locking position, where the base secures the mount to the toilet base in the locking position.

At least one embodiment of the application relates to a toilet seat assembly including a docking station configured to be coupled to a toilet base. The docking station includes a body, a locator projection extending from an upper surface of the body, and an electrical contact extending from the upper surface of the body. The toilet seat assembly further includes a hinge, and a seat and a lid rotatably coupled to the hinge. The hinge defines an opening configured to receive the locator projection. The hinge further defines an electrical contact opening configured to receive and electrically engage the electrical contact.

BRIEF DESCRIPTION OF THE FIGURES

FIG. 35 is a perspective cross-sectional view of the toilet seat hinge lock shown in

FIG. 32.

DETAILED DESCRIPTION

Referring generally to the FIGURES, a toilet seat assembly is shown according to various exemplary embodiments. The toilet seat assembly may be connected to a bowl with a quick-release mechanism for quickly and easily connecting or disconnecting the toilet seat assembly to the bowl of a toilet. According to other embodiments, the toilet seat assembly may be connected to a docking station, such that the toilet seat assembly may be removed easily for cleaning without disconnecting the docking station.

Figure 1:
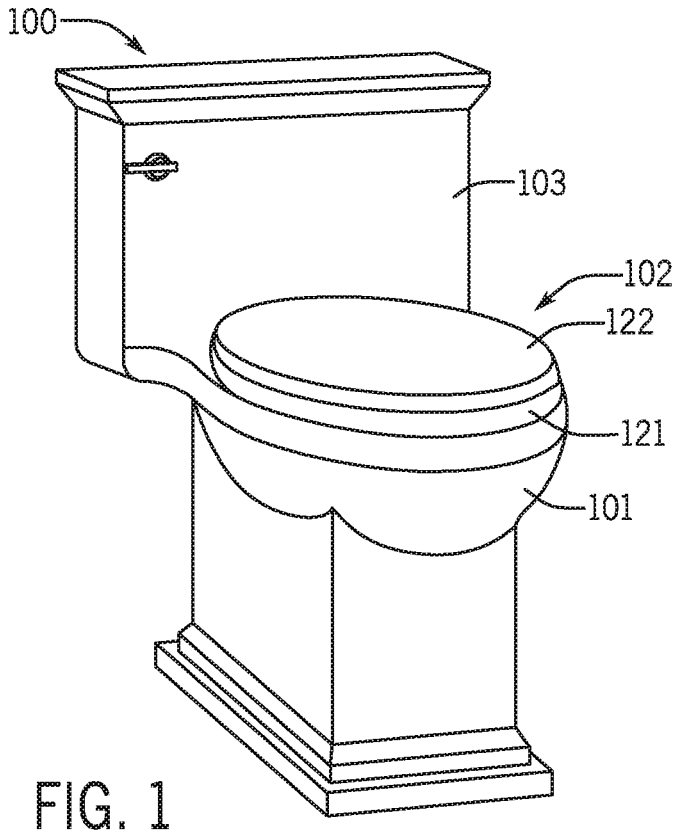
FIG. 1 is a perspective view of a toilet having a toilet seat hinge, according to this application.
Figure 2:
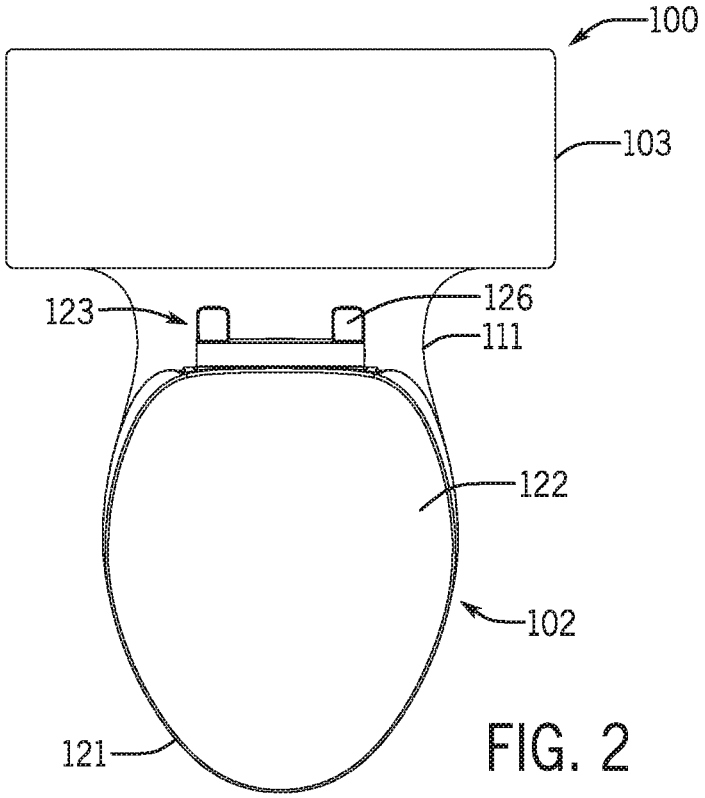
FIG. 2 is a top view of the toilet shown in FIG. 1.

FIGS. 1 and 2 illustrate an exemplary embodiment of a toilet 100 that includes a bowl 101 (e.g., base, pedestal, etc.), a toilet seat assembly 102 coupled to an upper surface 111 (e.g., a deck, a ledge, etc.) of the bowl 101, and a tank 103 for supplying water to the bowl 101. It is noted that the toilet seat assembly and the toilet seat hinge locks disclosed herein may be employed with any type of toilet (e.g., one-piece toilets, two-piece toilets, skirted toilets, smart toilets, etc.) and that the toilet 100 shown in FIGS. 1 and 2 is exemplary.

Further, the toilet seat hinge locks may be employed with any type of toilet seat assembly and/or toilet attachment assemblies (e.g., bidet assemblies, heated seats, smart devices, etc.).

Also shown in FIGS. 1 and 2, the toilet seat assembly 102 includes a seat 121 configured to support a person, a lid 122 (e.g., cover, etc.) covering the seat 121, and a hinge 123 that rotatably couples the seat 121 and the lid 122 to the toilet 100 (e.g., the upper surface 111). A portion of the hinge 123 is mountable to the upper surface 111 to secure the portion of the hinge 123 in place relative to the bowl 101 to allow independent rotation of the seat 121 and the lid 122 relative to the portion and the bowl 101. FIG. 2 illustrates two mounting locations attaching the hinge 123 to the bowl 101, each of which is concealed by a cover 126.

Figure 3:
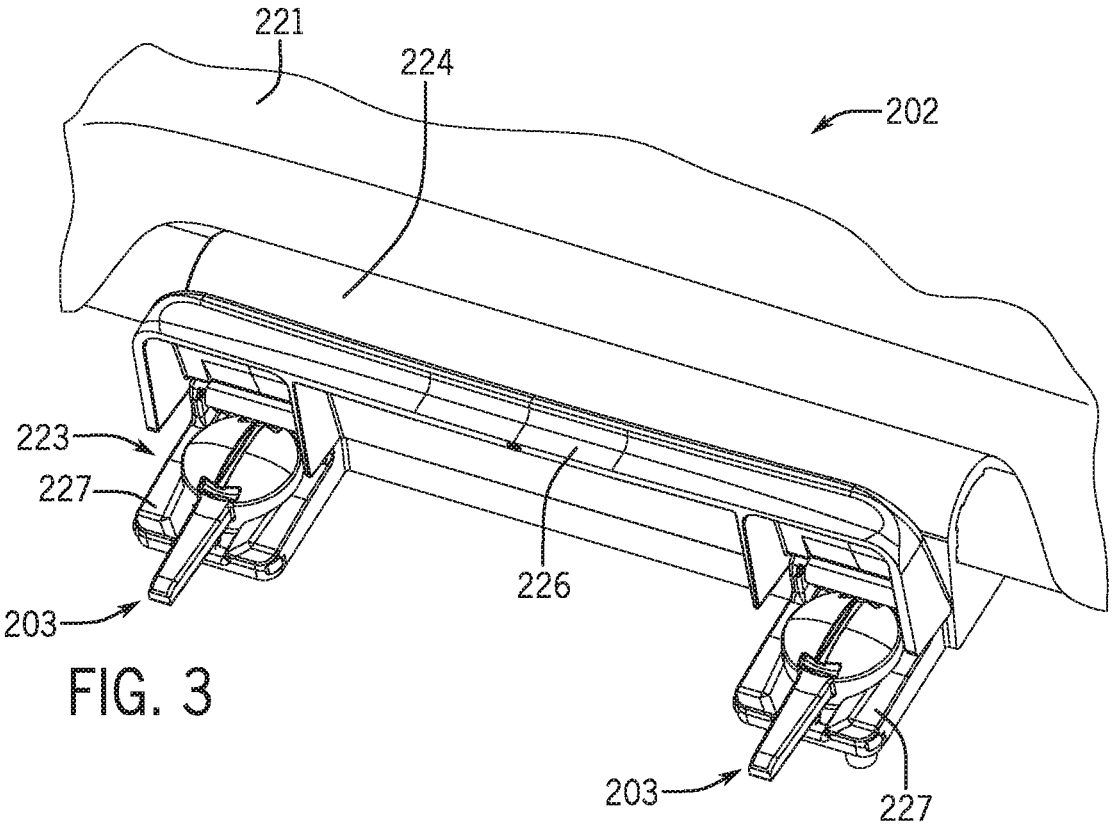
FIG. 3 is a perspective view of a toilet seat assembly having a toilet seat hinge according to this application.
Figure 4:
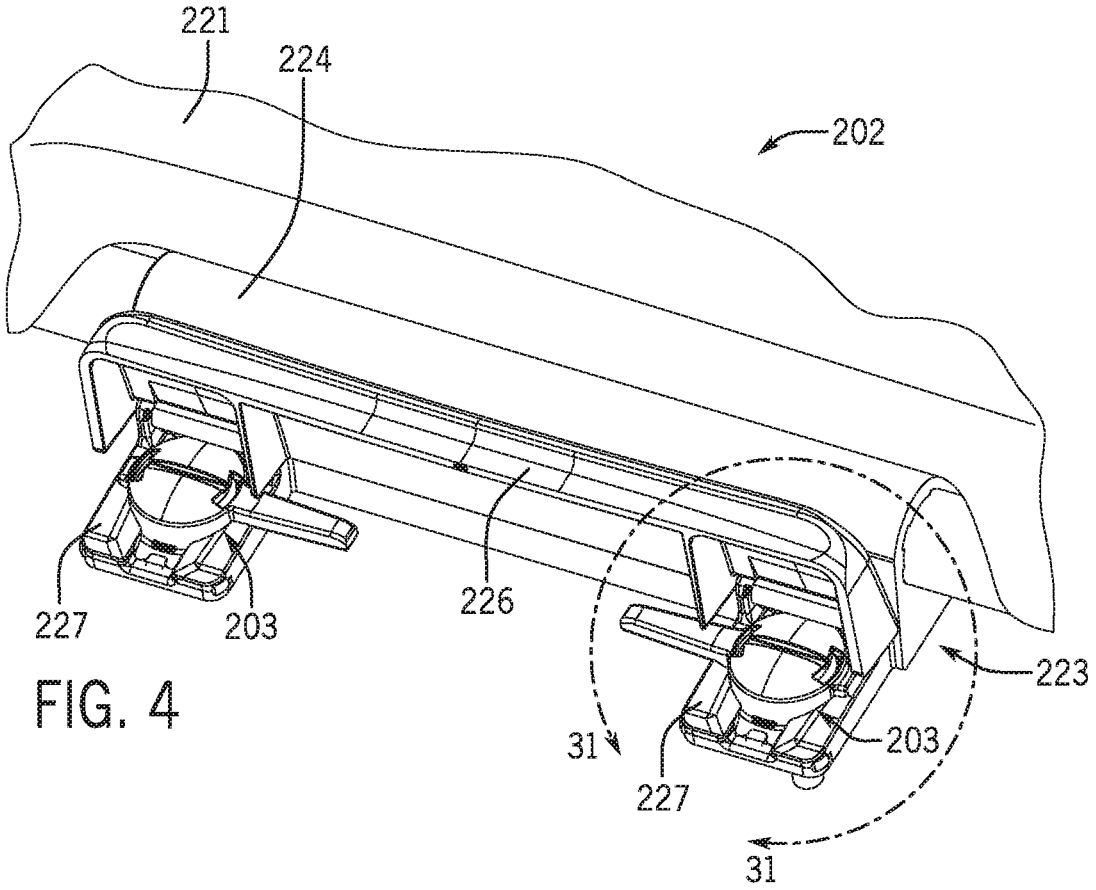
FIG. 4 is another perspective view of the toilet seat assembly shown in FIG. 3.

FIGS. 3 and 4 illustrate a toilet seat assembly 202 that includes a seat (hidden from view), a lid 221 covering and concealing the seat, and a hinge 223 for rotatably coupling the seat and lid 221 to a toilet. The hinge 223 includes a fixed body 224 and two spaced apart hinge mounts 227 extending from and coupled to the body 224. Each hinge mount 227 is configured to receive a single associated hinge lock 203 to secure the hinge 223 to a toilet. FIG. 3 shows each hinge lock 203 in an unlocked position (e.g., unlocked configuration, etc.), in which the hinge 223 is not secured to the toilet. FIG. 4 shows each hinge lock 203 in a locked position (e.g., locked configuration, etc.), in which the hinge 223 is secured to the toilet. Each hinge lock 203 is configured to provide selective locking and unlocking of the hinge in a fast and intuitive manner, as discussed below in more detail.

The hinge 223 may include a cover 226 for concealing the hinge locks 203. As shown in FIG. 4, the cover 226 is rotatable relative to the body 224 between an open position (as shown), in which the hinge mounts 227 and hinge locks 203 are accessible, and a closed position, in which the hinge mounts 227 and hinge locks 203 are inaccessible as the cover conceals them from view providing a cleaner appearance. A single cover 226 may be used to conceal both hinge mounts 227 and both hinge locks 203, as shown in FIG. 4, or a separate cover may be associated with each hinge mount 227 and associated hinge lock 203 as shown in FIG. 2.

Figure 5:
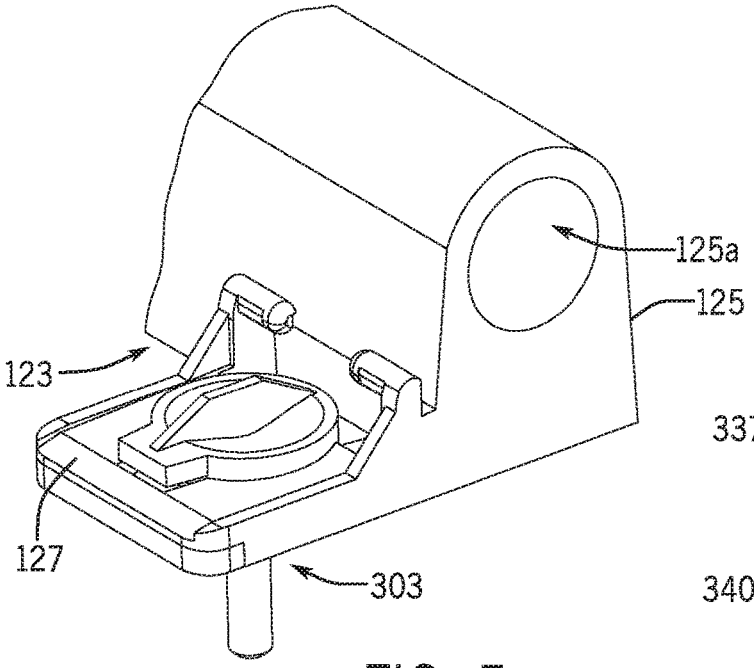
FIG. 5 is a perspective view of an embodiment of a toilet seat hinge lock in an unlocked position with a hinge.
Figure 6:
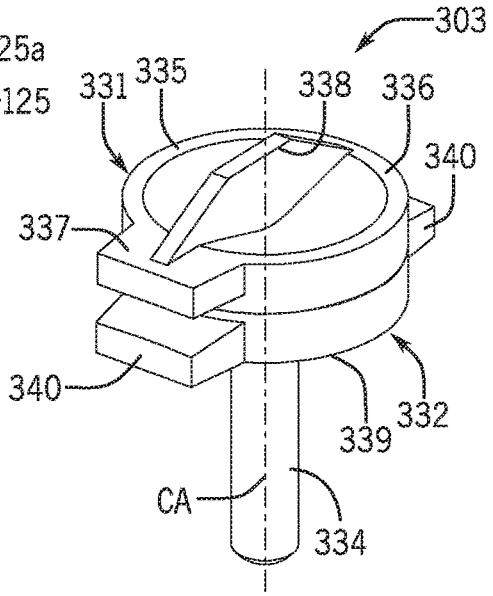
FIG. 6 is a perspective view of the toilet seat hinge lock shown in FIG. 5 in the unlocked position.
Figure 7:
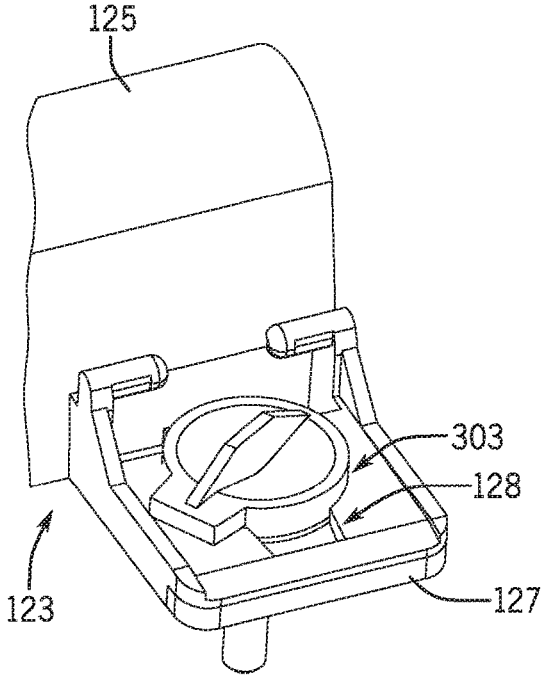
FIG. 7 is a perspective view of the toilet seat hinge lock shown in FIG. 5 in a locked position with the hinge.

FIGS. 5-8 illustrate an embodiment of a hinge lock 303 for securing a hinge 123 to a toilet. The hinge lock 303 moves relative to the hinge 123 between a first (e.g., unlocking) position, as shown in FIG. 5, in which the hinge 123 is unsecured to a toilet (not shown), and a second (e.g., locking) position, as shown in FIG. 7, in which the hinge 123 is secured to a toilet through the hinge lock 303.

Figure 9:
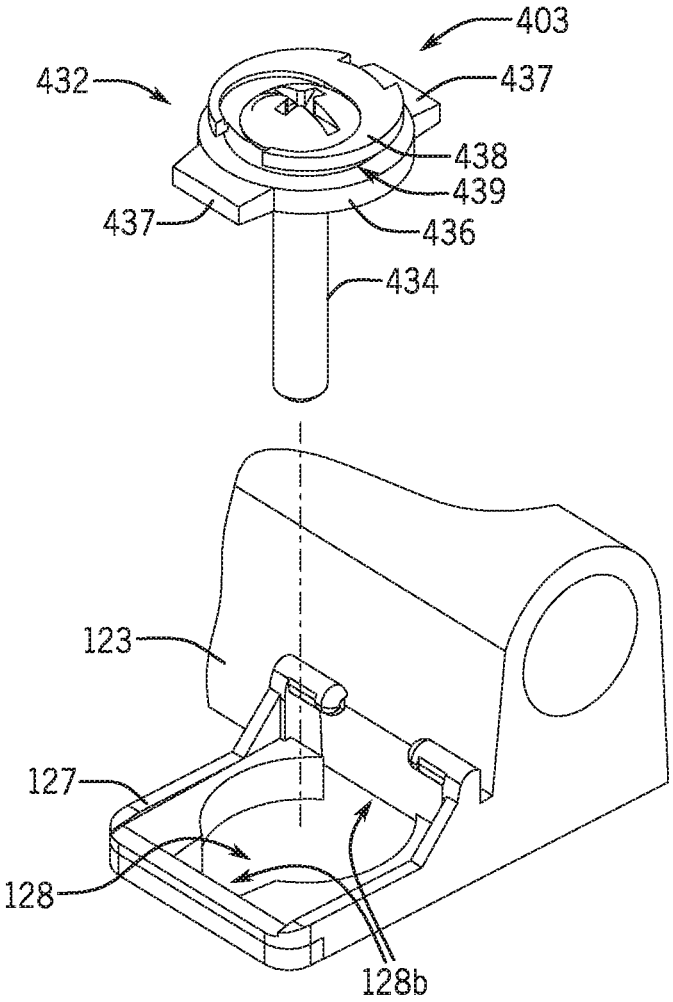
FIG. 9 is a partially exploded perspective view of an embodiment of a toilet seat hinge lock and hinge.

As shown in FIG. 5, the hinge 123 includes a base 125 that is elongated laterally (i.e., side to side with respect to the toilet) and includes a bore 125*a* extending longitudinally through the base 125 in the lateral direction. The bore 125*a* receives one or more other elements/components (e.g., pivot, damper, another hinge element, etc.). Extending rearward away from the base 125 is a hinge mount 127 associated with each mounting location (e.g., a two mount hinge will include two hinge mounts either separately or integrally formed). Each hinge mount 127 is secured to the toilet (e.g., the upper surface 111 of the bowl 101) through an associated hinge lock 303. As shown, each hinge mount 127 includes a flange that extends from the base 125 and includes an opening 128 therein for receiving a hinge lock 303. As shown in FIG. 9, the opening 128 is generally keyway shaped having a substantially circular portion 128*a* overlapping with a substantially rectangular portion 128*b*. The keyway opening 128 facilitates securing the hinge 123 to a toilet with the hinge lock (e.g., the hinge lock 303, 403, 503, etc.).

Figure 8:
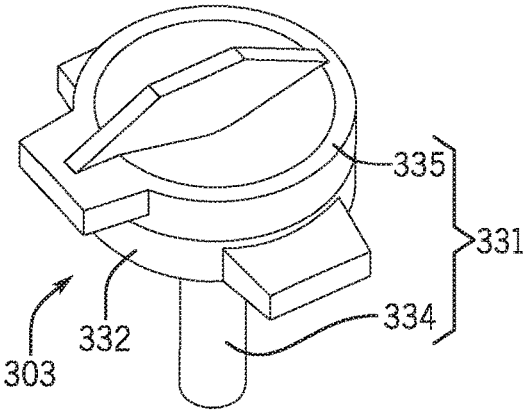
FIG. 8 is a perspective view of the toilet seat hinge lock shown in FIG. 7 in the locked position.

The hinge lock 303 is shown to include a locking member 331 and a locating member 332. As shown in FIGS. 6 and 8, the locking member 331 includes a threaded shaft 334 and a head 335 disposed on the end of the shaft 334. The shaft 334 threads to a fastener (e.g., nut, etc.) to clamp the hinge 123 between the head 335 and a portion of a toilet (e.g., the bowl 101). The head 335 is coupled to (e.g., over-molded onto) the shaft 334 (e.g., fixedly coupled, rotatably coupled), and the head 335 includes an annular base 336 and one or more than one flange 337 extending radially outward from the base 336 relative to a central axis CA (of the shaft 334). For example, the head 335 may include two flanges 337 extending radially away from the base 336 on opposite sides of the base 336. Each flange 337 retains (e.g., contacts) the hinge mount 127 in a locking position to secure the hinge mount 127 in place. As shown in FIG. 6, a tab 338 extends upwardly from the base 336 and transversely to the flange 337 to facilitate rotation or grasping the locking member 331 during assembly/disassembly.

The locating member 332 includes an annular base 339 and one or more flanges 340 extending radially outward from the base 339 relative to the central axis CA. As shown in FIGS. 6 and 8, two flanges 340 extend radially outward from opposite sides of the base 339, and each flange 340 has a generally rectangular shape that complements the rectangular portion 128*b* of the opening 128 in the hinge mount 127. It is noted that each flange may have another shape that complements a portion of an opening in the hinge mount. The locating member 332 includes an opening (e.g., a central opening) in the base 339 to receive the shaft 334 of the locking member 331 to allow relative rotation between the locating member 332 and the locking member 331.

During assembly, the locating member 332 is coupled to the locking member 331 by inserting the shaft 334 of the locking member 331 into the opening of the locating member 332 and sliding the locating member 332 up to the head 335 of the locking member 331. The coupled locating member 332 and locking member 331 are then coupled to a hinge mount 127 of a hinge 123 by inserting the locating member into the opening 128 in the hinge mount 127 with the flanges 340 aligned with and engaging corresponding portions (e.g., rectangular portions 128*b*) of the opening 128. The shaft 334 of the locking member 331 extends through the opening 128 and an opening in the toilet (to which the hinge 123 is being secured to), and a fastener (e.g., nut, etc.) is coupled to the shaft 334 to clamp the hinge 123 to the toilet through the head 335 and the fastener.

Figure 10:
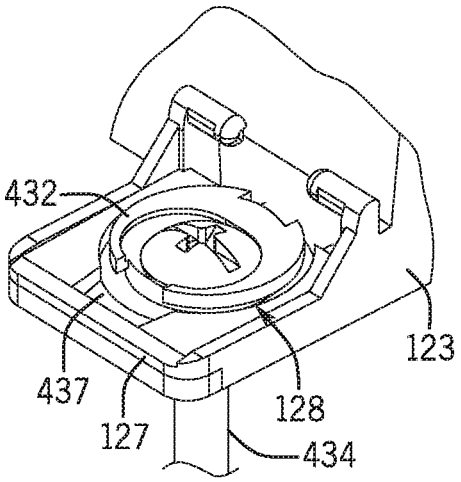
FIG. 10 is a perspective view of the toilet seat hinge lock shown in FIG. 9 partially assembled with the hinge.

FIGS. 9-13 illustrate an embodiment of a hinge lock 403 for securing a hinge 123 to a toilet. As shown in FIG. 9, the hinge lock 403 includes a locating member 432 and a threaded fastener 434. The locating member 432 includes a base 436 and two flanges 437 extending radially outward from opposite sides of the base 436. The fastener 434 extends through an opening in the base 436 with a head of the fastener 434 contacting the base 436 (e.g., disposed in a pocket of the base) to secure the locating member 432 to another element/component of the system (e.g., the toilet). Disposed on the base 436 is a locking feature 438 having a channel 439 (e.g., groove, etc.) extending into an outer periphery of the locking feature 438. The channel 439 receives a locking member 431 and is spiral shaped (e.g., threaded) to facilitate rotation of the locking member 431 relative to the locking feature 438, as discussed below. As shown in FIGS. 9 and 10, the locating member 432 is received in the opening 128 of the hinge mount 127 with the flanges 437 in the receiving portions (e.g., rectangular portions 128*b*) of the opening 128, and the fastener 434 extends through the opening in the locating member 432 and the opening 128 in the hinge mount 127 in order to engage with (e.g., thread to) another fastener (e.g., a nut) on the other side of the portion (e.g., wall) of the toilet.

Figure 11:
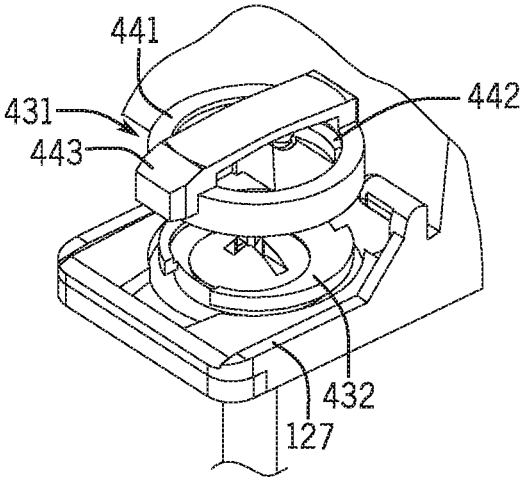
FIGS. 11-13 are perspective views of the toilet seat hinge lock shown in FIG. 9 in various stages of assembly with the hinge.
Figure 12:
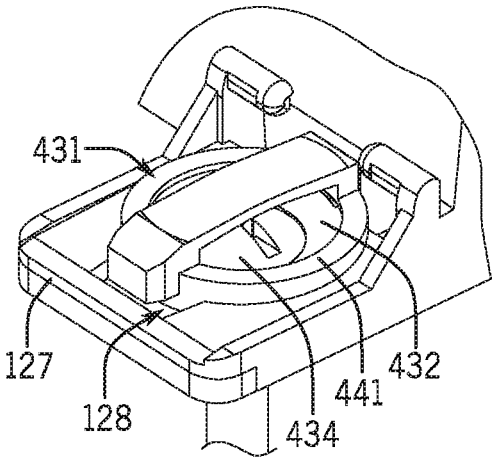
Figure 13:
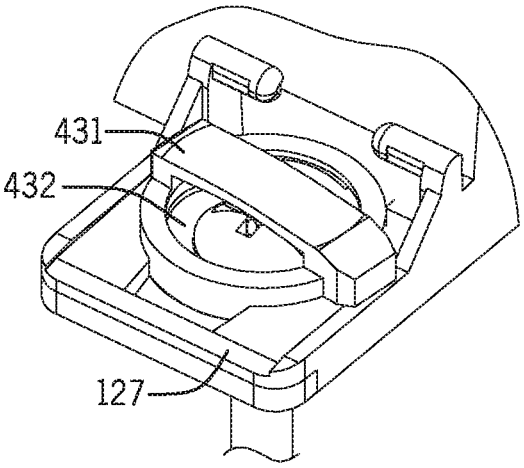

As shown in FIGS. 11-13, the hinge lock 403 includes a locking member 431 to secure the hinge 123 in place on the toilet. As shown, the locking member 431 includes an annular shaped base 441 having one or more than one inwardly extending flange 442 for engaging the channel 439. For example, the locking member 431 may include two flanges 442 disposed on different portions of the base 441 (e.g., opposite sides of the base). Each flange 442 extends radially inward from an inside of the base 441 to engage the channel 439 to couple the locking member 431 to the locating member 432. As shown in FIG. 11, the locking member 431 includes a generally rectangular top member 443 extending over the base 441. The top member 443 makes it easy to turn the locking member 431 by grasping and rotating the top member 443. Ends of the top member 443 extend beyond the outer diameter of the base 441 to overlap with the hinge mount 127 and secure the hinge mount 127 in place.

During assembly of the seat to the toilet using the hinge lock 403, the locating member 432 is inserted into the opening 128 of the hinge mount 127 with the flanges 437 of the locating member 432 received in the receiving portions 128*b* of the opening 128, as shown in FIG. 10, and with the fastener 434 extending through an opening in the toilet. Then, the locking member 431 is inserted into the opening 128 of the hinge mount 127 onto the locating member 432 with the flanges 442 in a non-locking condition with the channel 439 of the locating member 432, as shown in FIG. 12. Then, the locking member 431 is rotated relative to the locating member 432 and the hinge mount 127 with each flange 442 of the locking member 431 engaging a channel 439 of the locating member 432 to couple the locking and locating members together, such as in the locking position shown in FIG. 13. In the non-locking position, the ends of the top member 443 contact the sides of the hinge mount 127 to retain the hinge mount 127 in place on the toilet when the fastener 434 is fastened (e.g., a nut is threaded onto the threads of the fastener 434).

Figure 14:
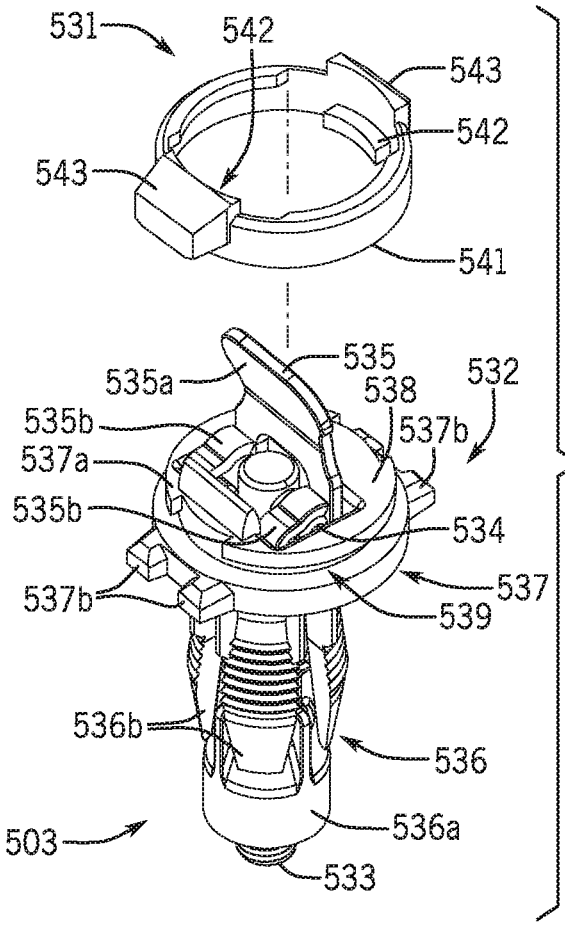
FIG. 14 is a partially exploded perspective view of an embodiment of a toilet seat hinge lock.

FIGS. 14-18 illustrate an embodiment of a hinge lock 503 for securing a hinge 123 to a toilet. The hinge lock 503 includes a locating member 532, which locates the hinge 123 on the toilet, and a locking member 531, which secures the hinge 123 to the toilet through the locating member 532. As shown in FIG. 14, the locking member 531 includes an annular body 541, two inner flanges 542 extending radially inward from opposing inner sides of the body 541, and two outer flanges 543 extending radially outward from opposite outer sides of the body 541.

Figure 19:
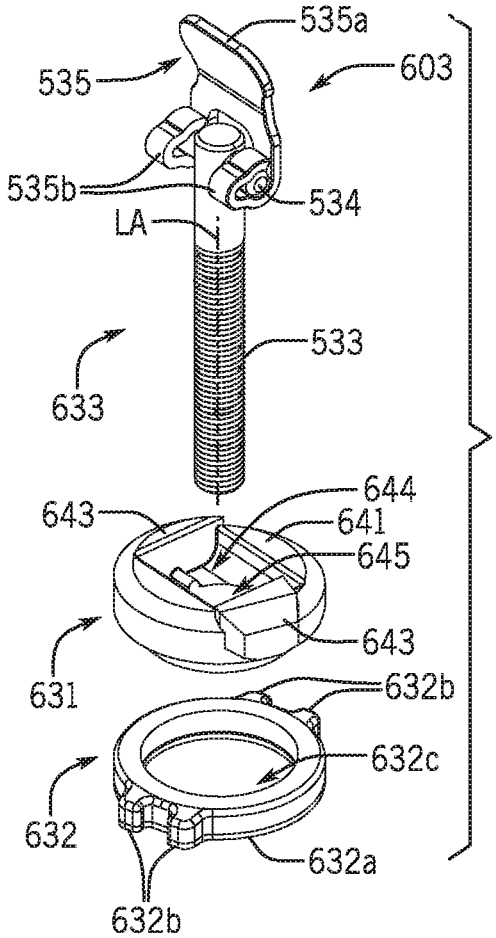
FIG. 19 is a partially exploded perspective view of an embodiment of a toilet seat hinge lock.

Referencing FIGS. 14 and 19, the locating member 532 includes a bolt 533 (e.g., a fastener, etc.) extending along a longitudinal axis LA, a pin 534 extending transversely through the bolt 533 relative to the longitudinal axis LA forming a general cross shape, a cam lever 535 pivotally coupled to the pin 534, an expandable anchor 536 disposed around the bolt 533, and a base 537. The cam lever 535 includes a flange 535*a* and two legs 535*b* extending from the flange 535*a* forming a clevis. Each leg 535*b* forms an opening that receives the pin 534 so that the cam lever 535 can rotate relative to the bolt 533 and pin 534 about a central axis of the pin 534. Further, each leg 535*b* is shaped as a cam to impart a changing clamp force by moving the bolt 533 along the longitudinal axis LA as the cam lever 535 is rotated relative to the bolt 533, as further explained below. The expandable anchor 536 includes a nut 536*a*, which threads to the bolt 533 and is disposed at the bottom of the anchor, and several fingers 536*b* that extend downwardly toward the nut 536*a*. The nut 536*a* threads to the bolt 533, such that rotation of the bolt in a locking direction moves the nut 536*a* upward to splay the fingers 536*b* in the hole of the toilet to hold the anchor 536 in place relative to the toilet (e.g., vitreous).

The base 537 includes a generally annular body 537*a* and one or more flanges 537*b* extending from each of two opposite sides of the body 537*a*. An opening extends through the body 537*a* to receive other elements of the locating member 532. Disposed on the body 537*a* is a locking feature 538 having a channel 539 (e.g., groove, etc.) extending into an outer periphery of the locking feature 538. The channel 539 receives a portion of the locking member 531 and has a shape (e.g., spiral, helical, threaded, etc.) to facilitate rotation of the locking member 531 relative to the locking feature 538.

Figure 15:
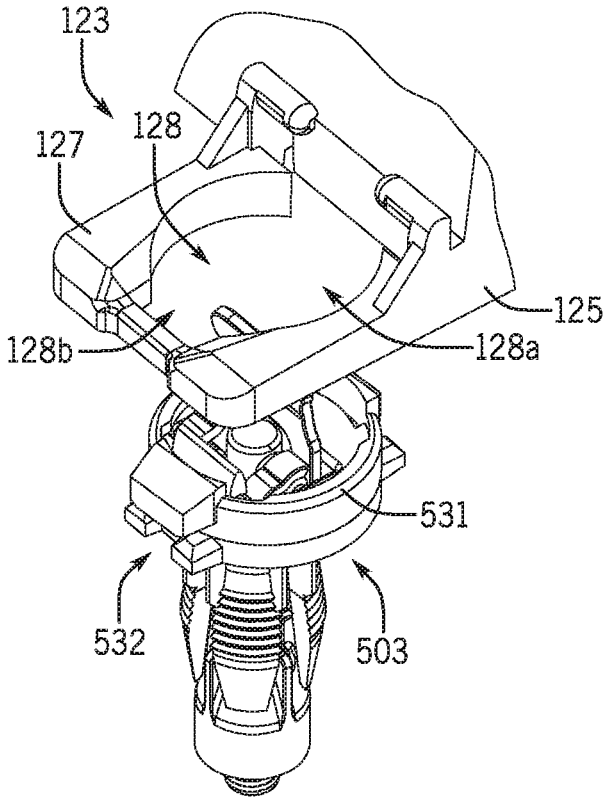
FIGS. 15-18 are perspective views of the toilet seat hinge lock shown in FIG. 14 in various stages of assembly with a hinge.
Figure 16:
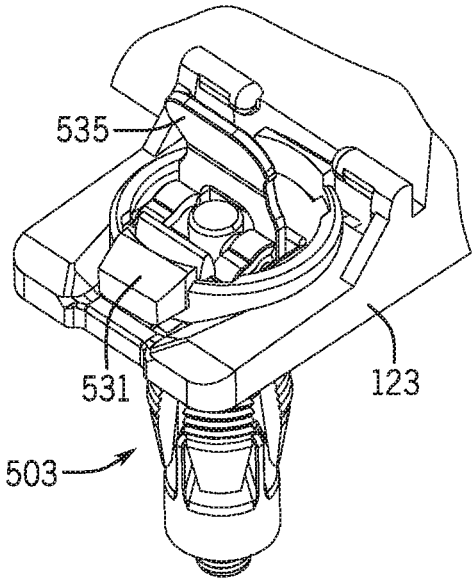
Figure 17:
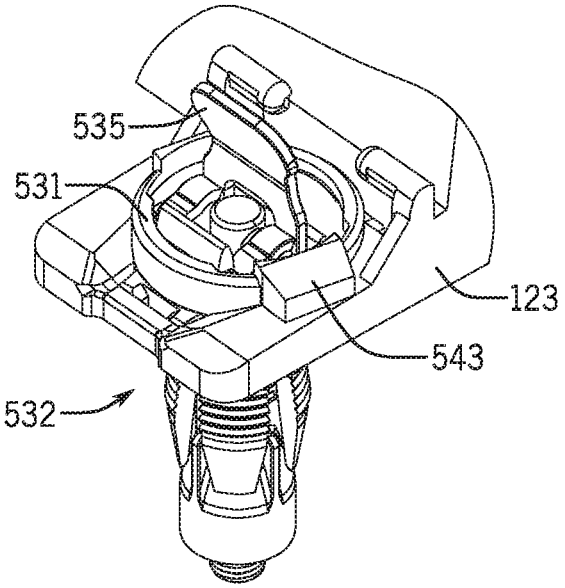
Figure 18:
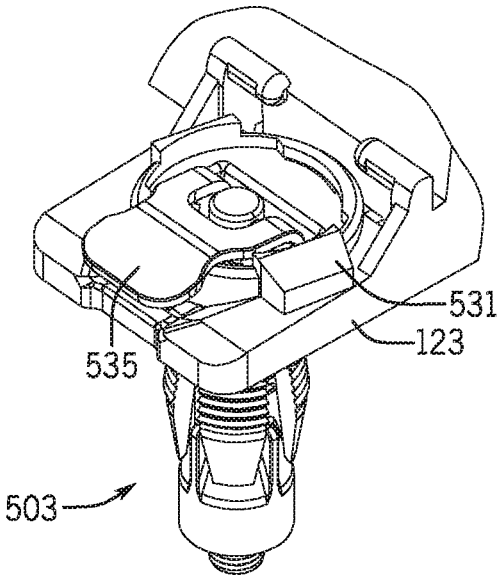

FIGS. 15-18 also illustrate an exemplary method of assembling the hinge 123 to a toilet using the hinge lock 503. As shown in FIG. 15, the hinge lock 503 having the locking member 531 assembled to the locating member 532 with the cam lever 535 in an open position is positioned onto the mount surface of the toilet (not shown) such that the bottom of the base 537 rests on the mount surface. Then the hinge 123 is inserted over the hinge lock 503 onto the toilet, as shown in FIG. 16, with the locking member 531 in the non-locking position. The locking member 531 is rotated (e.g., counter-clockwise) relative to the locating member 532 and the hinge 123 to the locking position, as shown in FIG. 17, in which each inner flange 542 (FIG. 14) engages one associated ramped channel 539 of the locking feature 538 and in which each outer flange 543 retaining part of the hinge 123 to create a vertical compression of the hinge 123 to the toilet (e.g., vitreous). As shown, the locking member 531 rotates approximately one-quarter of one turn/revolution (i.e., 90° plus or minus about 15°) from the non-locking position to the locking position. Then, the cam lever 535 is rotated from the open position (FIG. 17) to the lock position, as shown in FIG. 18, to pull the anchor 536 and base 537 tight to the toilet while adding further compression to hinge 123 between the locking member 531 and the toilet. This arrangement advantageously simplifies and shortens the installation/assembly time to mount the hinge to the toilet.

The hinge lock 503 could optionally utilize an additional gasket (e.g., an over-molded rubberlike resin, such as a thermoplastic elastomer (TPE) or other similar material) provided between the bottom side of the base 537 and the toilet. The compression force from the cam lever 535 can be tailored (e.g., tuned) by employing different thicknesses and durometers to align the cam lever 535 properly. Another option is increasing the size (e.g., length) of the cam lever 535, such as if placed towards the center of hinge, to improve leverage and ease of use. This arrangement may require a larger single hinge cover to hide the hinge lock 503 and the cam lever 535.

FIGS. 19-25 illustrate an embodiment of a hinge lock 603 for securing a hinge 123 to a toilet. The hinge lock 603 includes an integrated locating member and gasket 632 for mounting to the toilet, a locking member 631 disposed on the gasket 632, and a bolt and cam lever assembly 633, which includes the bolt 533, the pin 534, and the cam lever 535 described above. The gasket can be formed separately from and coupled to or integrally formed with (e.g., overmolded onto) the locating member to form the locating member and gasket 632. The gasket is below the locating member and is made from a material, such as TPE, that grips the material of the toilet (e.g., vitreous) to increase the friction between the gasket and the contacting elements (e.g., toilet, locking member). As shown in FIG. 19, the locating member and gasket 632 has an annular body 632*a* with two spaced apart flanges 632*b* extending from each of two opposite outer sides of the body 632*a*. A central opening 632*c* in the locating member and gasket 632 receives the bolt and cam lever assembly 633 upon assembly.

As shown in FIG. 19, the locking member 631 includes a circular body 641 with two outer flanges 643 extending radially outward from opposite outer sides of the body 641. A cavity 644 is disposed in the top of the body 641 for receiving and supporting the bolt and cam lever assembly 633. The two legs 535*b* of the cam lever 535 rest on the top side surfaces that define the cavity 644. A central bore 645 extends from the cavity 644 through the body 641 for receiving the bolt 533.

Figure 20:
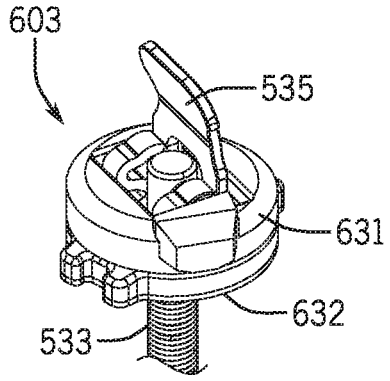
FIG. 20 is a perspective view of the toilet seat hinge lock shown in FIG. 19.
Figure 21:
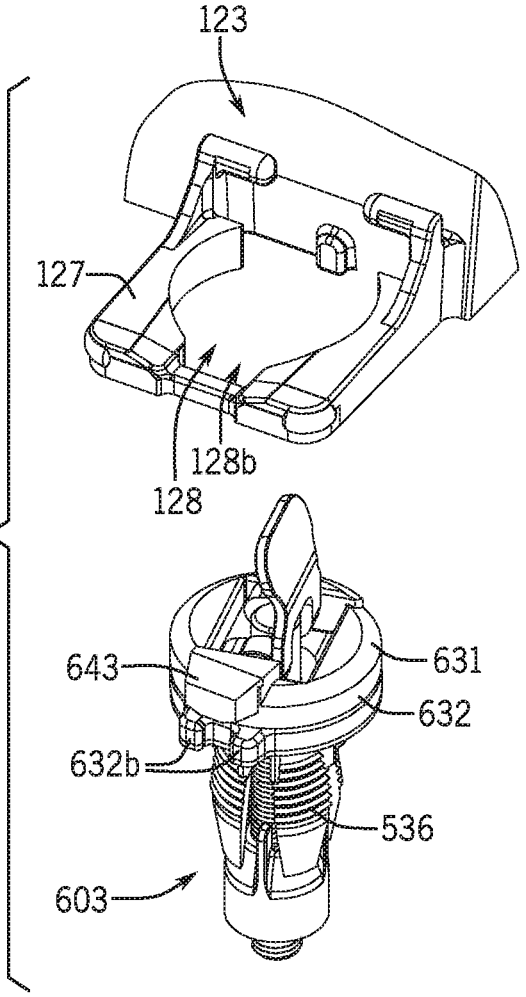
FIGS. 21-25 are perspective views of the toilet seat hinge lock shown in FIG. 20 in various stages of assembly with a hinge.
Figure 22:
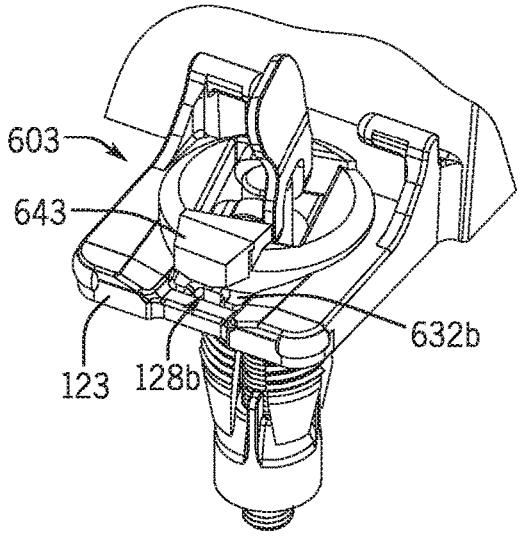
Figure 23:
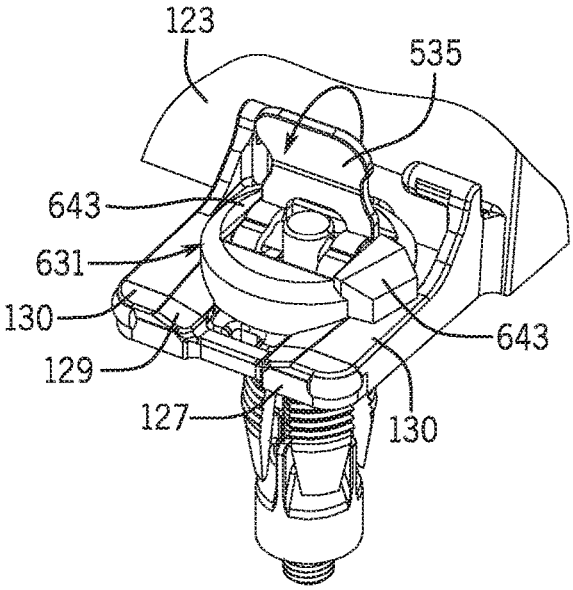
Figure 24:
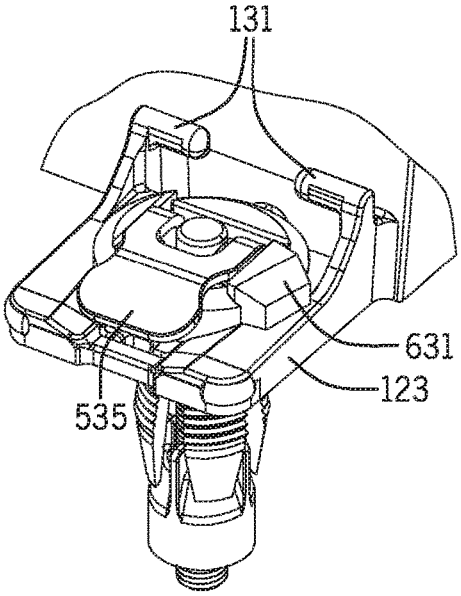
Figure 25:
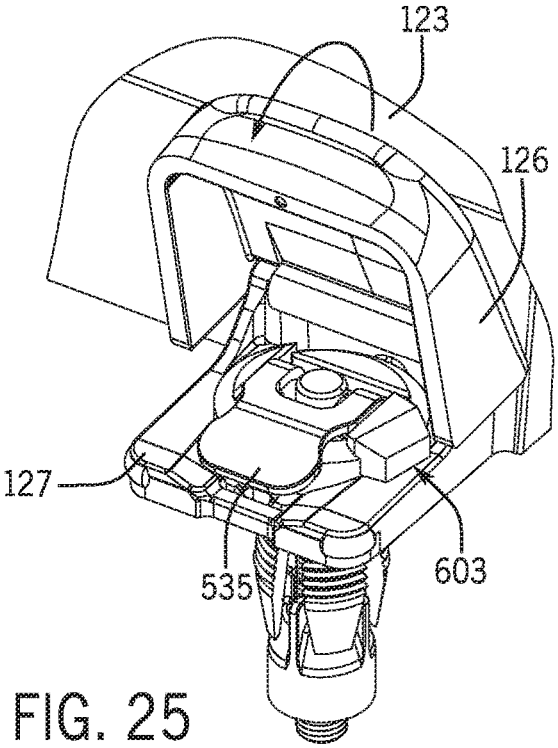

FIGS. 20-25 illustrate an exemplary method of assembling the hinge 123 to a toilet using the hinge lock 603. As shown in FIG. 20, the locating member and gasket 632 is placed on the toilet (not shown), which grips to the toilet material (e.g., vitreous), then the locking member 631 is placed on top of the locating member and gasket 632 with the bolt 533 passing through the portion of the toilet being mounted to. The expandable anchor 536 is coupled to the bolt 533 and hand tightened (e.g., using several revolutions/rotations). Then, the locking member 631 is aligned to receive the hinge 123 such that the flanges 632*b* of the locating member and gasket 632 and the flanges 643 of the locking member 631 are received in the rectangular portions 128*b* of the opening 128 of the hinge 123, as shown in FIGS. 21 and 22. Then, the locking member 631 and bolt and cam lever assembly 633 are rotated relative to the hinge 123 from the non-locking position shown in FIG. 22 to the locking position shown in FIG. 23 with approximately one quarter of one turn or revolution. The hinge mount 127 includes a ramp such that as the locking member 631 is rotated from the non-locking position to the locking position, the vertical compression load increases. As shown best in FIG. 23, a ramp surface 129 inclines upwardly from the inner edge proximate the rectangular portion 128*b* to the outer edge proximate a top surface 130 that is at the height of the outer edge. In the locking position, a bottom surface of each flange 643 contacts the top surface 130 of the hinge mount 127 to provide the vertical compression force clamping the hinge mount 127 to the toilet. The cam lever 535 of the hinge lock 603 is then rotated downwardly from the open position (FIG. 23) to the securing (e.g., locking) position (FIG. 24) to provide the final vertical compression loading (force) by pulling the bolt 533 (e.g., relative to the anchor 536 and portion of the toilet being mounted to). As shown in FIG. 25, if a cover 126 is provided with the assembly, then the cover 126 can be rotated downwardly from the uncovered position to the covered position concealing the hinge mount 127 and the hinge lock 603 from view, as well as prohibiting dirt and other contaminants from soiling the components of the hinge lock 603. The cover 126 is rotatably mounted to the posts 131 of the hinge mount 127 (FIG. 24).

It should be noted that the gasket of the locating member and gasket 632 can be employed with any of the other hinge lock assemblies disclosed herein. For example, the gasket could be employed with the hinge lock 503 by being disposed between the toilet and the locating member 532 (e.g., the base 537).

Figure 26:
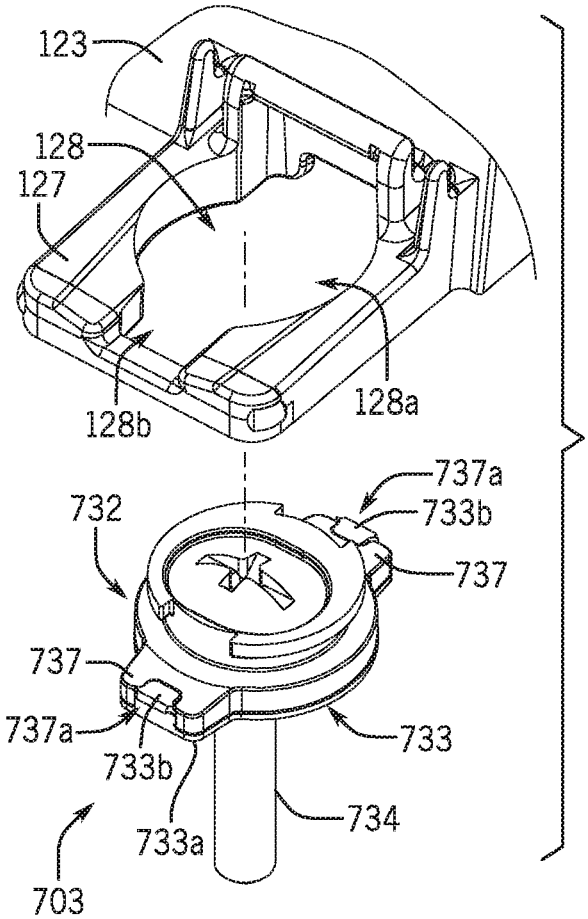
FIG. 26 is a partially exploded perspective view of an embodiment of a toilet seat hinge lock and hinge.

FIGS. 26-30 illustrate an embodiment of a hinge lock 703 for securing a hinge 123 to a toilet. The hinge lock 703 is similar to the hinge lock 403 described above, except when noted. The hinge lock 703 includes a locking member 731, a locating member 732, a gasket 733, and a fastener 734. The locating member 732 is configured basically the same as the locating member 432, except that each flange 737 has a notch 737*a* for receiving a detent projection 733*b* of the gasket 733, as shown in FIG. 26. Similarly, the gasket 733 is basically the same as the gasket of the locating member and gasket 632, except that each flange 733*a* has the detent projection 733*b* for engaging the notch 737*a*. As shown best in FIG. 28, the locking member 731 includes an annular base 741, two internal flanges 742 extending inwardly from opposed sides of the base 741, a top member 743 extending across the top of base 741 to facilitate rotation, and two external flanges 744 extending outwardly from opposite sides of the base 741 for securing the hinge 123 in place.

Figure 27:
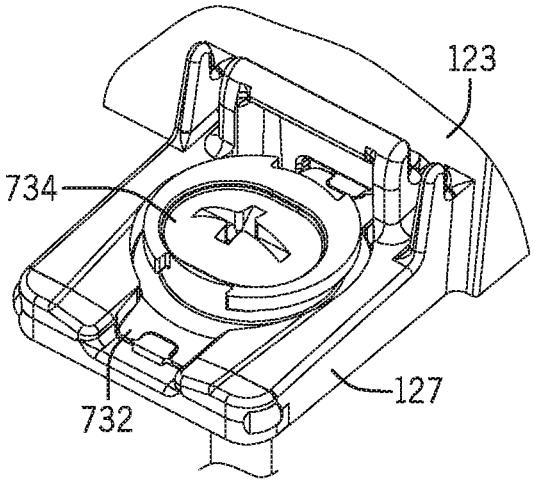
FIG. 27 is a perspective view of the toilet seat hinge lock shown in FIG. 26 partially assembled with the hinge.
Figure 28:
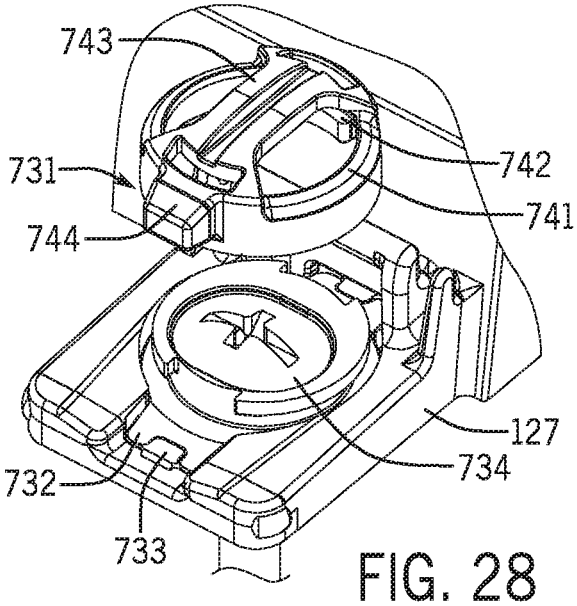
FIGS. 28-30 are perspective views of the toilet seat hinge lock shown in FIG. 26 in various stages of assembly with the hinge.
Figure 29:
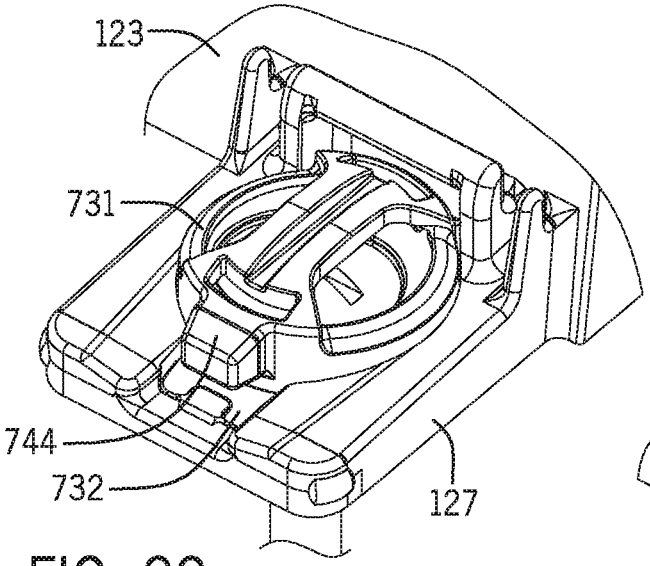
Figure 30:
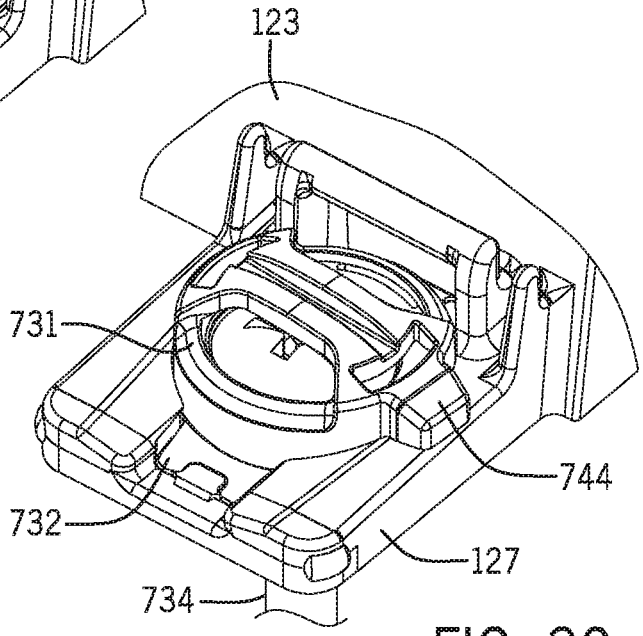

As shown in FIG. 26, the threaded shaft of the fastener 734 is placed into coincident openings in the gasket 733 and the locating member 732 with the locating member 732 on top of the gasket 733, and the head of the fastener 734 nested in a cavity in the top of the locating member 732. The gasket 733 sits on the top surface of the portion of the toilet being mounted to, such that the threaded shaft of the fastener 734 extends through an opening in the portion of the toilet. Another fastener (e.g., nut, anchor, etc.) can be employed to secure the fastener 734 and the locating member 732 (through the head of the fastener 734) in place to the toilet. The hinge 123 is then set on the locating member 732 with the flanges 737 aligned with the rectangular portions 128*b* of the opening 128 of the hinge mount 127, as shown in FIGS. 26 and 27. Then, the locking member 731 is placed on top of the locating member 732 and the hinge mount 127 with the external flanges 744 aligned with slots in the hinge mount 127 associated with the rectangular portions 128*b* of the opening 128, as shown in FIGS. 28 and 29. Finally, the locking member 731 is rotated approximately one quarter of one turn/revolution from the non-locking position (shown in FIG. 29) to the locking position (shown in FIG. 30) to secure the hinge 123 to the toilet by applying a vertical compression force into the top surface 130 of the hinge mount 127. The ramp surface 129 increases the vertical compression force, as noted above. Further, during rotation of the locking member 731 to the locking position, the inner flanges 742 of the locking member 731 engage channels (e.g., channels 439) of the locating member 732 to secure the locking member 731 and locating member 732 together.

Figure 31:
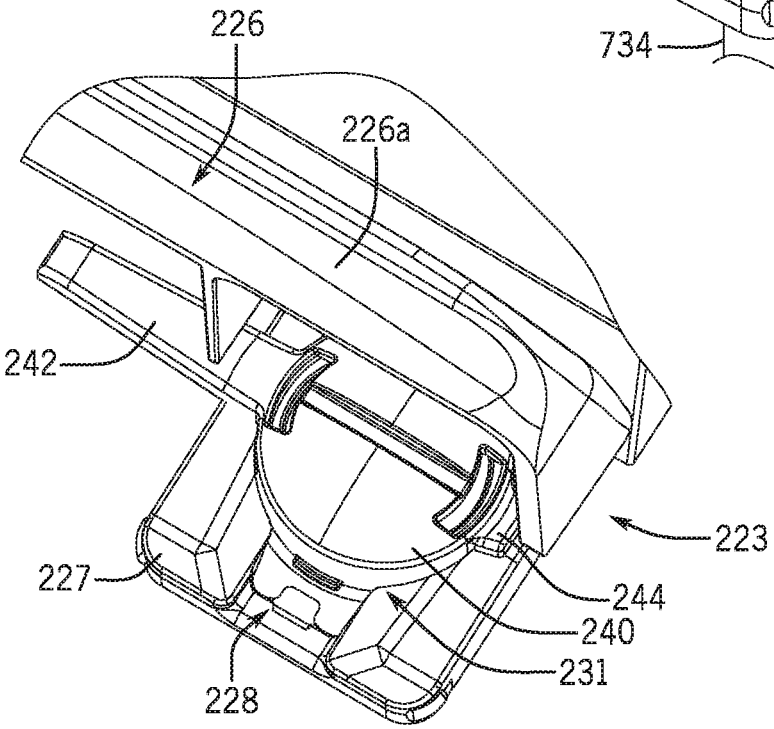
FIG. 31 is a detail view of the toilet seat hinge lock shown in FIG. 4.

FIG. 31 illustrates the toilet seat hinge lock 203 shown in FIG. 4. The hinge lock 203 includes a locating member (not shown), which engages the opening 228 in the hinge mount 227 and has a fastener extending through the portion of the toilet to which the hinge 223 is mounted, and a locking member 231 for securing the hinge 223 in place relative to the toilet and the locating member. The locating member can be configured according to any locating member disclosed herein. The locking member 231 includes a body 240, which receives a portion of the locating member in a cavity to conceal the portion, an inner flange extending inwardly from a wall of the body 240 into the cavity to engage a channel of the locating member, a long flange 242 extending outwardly from part of the outside of the body 240, and a short flange 244 extending outwardly from another part (e.g., opposite part) of the outside of the body 240. The short flange 244 engages the hinge mount 227 (as discussed herein) in a locking position of the locking member 231 (as shown in FIG. 31) to secure the hinge mount 227 to a toilet. The long flange 242 engages the hinge mount 127 and has a length that is longer than the short flange 244 to prevent the cover 226 from being moved to the closed position (covering the hinge mount 227 and the locking member 231) in a non-locking position of the locking member 231, as shown in FIG. 3. In the non-locking position, the long flange 242 prevents the cover 226 from fully closing by limiting rotation of a wall 226*a* of the cover 226. From the non-locking position to the locking position, the locking member 231 is rotated approximately one quarter of one turn in the counter-clockwise direction.

FIGS. 37-47 illustrate additional embodiments of hinge locks 903, 1003, 1103 for securing the hinge 123 to the toilet 100. The hinge lock 903 shown in FIG. 37 includes a locking member 905 for retaining the hinge mount 127 of the hinge 123 to the toilet 100, a gasket 906 disposed between the toilet 100 and the locking member 905, as well as a bolt 907 and a nut 908 for securing the locking member 905 to the toilet 100. The locking member 905 has a base 950 seated on the gasket 906, an outer flange 952 extending outwardly around at least a portion of the base 950 to overhang and retain a counterpart portion of the hinge mount 127 upon assembly, and a cavity 954 disposed in the base 950 to receive the bolt 907. The base 950 is assembled in the opening 128 of the hinge mount 127 with the flange 952 overhanging a portion of the top surface 130 of the hinge mount 127 to retain the hinge mount 127 in place on the toilet 100. The bolt 907 is inserted into the cavity 954 so that the threaded shaft 970 of the bolt 907 extends through the cavity 954 and a hole in the toilet 100, with the head 972 of the bolt 907 in the cavity 954. The locking member 905 and the hinge 123 are retained in place upon tightening of the nut 908 over the threaded shaft 970. The nut 908 includes a threaded sleeve 980 for threading to the threaded shaft 970, a tapered (e.g., frusto-conical shaped) lead-in 982 on the leading end of the sleeve 980 for engaging the hole in the toilet 100 from the opposite side as the bolt 907, and a flange 984 disposed at the trailing end of the sleeve 980 to make it easier for a person to rotate the nut 908 when threading the nut 908 on the bolt 907.

Figure 37:
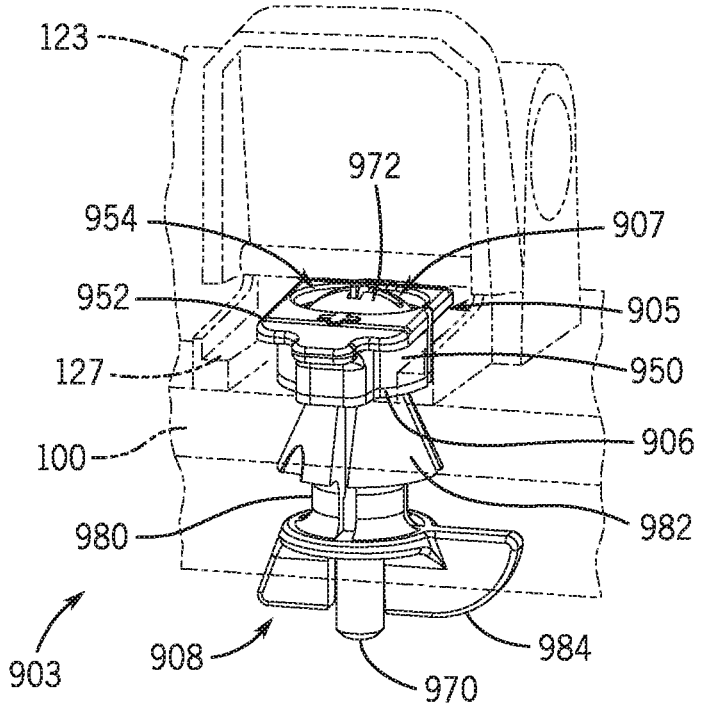
FIG. 37 is a perspective view an embodiment of a toilet seat hinge lock and hinge.
Figure 38:
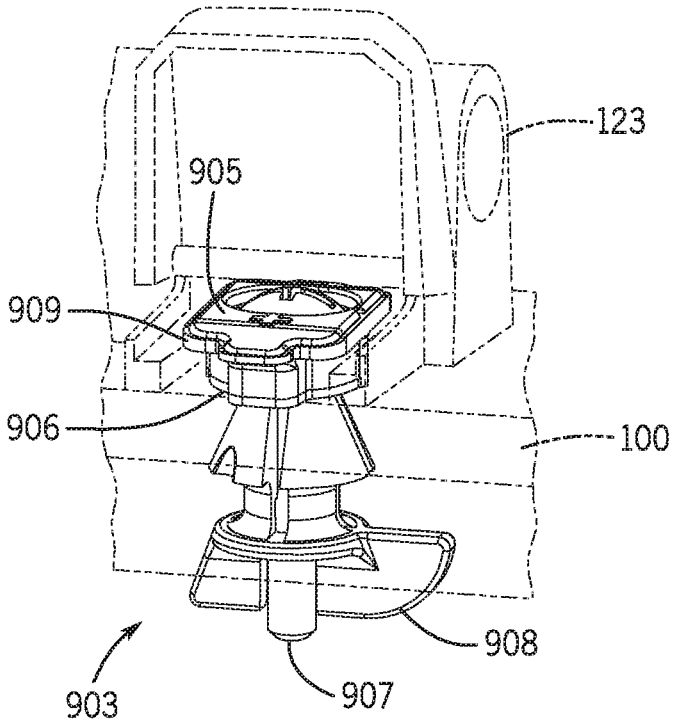
FIG. 38 is a perspective view an embodiment of a toilet seat hinge lock and hinge.

The hinge lock 903 shown in FIG. 38 is configured the same as the hinge lock 903 shown in FIG. 37, except it further includes another gasket 909 provided between the flange 952 of the locking member 905 and the hinge mount 127. The gaskets 906, 909 are made from a material that increases the friction and/or provides compliance/compression between the two adjacent elements/components of the system. One exemplary material is TPE, although other materials can be employed. The gasket 906 grips the material of the toilet (e.g., vitreous) and the material of the locking member 905 to aid installation/assembly; and the gasket 909 compresses elastically upon tightening of the nut 908 to the bolt 907 to improve the retention force between the hinge 123 and toilet 100 from the hinge lock 903.

Figure 39:
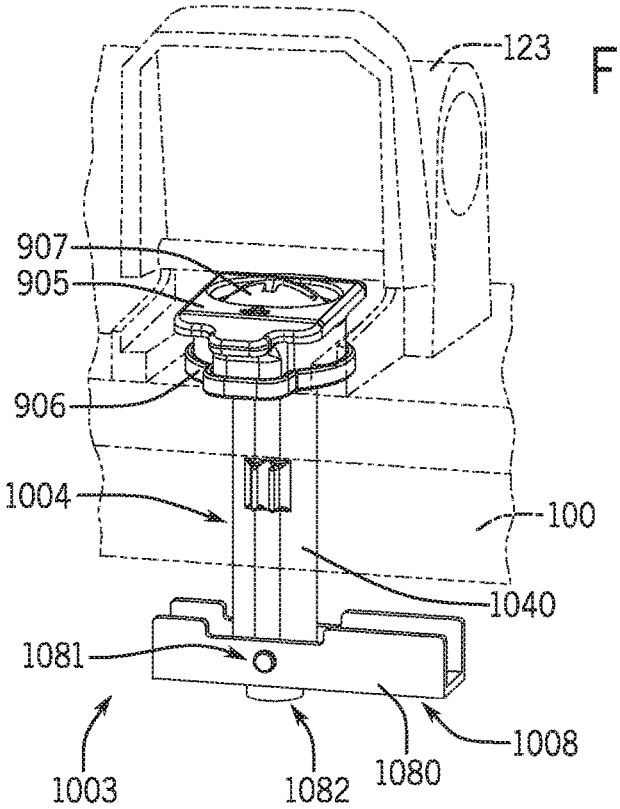
FIG. 39 is a perspective view an embodiment of a toilet seat hinge lock and hinge.

The hinge lock 1003 shown in FIG. 39 includes a includes a locking member 905 for retaining the hinge mount 127 of the hinge 123 to the toilet 100, a gasket 906 disposed between the toilet 100 and the locking member 905, as well as a bolt 907, a sleeve 1004, and a nut 1008 for securing the locking member 905 to the toilet 100. The locking member 905, the gasket 906, and the bolt 907 are configured the same as described above. The sleeve 1004 has a hollow body 1040 having a longitudinal bore through which the threaded shaft 970 of the bolt 907 extends in order to thread to the nut 1008. The sleeve 1004 can be integrally formed with or formed separately from and coupled to the gasket 906. The nut 1008 has a U-shaped body 1080 having a base and two spaced apart legs extending away from the base. The legs of the body 1080 are pivotally coupled to the sleeve 1004 at a pivot 1081. The base of the body 1080 has a threaded opening 1082 for threading to the threaded shaft 970. During assembly, the sleeve 1004 and nut 1008 can be inserted into the hole in the toilet from the same side as the hinge 123 since the nut 1008 can rotate about 90° about the pivot 1081 such that the nut 1008 extends longitudinally with the sleeve 1004 (rather than transverse to the sleeve 1004 as shown in FIG. 39). Once the nut 1008 is through the hole in the toilet 100, the nut 1008 can be rotated to be transverse to the sleeve 1004. As the bolt 907 is rotated (e.g., screwed) in the tightening direction, the nut 1008 threads to the bolt 907 moving toward the toilet 100 and compressing (e.g., crushing) the sleeve 1004. After a predetermined rotation, the nut 1008 contacts an underside of the toilet 100 to retain the hinge 123 to a topside of the toilet 100 through the hinge lock 1003.

Figure 40:
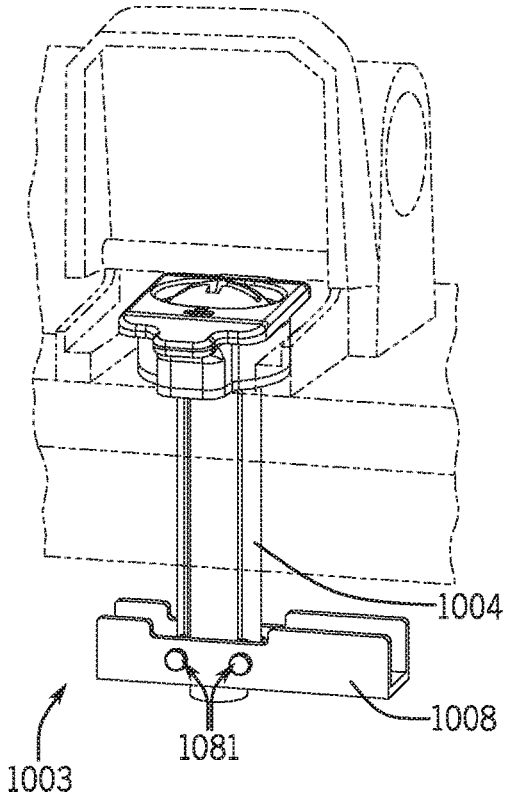
FIG. 40 is a perspective view an embodiment of a toilet seat hinge lock and hinge.
Figure 41:
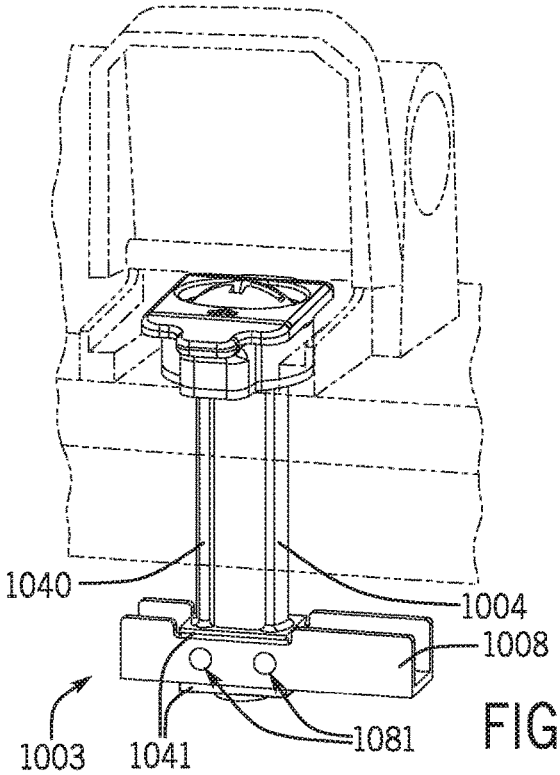
FIG. 41 is a perspective view an embodiment of a toilet seat hinge lock and hinge.

The hinge lock 1003 shown in FIG. 40 is basically the same as the hinge lock 1003 shown in FIG. 39, except that the nut 1008 is coupled to the sleeve 1004 at two spaced apart connections 1081. The hinge lock 1103 shown in FIG. 41 is basically the same as the hinge lock 1003 shown in FIG. 40, except the nut 1008 is further retained by upper and lower walls 1041 extending transversely to the wall forming the hollow body 1040 on opposite sides of the two connections 1081. The upper and lower walls 1041 retain the nut 1008 as the body 1040 compresses during installation/assembly.

The hinge locks as disclosed herein can be employed with seat assemblies that utilize electric power, and such hinge locks and/or hinges can be configured to facilitate routing electricity to the seat assemblies through the hinge assemblies. Thus, the systems utilizing electric power can be incorporated with any of the hinge and hinge locks disclosed herein. Such arrangements may advantageously hide routing of electric wires, protect the wiring to improve durability, as well as provide other advantages.

Figure 32:
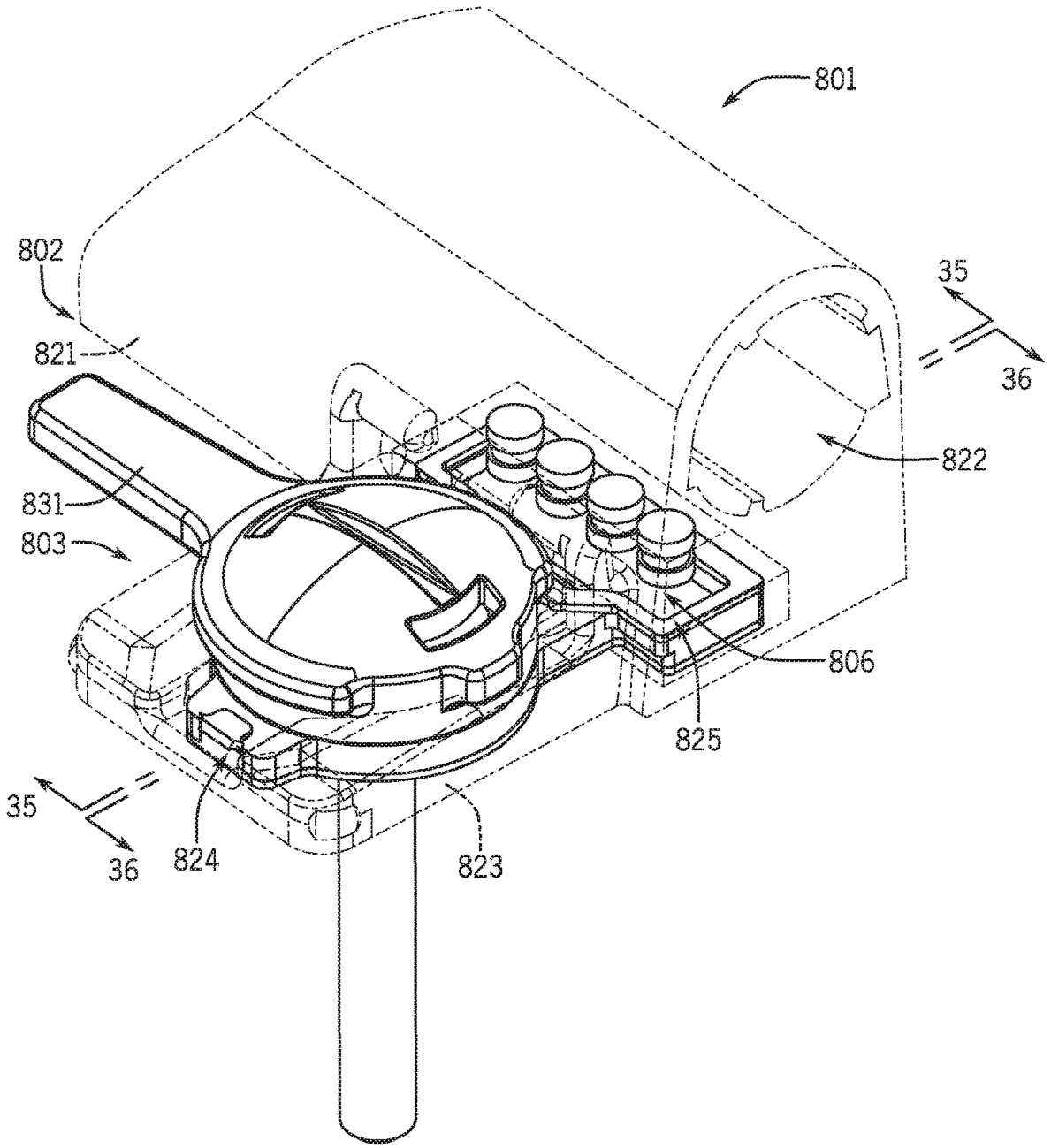
FIG. 32 is a perspective view an embodiment of a toilet seat hinge lock and hinge.
Figure 33:
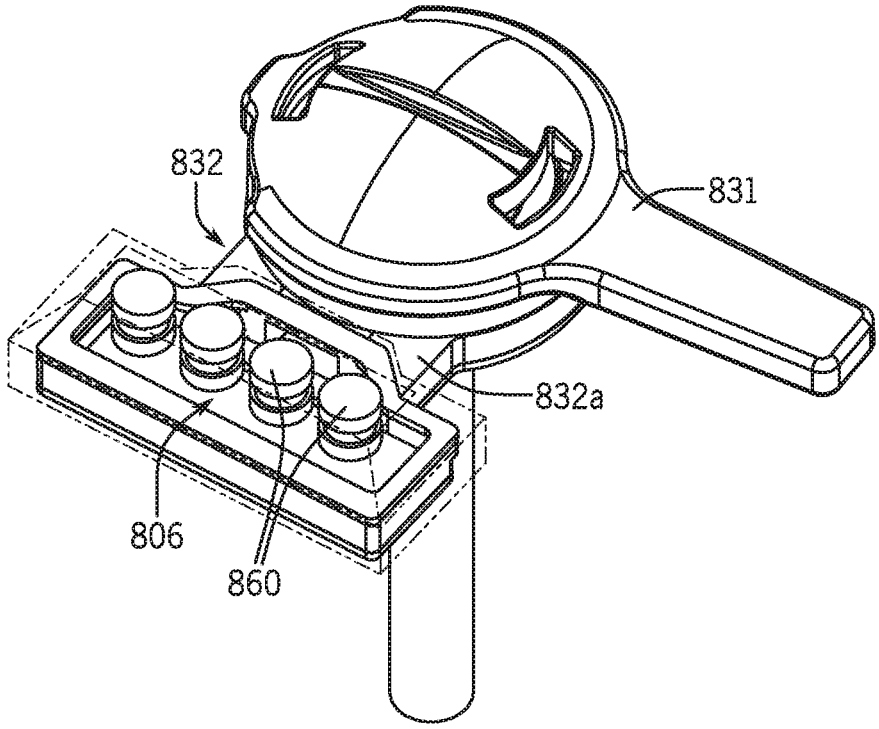
FIG. 33 is a top perspective view of the toilet seat hinge lock shown in FIG. 32.
Figure 34:
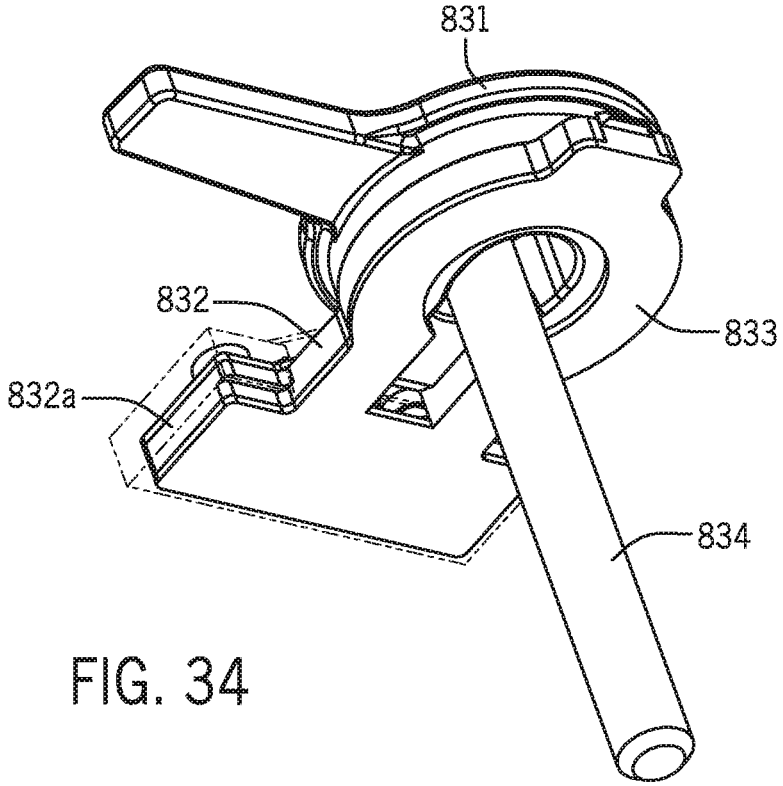
FIG. 34 is a bottom perspective view of the toilet seat hinge lock shown in FIG. 32.

FIGS. 32-36 illustrate an embodiment of a quick release hinge and hinge lock system 801 that includes electrical contacts for transmitting power and/or digital signal(s) to/from the system 801. The system 801 includes a hinge 802 and a hinge lock 803 for securing the hinge 802 to a toilet. As shown in FIG. 32, the hinge 802 includes a hinge base 821 that is mountable to the toilet. The hinge base 821 includes a bore 822 for receiving another element/component (e.g., a pivot for pivotally coupling a seat and cover to the hinge base 821). A hinge mount 823 extends from the hinge base 821 for each mounting location between the system and the toilet. The hinge mount 823 includes an opening 824 for receiving the hinge lock 803; and a cavity 825 is disposed in the hinge 802 for housing one or more electrical components.

Figure 35:
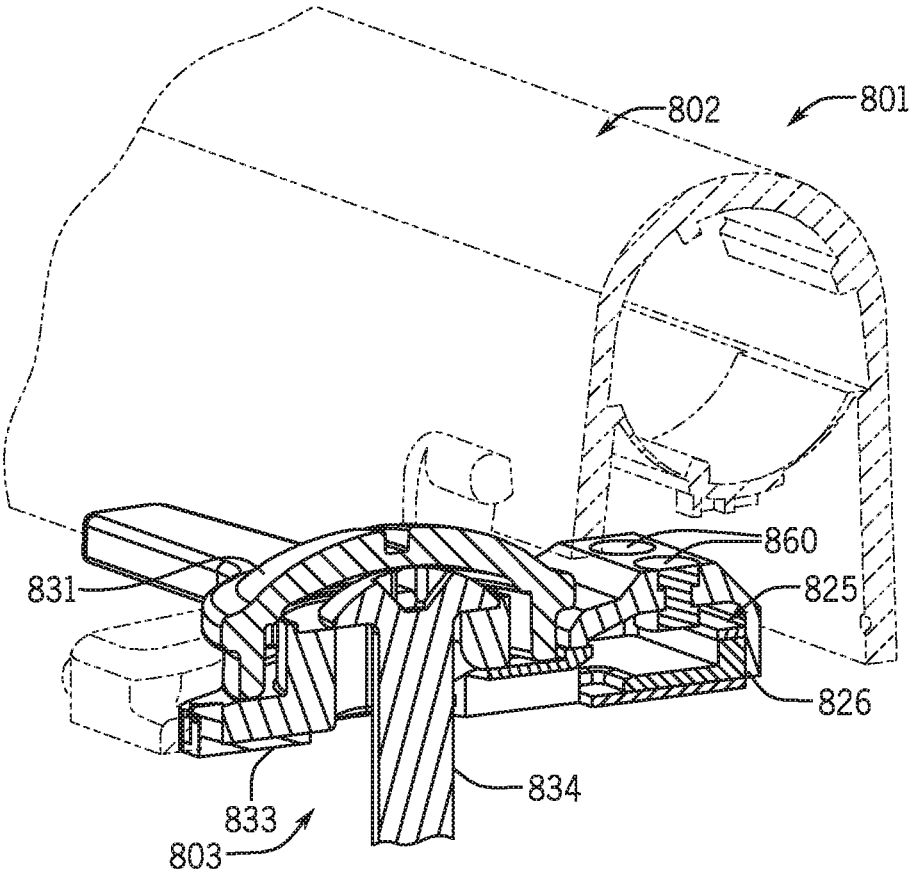
Figure 36:
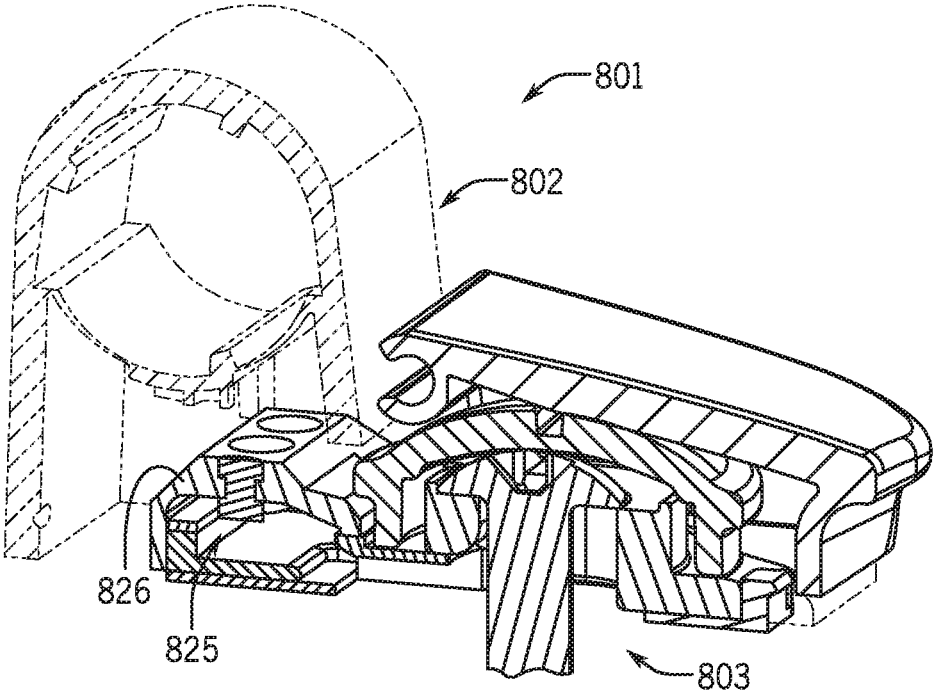
FIG. 36 is another perspective cross-sectional view of the toilet seat hinge lock shown in FIG. 32.

As shown best in FIGS. 32, 35, and 36, a battery 806 having a plurality of terminals 860 is disposed in the cavity 825 of the hinge 802. The terminals 860 supply electric power to other electrical elements/components of the system and/or receive electric power from a source to charge the battery 806. As shown best in FIGS. 33 and 34, the battery 806 is integrated with the hinge lock 803, which further includes a locking member 831, a locating member 832, an optional gasket 833 disposed between the top of the toilet and a bottom of the locating member 832, and a fastener 834. The locking member 831 is basically the same as the locking member 731, except that the locking member 831 includes a long flange and a short flange like the locking member 231 shown in FIG. 31. The locating member 832 is similar to other locating members (e.g., the locating member 732), except that a rear portion 832*a* supports/receives the battery 806. As shown best in FIGS. 35 and 36, the rear portion 832*a* of the locating member 832 and an interior wall 826 of the hinge 802 together define the cavity 825 that houses the battery 806.

Figure 42:
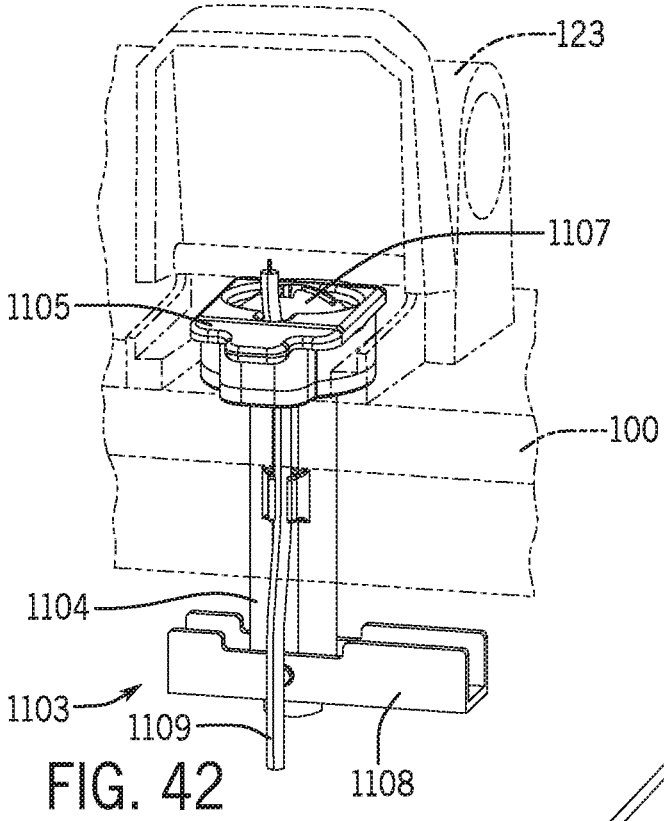
FIG. 42 is a perspective view an embodiment of a toilet seat hinge lock and hinge.

The hinge lock 1103 shown in FIGS. 42-47 advantageously provides for routing of electrical wiring 1109 through the hinge and hinge lock system 1101 to supply power to the battery 806 from a source and/or route electric power from the battery 806 to other electric elements/components in the seat assembly and/or the toilet 100. As shown in FIG. 42, the hinge lock 1103 includes a sleeve 1104 engaging an opening in the toilet 100, a locating member 1105 disposed on one end of the sleeve 1104, a fastener 1107 engaging the locating member 1105 and the sleeve 1104, and a nut 1108 coupled to the other end of the sleeve 1104 and the fastener 1107 to secure the hinge 123 to the toilet 100. The fastener 1107 and the nut 1108 are configured the same as the fastener 907 and the nut 1008 shown in FIG. 39.

Figure 43:
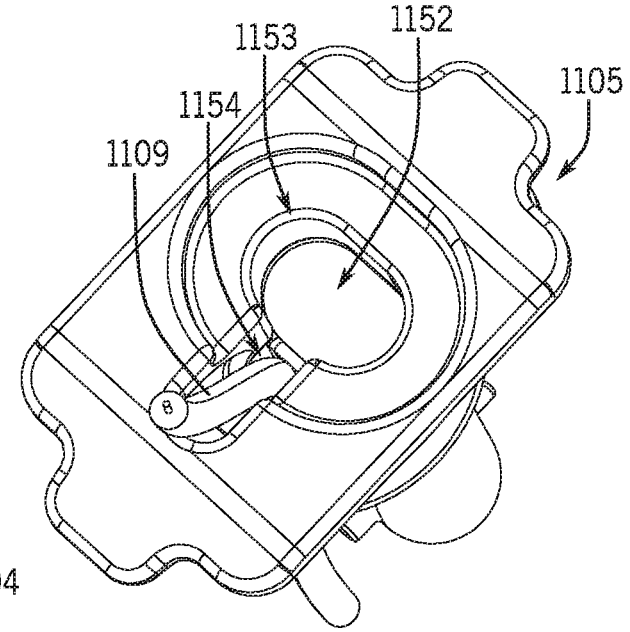
FIG. 43 is a top perspective view of the toilet seat hinge lock shown in FIG. 42.
Figure 44:
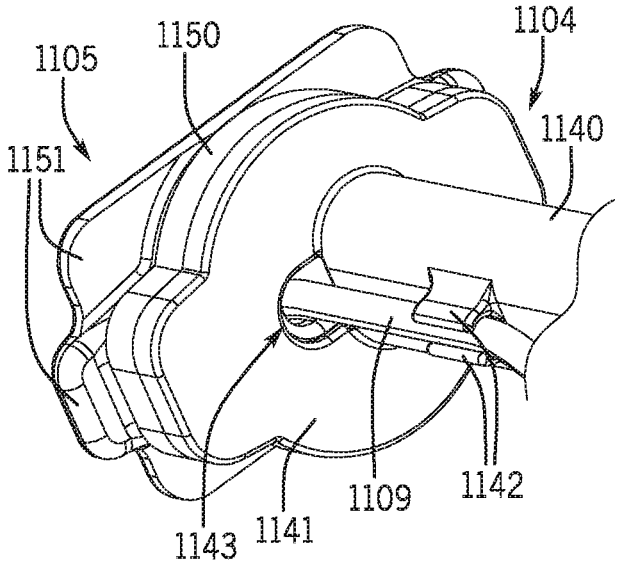
FIG. 44 is a bottom perspective view of the toilet seat hinge lock shown in FIG. 42.
Figure 45:
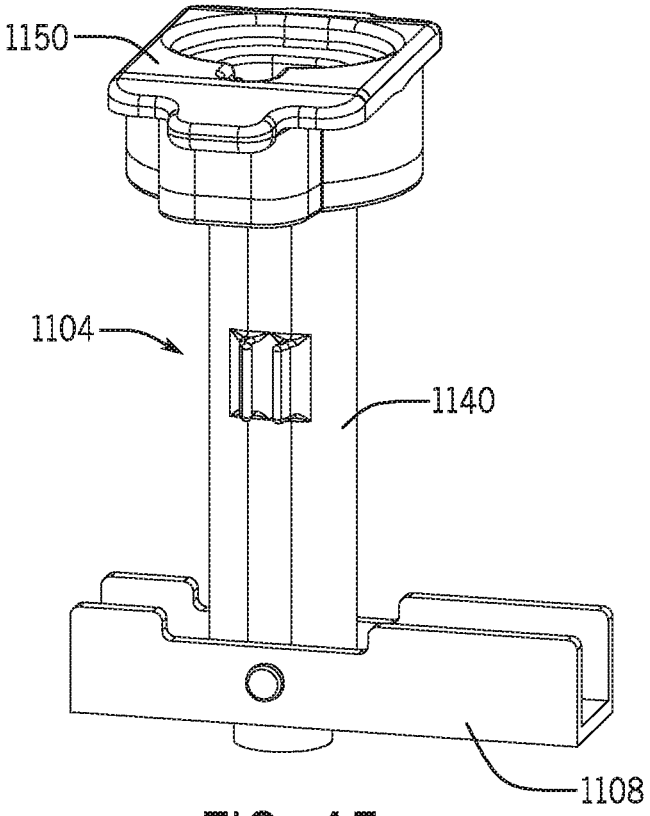
FIG. 45 is a perspective view of the toilet seat hinge lock shown in FIG. 42.

As shown in FIGS. 43-45, the locating member 1105 includes a base 1150, one or more flanges 1151 extending outwardly from the base 1150 to overhang and retain the hinge 123 in place on the toilet when assembled, and a bore 1152 (shown having a slotted cross-section shape in FIG. 43) that receives the shaft of the fastener 1107, a counter bore 1153 located in the top side of the base 1150 and the bore 1152 to receive the head of the fastener 1107, and a notch 1154 through which the wiring 1109 is routed. As shown in FIG. 43, the notch 1154 extends from the bore 1152 through the counter bore 1153 and a portion of the base 1150. Also shown, the wiring 1109 is routed through the notch 1154.

Figure 46:
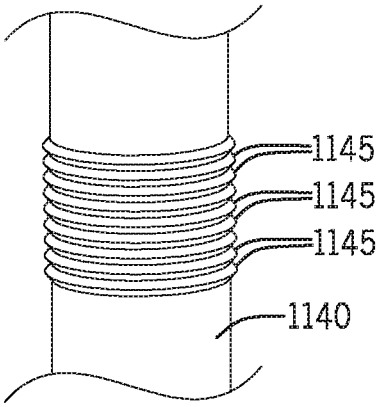
FIG. 46 is a perspective view of a portion of a sleeve of a toilet seat hinge lock in a shortened or crushed configuration.
Figure 47:
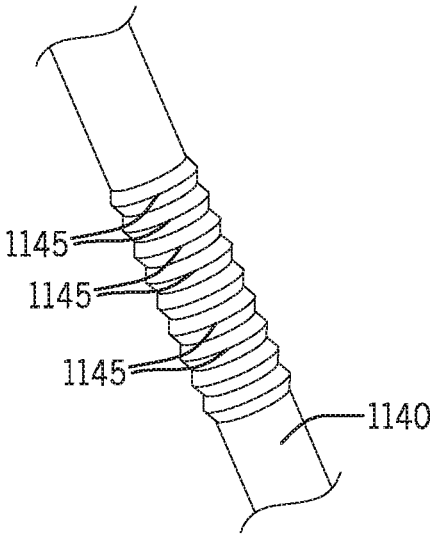
FIG. 47 is a perspective view of the portion of the sleeve of the toilet seat hinge lock shown in an extended or uncrushed configuration.

As shown best in FIG. 44, the sleeve 1104 includes a tubular body 1140 and a flange 1141 extending outwardly from the body 1140 at one end thereof. A pair of spaced apart tabs 1142 extend outwardly from a section of the body 1140 to retain a portion of the wiring 1109 between the tabs 1142. The flange 1141 rests on the toilet when assembled and has an opening 1143 that is in-line with the tabs 1142 allowing the wiring 1109 to be routed through the opening 1143 and into the notch 1154 of the locating member 1105. The flange 1141 can be made from gasket material or another suitable material. As shown in FIG. 45, the body 1140 of the sleeve 1104 can be smooth or as shown in FIGS. 46 and 47, the body 1140 can include corrugations 1145 that are configured to crush when subjected to a threshold compression force and separate (e.g., extend) when subjected to a threshold tensile force. The smooth body 1140 can also crush at a threshold compression force, but the corrugations 1145 better control the location and force of the crushing.

Figure 48:
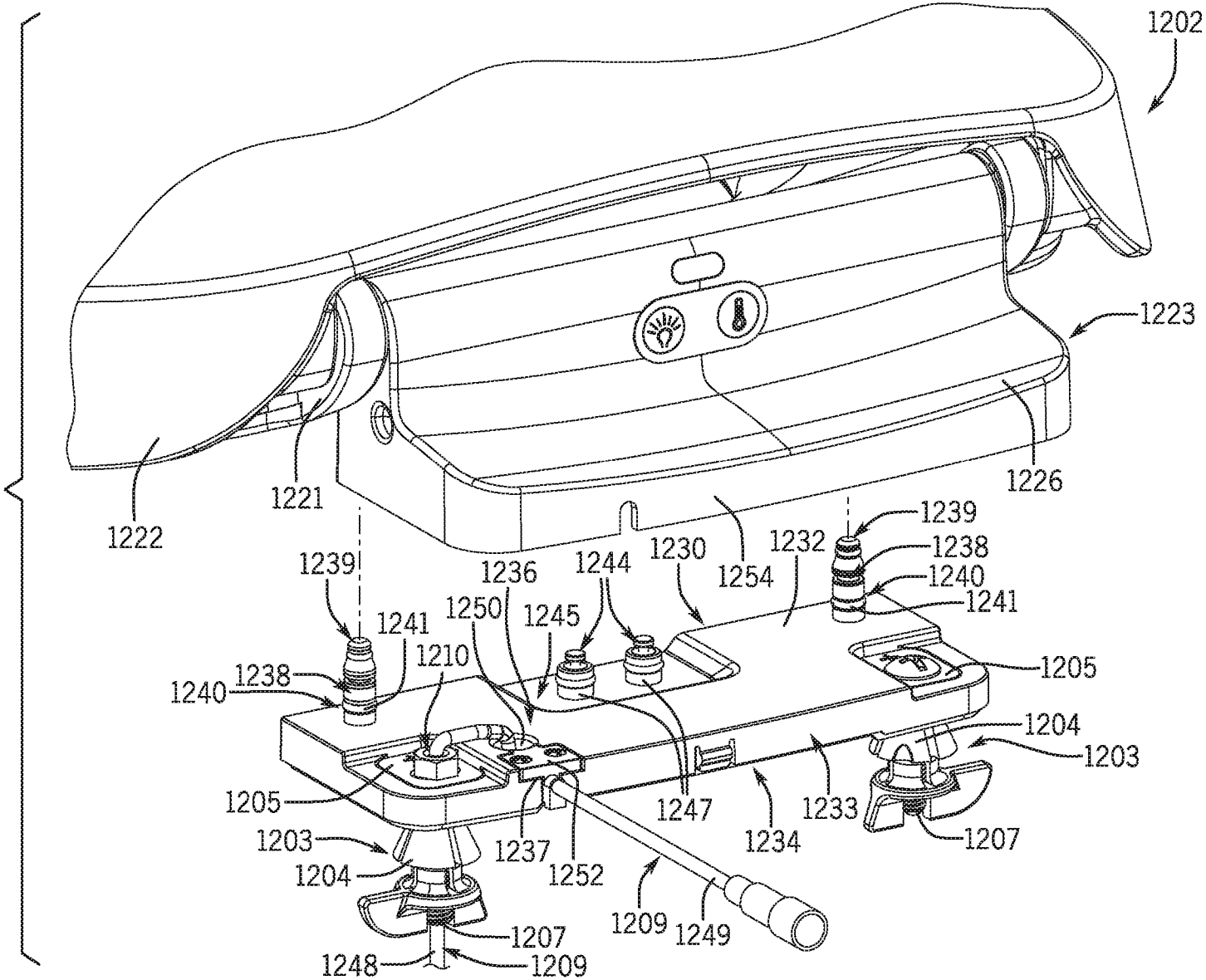
FIG. 48 is an exploded perspective view of a toilet seat assembly, showing a toilet seat hinge being coupled to a docking station.

As shown in FIG. 48, a toilet seat assembly 1202 is shown according to an exemplary embodiment. The toilet seat assembly 1202 includes a lid 1222 (e.g., cover, etc.) covering and concealing a seat 1221, and a hinge 1223 for rotatably coupling the seat 1221 and the lid 1222 to a toilet base. The hinge 1223 includes a fixed body 1224 (shown in FIG. 50). The fixed body 1224 may house electronics for operating the seat 1221 and/or the lid 1222. For example, the fixed body 1224 may house a motor assembly for electrically raising and lowering the seat 1221 and/or the lid 1222. According to other exemplary embodiments, the fixed body 1224 may house or electrically connect to other components, such as a light source configured to transmit light into the bowl 101 of a toilet 100 (e.g., illuminating the toilet 100 at night as a night light) or may power a device configured to release a scent in or proximate the toilet 100 to control or eliminate odor emanating from the toilet. The fixed body 1224 may contain cleaning solution or scent and may be configured to release the cleaning solution or scent into the bowl 101. The fixed body 1224 may also include a sensor for determining the presence of a user and is configured to instruct the motor assembly to automatically raise the seat 1221 and/or the lid 1222 when it senses the presence of the user and to automatically lower the seat 1221 and/or the lid 1222 as well as flush the toilet when it senses the user depart.

According to an exemplary embodiment, the toilet seat assembly 1202 is configured to be controlled remotely. The fixed body 1224 houses a receiver (not shown) which is configured to connect wirelessly (e.g., via Bluetooth, ZigBee, Wi-Fi, etc.) to a controller (not shown). The controller may be an electronic touch-screen or capacitive touch monitor for wireless operation of the toilet seat assembly 1202. According to another exemplary embodiment, the toilet seat assembly 1202 may be operated by a mobile device (e.g., smartphone). For example, when the receiver senses the presence of a mobile device, the receiver determines that a person with a given user profile is approaching the toilet. The toilet seat assembly 1202 responds to the presence of the person either automatically or in response to a user input applied to the controller and transmitted to the receiver. For example, the toilet seat assembly 1202 may lift at least one of the seat 1221 or the lid 1222, such that the toilet 100 is available for immediate use when the person reaches the toilet 100. The toilet seat assembly 1202 may respond differently to actions by users based on pre-determined user profiles. For example, when a first user approaches the toilet 100 with a first user profile, the lid 1222 may lift to a raised position while the seat 1221 remains in a lowered position. However, when a second user approaches the toilet 100 with a second user profile, both the lid 1222 and the seat 1221 may lift to a raised position.

Once a person is finished using the toilet 100 and leaves the immediate vicinity of the toilet 100, the receiver receives a signal from the controller either automatically or in response to a user input applied to the controller. For example, the controller transmits a signal to the receiver to lower one or both of the seat 1221 and the lid 1222 to a lowered position. The receiver may further transmit a signal to the toilet seat assembly 1202 to instruct the toilet 100 to begin a flush sequence for evacuating the contents in the bowl 101. The controller may further be used to operate other electronic devices, including the light source or releasing a scent or cleaning solution into the bowl 101.

Referring still to FIG. 48, the toilet seat assembly 1202 includes a docking station 1230. The docking station 1230 is configured to be electrically coupled to a power supply (not shown) and receive the hinge 1223 thereon, such that the docking station 1230 electrically connects the hinge 1223 to the power supply. The docking station 1230 includes a generally planar docking body 1232 defining a lower surface 1234 configured to be disposed on the upper surface 111 of a toilet bowl 101, and an opposing upper surface 1236. As shown in FIG. 48, the toilet seat assembly 1202 includes hinge locks 1203 extending through the docking station 1230 for coupling the docking station 1230 to the bowl 101. The hinge locks 1203 may be substantially the same as any of the hinge locks described above, such that the docking station 1230 may be quickly connected to (and disconnected from) the bowl 101 just as the toilet seat assemblies, descried above, are quickly connectable and disconnectable from the bowl 101. For example, each hinge lock 1203 includes a sleeve 1204 engaging an opening in the toilet 100, a locating member 1205 disposed on one end of the sleeve 1204 (e.g., in the upper surface 1236 of the docking body 1232), a fastener 1207 engaging the locating member 1205 and the sleeve 1204, and a nut (not shown) coupled to the other end of the sleeve 1204 and the fastener 1207 to secure the docking station 1230 to the toilet 100. The sleeve 1204 may be compressed within an opening in the toilet to further prevent the docking station 1230 from sliding in a lateral direction against the toilet. The sleeve 1204 can be configured having a hollow cylindrical shape or having a generally frusto-conical shape tapering inward toward the vitreous (as shown in FIG. 48) so that the sleeve 1204 can be used with toilets having different sized holes and still remove tolerance to provide a secure fit.

While FIGS. 42-44 show a hinge lock 1103 with electrical wiring 1109 passing through the hinge lock 1103 external to the sleeve 1104, as shown in FIG. 48, a portion of the hinge lock 1203 is hollow and configured to pass electrical wiring 1209 therethrough. Specifically, FIG. 48 shows a hollow fastener 1207, defining a bore 1210 extending therethrough, such that at least a portion of the electrical wiring 1209 is configured to extend through the bore 1210 of the fastener 1207, from the lower surface 1234 of the docking body 1232 to the upper surface 1236 of the docking body 1232. In this configuration, the electrical wiring 1209 passes through the docking station 1230 without interfering with the connection between the sleeve 1204 and the corresponding openings in the bowl 101 receiving the sleeve 1204. While FIG. 48 shows each of the two hinge locks 1203 defining bores 1210 extending therethrough, it should be understood that only one of the hinge locks 1203 defines a bore 1210 and receives electrical wiring 1209 extending therethrough. Similarly, while the docking station 1230 shown in FIG. 48 may have a quick-connect configuration, it should be understood that the docking station 1230 may be more permanently coupled to the bowl 101, while the hinge 1223 remains easily separable from the docking station 1230.

A plurality of locator projections (i.e., locating members) 1238 extend generally upward and away from the upper surface 1236 of the docking body 1232 and are configured to engage corresponding openings 1242 formed in the hinge 1223. Each locator projection 1238 defines an end 1239 extending away from the docking body 1232 and a diameter at the end 1239 that is less than a diameter of a lower portion 1240 of the locator projection 1238. The diameter at the end 1239 is less than a diameter of the opening 1242, such that the locator projections 1238 may be easily received in the corresponding openings 1242 without precisely aligning the openings 1242 with the locator projections 1238. The diameter of the lower portion 1240 of the locator projections is substantially the same as the diameter of the openings 1242, such that as the hinge 1223 is lowered onto the docking station 1230, the openings 1242 begin to tightly engage the lower portion 1240 of the locator projections 1238. In this configuration, the interaction of the locator projections 1238 and the openings 1242 prevents lateral movement of the hinge 1223 relative to the docking station 1230 once the hinge 1223 is installed thereon. A gasket 1241 (i.e., a ring) may be disposed annularly about the lower portion 1240 of the locator projection 1238 and compressed between the locator projection 1238 and the openings 1242 to further secure the hinge 1223 in place on the docking station 1230. While FIG. 48 shows the docking station 1230 having two locator projections 1238, it should be understood that the docking station 1230 may include more or fewer locator projections 1238 or may engage the hinge 1223 in a fixed orientation in other ways.

A plurality of electrical contacts 1244 extend generally upward and away from the upper surface 1236 of the docking body 1232, where each electrical contact 1244 is configured to engage a corresponding electrical contact 1246 recessed in a cylindrical opening formed in the hinge 1223. The electrical contacts 1244 are provided in a recess 1245 formed in the upper surface 1236 of the docking body 1232, protecting the electrical contacts 1244 from damage when the hinge 1223 is not installed on the docking station 1230. The electrical contacts 1244 define a height less than a height of the locator projections 1238, such that the hinge 1223 may first be located and positioned in a lateral direction on the locator projections 1238 and lowered into engagement with the lower portion 1240 of the locator projections 1238 before receiving and engaging the electrical contacts 1244 in the openings having the electrical contacts 1246. A gasket 1247 may be disposed annularly about the electrical contact 1244 and compressed between the electrical contact 1244 and a portion of the hinge 1223 defining an electrical contact opening to further secure the hinge 1223 in place on the docking station 1230. The gasket 1247 may further seal the electrical connection between the docking station 1230 and the hinge 1223, protecting the electrical contacts 1244, 1246 from introduction of water from the nearby toilet bowl 101. While FIG. 48 shows the docking station 1230 having two electrical contacts 1244, it should be understood that the docking station 1230 may include more or fewer electrical contacts 1244. While FIGS. 48-50 show the locator projections 1238 and the electrical contacts 1244 formed as part of the docking station 1230 and the openings 1242 and the electrical contact 1246 openings formed as part of the hinge 1223, it should be understood that the locator projections 1238 and the electrical contacts 1244 may extend from the hinge 1223 and the openings 1242 and the electrical openings 1246 may be formed from the docking station 1230 according to other exemplary embodiments.

Figure 49:
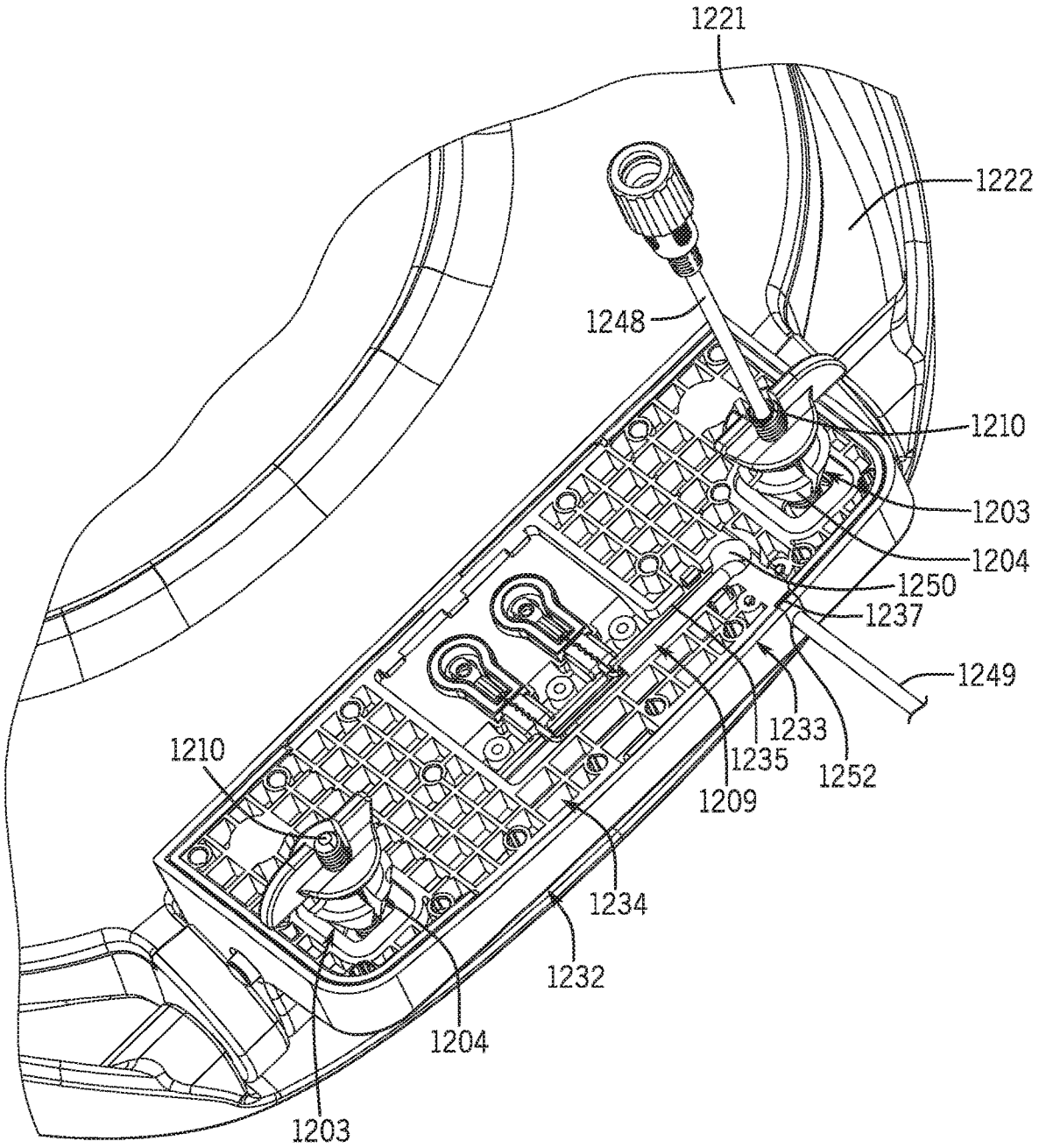
FIG. 49 is a bottom perspective view of the toilet seat assembly shown in FIG. 48.

Referring to FIGS. 48 and 49, the electrical wiring 1209 is shown in more detail. As shown in FIG. 49, the lower surface 1234 of the docking body 1232 defines a first channel 1235 extending laterally therethrough. The first channel 1235 is configured to receive the electrical wiring 1209, such that the electrical wiring 1209 can be concealed within the docking station 1230. The electrical wiring 1209 includes a first electrical wire 1248 extending through the bore 1210 of one of the hollow fasteners 1207, through the first channel 1235, and electrically coupled to one of the (e.g., a first) electrical contacts 1244 at the lower surface 1234. A through hole 1250 extends from the upper surface 1236 of the docking body 1232 to the first channel 1235. The first electrical wire 1248 passes through the through hole 1250 in order to be positioned in the first channel 1235. A second channel 1237 is formed in the upper surface 1236 of the docking body 1232 and extends from a rear edge 1233 of the docking body 1232 to the first channel 1235, through the through hole 1250. A second electrical wire 1249 extends from the rear edge 1233 of the docking body 1232, through the second channel 1237 and the first channel 1235, and electrically couples to another of the (e.g., a second) electrical contacts 1244. A channel cover 1252 is disposed on the upper surface 1236 of the docking body 1232 across at least a portion of the second channel 1237 after the second electrical wire 1249 is inserted into the second channel 1237, such that the second electrical wire 1249 is secured in place, even when the second electrical wire 1249 is pulled away from the docking station 1230. At least one of the first or second electrical wires 1248, 1249 is connected to the power source to power electrical components in the toilet seat assembly 1202. Similarly, at least one of the first or second wires 1248, 1249 is connected to a controller for controlling a function or operation of the hinge 1223, as discussed above.

Figure 50:
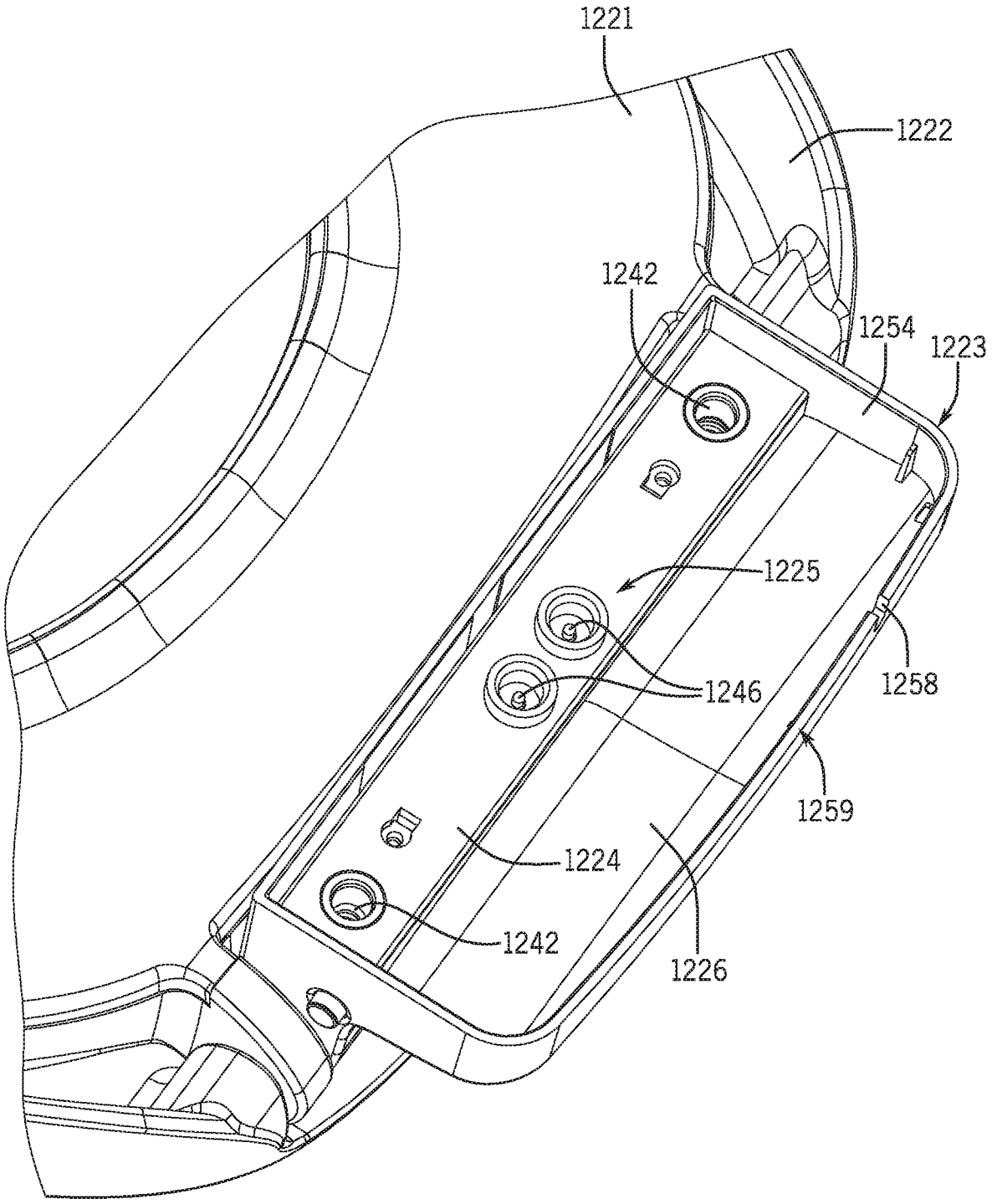
FIG. 50 is a bottom perspective view of the toilet seat hinge shown in FIG. 48.
Figure 51:
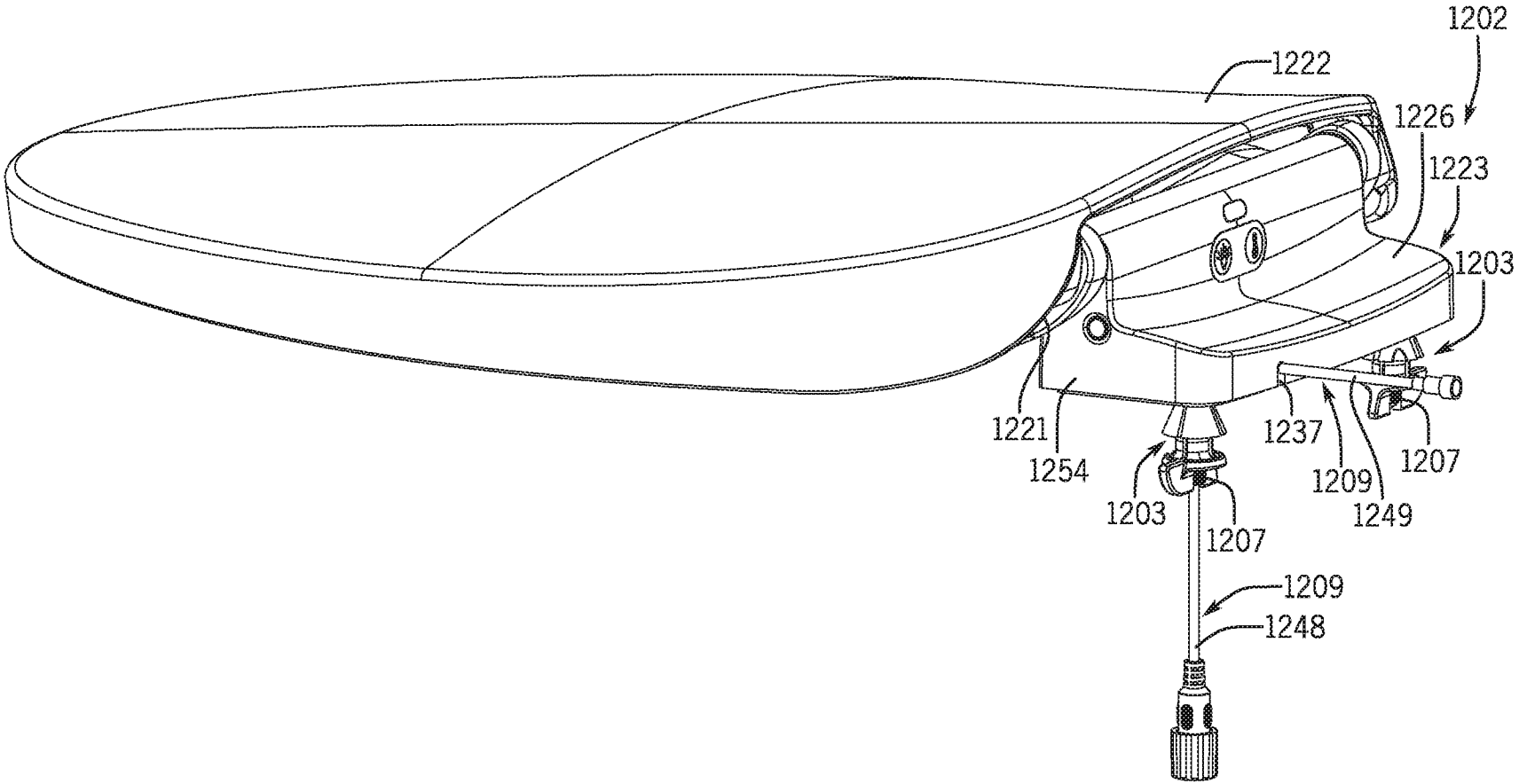
FIG. 51 is a perspective view of the toilet seat assembly shown in FIG. 48.
Figure 52:
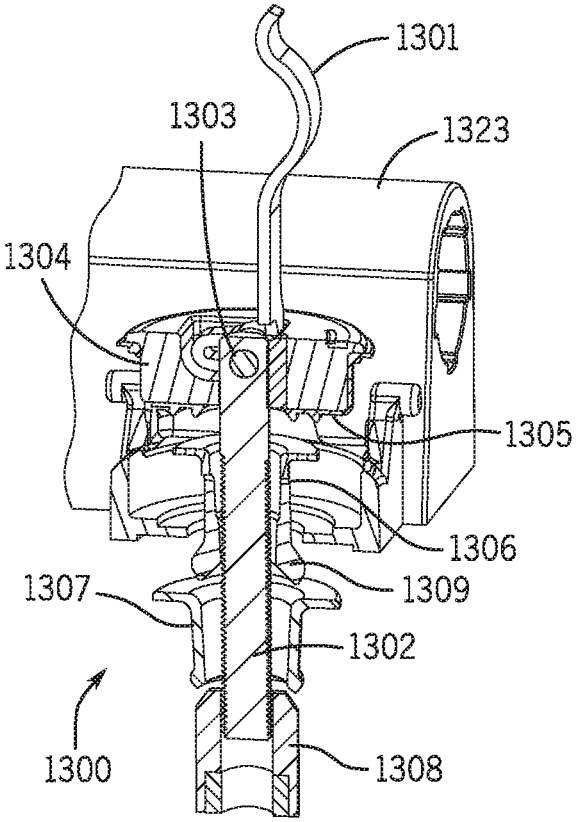
FIG. 52 is a cross-sectional exploded perspective view of an embodiment of a toilet seat hinge.

Referring to FIG. 50, the hinge 1223 is shown according to an exemplary embodiment. The fixed body 1224 forms a portion of the hinge 1223 that defines the openings 1242 and the electrical contact openings 1246. A cover 1226 is formed around the fixed body 1224 and is configured to conceal the docking station 1230 when the hinge 1223 is installed on the docking station 1230. The cover 1226 includes a wall 1254 extending downward at an outer periphery of the cover 1226, enclosing the fixed body 1224. The wall 1254 may define a profile complementary to or larger than an outer periphery of the docking station 1230, such that the docking station 1230 fits inside and may be completely enclosed by the cover 1226. A through hole (i.e., second through hole) 1258 is formed in a rear edge 1259 of the wall 1254 and is aligned with the second channel 1237 of the docking body 1232, such that the second electrical wire 1249 may extend through the wall 1254 for being plugged in outside the hinge 1223. Referring to FIG. 51, the hinge 1223 is shown installed on the docking station 1230. In this configuration, the wall 1254 extends level with or below the lower surface 1234 of the docking body 1232, such that the entire docking station 1230 is concealed from view. As discussed above, when the hinge 1223 is installed on the docking station 1230, the second electrical wire 1249 extends outward from the rear edge 1259 of the wall 1254 through the through hole 1258 for connection to a power source, controller, etc.

Referring again to FIG. 50, a portion of the cover 1226 disposed between the fixed body 1224 and the rear edge 1259 of the wall 1254 is raised above (e.g., further away from the bowl 101) a lower surface 1225 of the fixed body 1224, such that a cavity is formed between the cover 1226 and the upper surface 1236 of the docking body 1232 when the hinge 1223 is installed on the docking station 1230, such that there is space between the upper surface 1236 and the cover 1226 for the first electrical wire 1248 or other wires that extend above the docking body 1232. According to an exemplary embodiment, the fixed body 1224 and the cover 1226 may be integrally formed as part of the hinge 1223.

As shown in FIG. 51, the hinge 1223 is installed on the docking station 1230. In this configuration, the docking station 1230 is coupled to the bowl 101 with the hinge locks 1203, which may alternatively be any of the quick-connect hinge locks discussed in the present application or may include a conventional fastener. As the hinge 1223 is lowered onto the docking station 1230, the openings 1242 engage the ends 1239 of the locator projections 1238, limiting lateral movement of the hinge 1223 relative to the docking station 1230. As the hinge 1223 is further lowered, the openings 1242 engage the lower portion 1240 of the locator projections 1238 and are press-fit onto the locator projections 1238 by compressing the gasket 1241. Similarly, the electrical contact openings 1246 are press-fit onto the electrical contacts 1244 by compressing the gaskets 1247. This press-fit arrangement holds the hinge 1223 securely on the docking station 1230. For example, friction between the sidewalls of the openings 1242 and the gaskets 1241 or between the sidewalls of the electrical contact openings 1246 and the gaskets 1247 prevents the hinge 1223 from being pulled up from the docking station 1230. However, the size (e.g., diameter) of the gaskets 1241, 1247 may be selected, such that a user may overcome the friction to remove the hinge 1223 from the docking station 1230.

The electrical contacts 1244 may be removed from the electrical contact openings 1246 by lifting the hinge 1223 away from the docking station 1230 in order to separate the hinge 1223 from the docking station 1230. The configurations shown in FIGS. 48-51 allows a user to completely remove the seat 1221, the lid 1222, and the hinge 1223 to provide better access for cleaning the entire exposed surface of the bowl 101, whereas traditional powered toilet seats cannot be removed for cleaning without also disconnecting and reconnecting wires. This configuration saves time during cleaning and improves the ability to thoroughly disinfect a surface of the toilet.

While FIGS. 48-51 show the hinge 1223 being supplied power from an external power supply through direct electrical contact, it should be understood that the hinge 1223 may be powered in other ways. For example, the docking station 1230 may include a battery configuration substantially similar to the battery 806 described above with respect to FIGS. 32, 35, and 36. In this configuration, the docking station 1230 may still use electrical wires 1209 to connect to a controller for operating the hinge 1223, but may not require a wired connection to an external power source. Power is then transferred from the battery 806, through the electrical contacts 1244 to the hinge 1223.

While FIGS. 48-51 show the docking station 1230 being connected to a hinge 1223, it should be recognized that the configuration of the docking station 1230 may be used to connect to other devices. For example, the docking station 1230 may support and be connected to a toilet seat lighting apparatus as set forth in U.S. patent application Ser. No. 15/425,783, filed Feb. 6, 2017, the entire disclosure of which is incorporated by reference herein. According to another example, the docking station 1230 may support and be connected to a cleaning system or accessory as set forth in U.S. patent application Ser. No. 15/245,996, filed Aug. 24, 2016. The docking station 1230 may further be used to supply power to a seat heater, powered bidet structure (e.g., for extending and retracting a bidet wand), or other accessory. According to another exemplary embodiment, the docking station 1230 may supply power to an outlet (e.g., USB port) formed in the toilet or as part of a toilet accessory for supplying power to a device.

According to another exemplary embodiment, the hinge 1223 may be electrically connected to the docking station 1230 without a direct physical electrical connection. For example, the docking station 1230 may include a first inductor coil and the hinge 1223 may include a second inductor coil. The first inductor coil is connected to a power source (e.g., external power supply, battery, etc.) and transfers power through induction to the second inductor coil. In this configuration, the locator projections 1238 may hold the hinge 1223 securely on the docking station 1230 without the electrical contacts 1244. The hinge 1223 may then be operated wirelessly, as discussed above, or may be connected to a controller through the electrical contacts 1244.

While the docking station 1230 may be used to inductively provide power to the hinge 1223, it should also be understood that the docking station 1230 may inductively power or charge other accessories or devices (e.g., mobile device). For example, the docking station 1230 may be positioned on the bowl 101 in a position, such that a user may place an induction charge-capable device thereon for charging. For example, the docking station 1230 may be coupled to a lid for the tank 103, such that the user may place the device on top of the docking station 1230 for charging.

In configurations where the docking station 1230 is not enclosed by the hinge 1223, a cover may be disposed on the docking station 1230, which allows for induction currents to pass therethrough and enclose the docking station 1230 to protect the docking station 1230 from water and other damage. According to another exemplary embodiment, the docking station 1230 may be coupled to an underside of the lid or another surface of the toilet that is concealed from view (e.g., inside the pedestal). In this configuration, induction currents pass through the toilet surface (e.g., bowl 101, tank lid) to provide inductive charging to a device through the toilet surface. For example, a user may place the device directly on the tank lid or other surface and charge or power the device through induction currents passed from the concealed docking station 1230, through the toilet surface, to the device.

Figure 102:
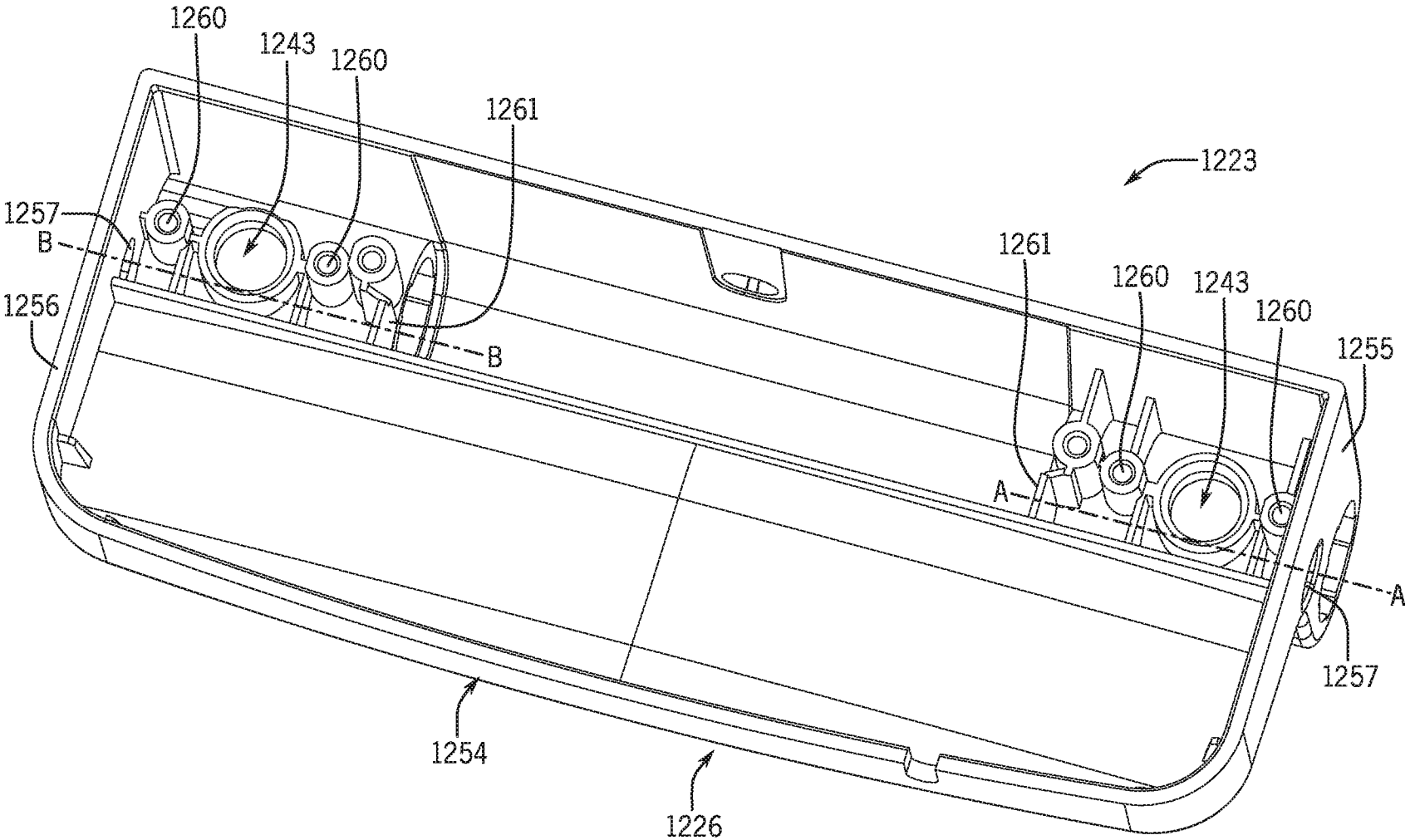
FIG. 102 is a bottom perspective view of a toilet seat hinge.

Referring now to FIG. 102, the hinge 1223 is shown according to another exemplary embodiment. The wall 1254 of the cover 1226 includes opposing first and second lateral sides 1255, 1256, which may be exposed when the toilet seat assembly 1202 is installed. A through hole 1257 extends through each of the sides 1255, 1256, proximate the openings 1242. In this configuration, the through holes 1257 provide access to an interior of the cover 1226 from a position external to the cover 1226, as will be described in further detail below. The through holes 1257 are positioned in the sides 1255, 1256, such that the through holes 1257 are visible when the seat 1221 and/or the lid 1222 are in either or both of the open and closed positions (e.g., as shown in FIG. 48). The through hole 1257 formed in the first side 1255 defines a first axis A-A extending substantially perpendicularly to the first wall 1255. Similarly, the through hole 1257 formed in the second side 1256 defines a second axis B-B extending substantially perpendicularly to the second wall 1256. The first axis A-A and the second axis B-B may be collinear or substantially parallel. While FIG. 102 shows the through holes 1257 extending through the first and second side 1255, 1256, it should be understood that the through holes 1257 may be formed other portions of the wall 1254 of the cover 1226 (e.g., a forward portion or a rear portion), such that the through holes 1257 are accessible to a user when the toilet seat assembly 1202 is installed. A stop 1261 is formed in the interior portion of the cover 1226 along each of the first axis A-A and the second axis B-B, opposing the through holes 1257.

A receiving opening 1243 is formed in the cover 1226 to correspond with each of the openings 1242, discussed with respect to FIG. 50. Referring still to FIG. 102, a plurality of mounting openings 1260 (i.e., bores) are formed in the cover 1226 about each of the receiving openings 1243. For example, FIG. 102 shows two mounting openings 1260 disposed on laterally opposing sides of each receiving opening 1243. The mounting openings 1260 may be threaded or may be formed from a plastic or other deformable material, such that when a screw is received in the mounting openings 1260, the screw forms threads within the mounting openings 1260 and is securely received therein. According to other exemplary embodiments, the mounting openings 1260 may be formed in other ways or locations in the cover 1226.

Figure 103:
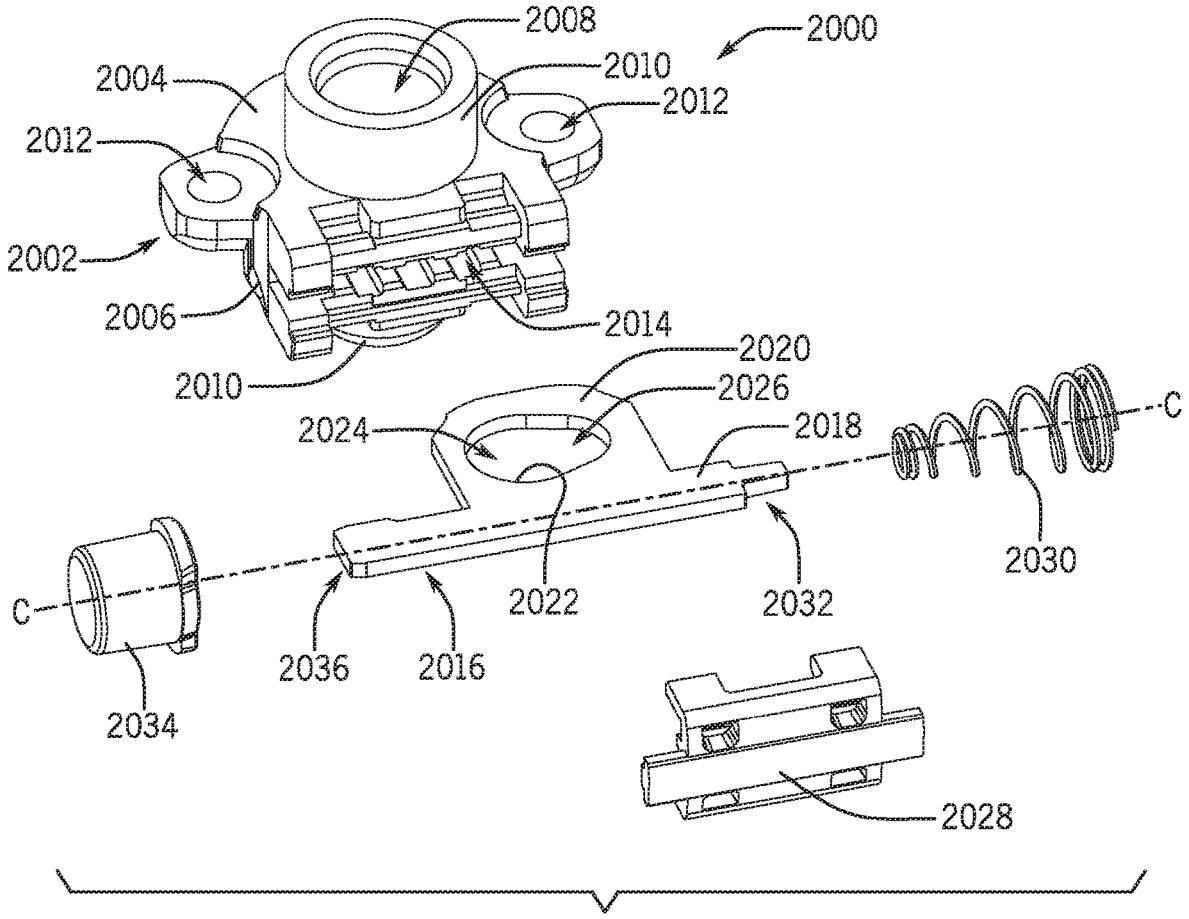
FIG. 103 is an exploded view of a quick release assembly.
Figure 104:
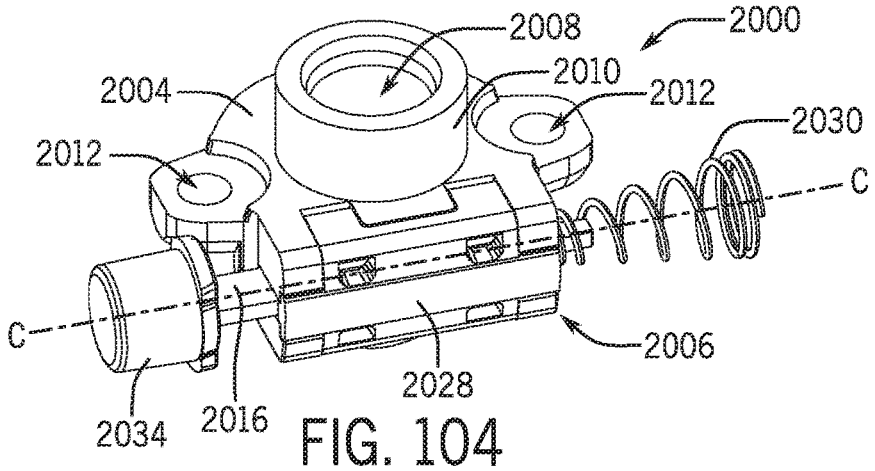
FIG. 104 is a perspective view of the assembled quick release assembly shown in FIG. 103.

Referring now to FIGS. 103 and 104, a quick release assembly 2000 is shown according to an exemplary embodiment. The assembly 2000 includes a body 2002 defining an upper surface 2004, a lower surface 2006, and a bore 2008 extending vertically through the body 2002 from the upper surface 2004 to the lower surface 2006. According to an exemplary embodiment, the bore 2008 is substantially the same as or corresponds to the opening 1242 discussed in FIG. 50 and is configured to receive a locator projection 1238 therein. The upper surface 2004 and the lower surface 2006 each include a projection 2010 extending vertically outward therefrom, further defining the bore 2008. It should be understood that with respect to FIGS. 103 and 104, the term "vertically" corresponds to the axial direction defined by the bore 2008 and the term "laterally" corresponds to the radial direction defined by the bore 2008. According to an exemplary embodiment, when the assembly 2000 is installed on the cover 1226, the projection 2010 on the upper surface 2004 is received in the receiving opening 1243 in order to locate the assembly 2000 in the cover 1226. The upper surface 2004 further defines a plurality of openings 2012 corresponding to the mounting openings 1260 formed in the cover 1226. In this configuration, a fastener (e.g., a screw) is passed through the openings 2012 and received in the mounting openings 1260 in order to couple the body 2002 of the assembly 2000 to the cover 1226.

The body 2002 defines a channel 2014 (i.e., a slot), which extends from an exterior surface of the body 2002 laterally into the bore 2008. The assembly 2000 further includes a sliding member 2016 received in the channel 2014, which is configured to engage a protruding portion of the locator projection 1238 (e.g., the gasket 1241, the end 1239, or other portion) with an interference fit. Specifically, as shown in FIG. 103, the sliding member 2016 defines an elongate pin 2018 and an arm 2020 extending laterally outward from the pin 2018. The entire arm 2020 and a portion of the pin 2018 are disposed in the channel 2014 when the sliding member 2016 is received in the channel 2014. The arm 2020 defines a locking opening 2022, which includes an irregular shape having a first portion 2024 defining a first diameter and a second portion 2026 laterally offset from the first portion 2024 and defining a second diameter less than the first diameter. A sliding axis C-C is defined along the pin 2018 and the sliding member 2016 is configured to move laterally along the sliding axis C-C when the sliding member 2016 is installed in the body 2002.

Referring still to FIGS. 103 and 104, the assembly 2000 includes a cover 2028 disposed on a side of the body 2002 and configured to enclose the channel 2014. When the cover 2028 is installed on the body 2002, the cover 2028 prevents the sliding member 2016 from being withdrawn from the channel 2014, while allowing the sliding member 2016 to continue to slide along the sliding axis C-C.

A spring 2030 (i.e., a biasing member) is disposed on a first end 2032 of the pin 2018 and a cap 2034 is disposed on an opposing second end 2036 of the pin 2018. The spring 2030 extends along the sliding axis C-C. When the assembly 2000 is installed in a cover 1226, the sliding axis C-C is aligned (e.g., collinear) with the corresponding first axis A-A or second axis B-B. In this configuration, the spring 2030 engages and is compressed between the stop 1261 and the first end 2032 of the pin 2018, such that the sliding member 2016 is biased away from the stop 1261 and toward the corresponding through hole 1257. When the spring 2030 is in an uncompressed (i.e., extended) configuration, the sliding member 2016 is in a first (i.e., locked) position, in which the cap 2034 extends through the corresponding through hole 1257, such that it is accessible to a user external to the cover 1226. A user may then press the cap 2034, pushing the cap 2034 further into the through hole 1257, thereby moving the sliding member 2016 along the sliding axis C-C and compressing the spring 2030 until the sliding member 2016 is in a second (i.e., unlocked) position.

When the sliding member 2016 is in the second position, the first portion 2024 of the locking opening 2022 is substantially axially aligned with the bore 2008. The first portion 2024 defines a diameter greater than or the same as a widest portion of the locator projection 1238 received in the bore 2008, such that the locator projection 1238 may move axially in the bore 2008 without any interference from the sliding member 2016. In contrast, when the sliding member 2016 is in the first position, the second portion 2026 of the locking opening 2022 is substantially axially aligned with the bore 2008. The second portion 2026 defines a diameter less than the widest portion of the locator projection 1238. Interaction between the second portion 2026 and the widest or other portion of the locator projection 1238 having a diameter greater than that of the second portion 2026 provides an interference fit, locking the locator projection 1238 in the bore 2008 and preventing it from being withdrawn therefrom. As described, the sliding member 2016 defaults to the first position.

Figure 105:
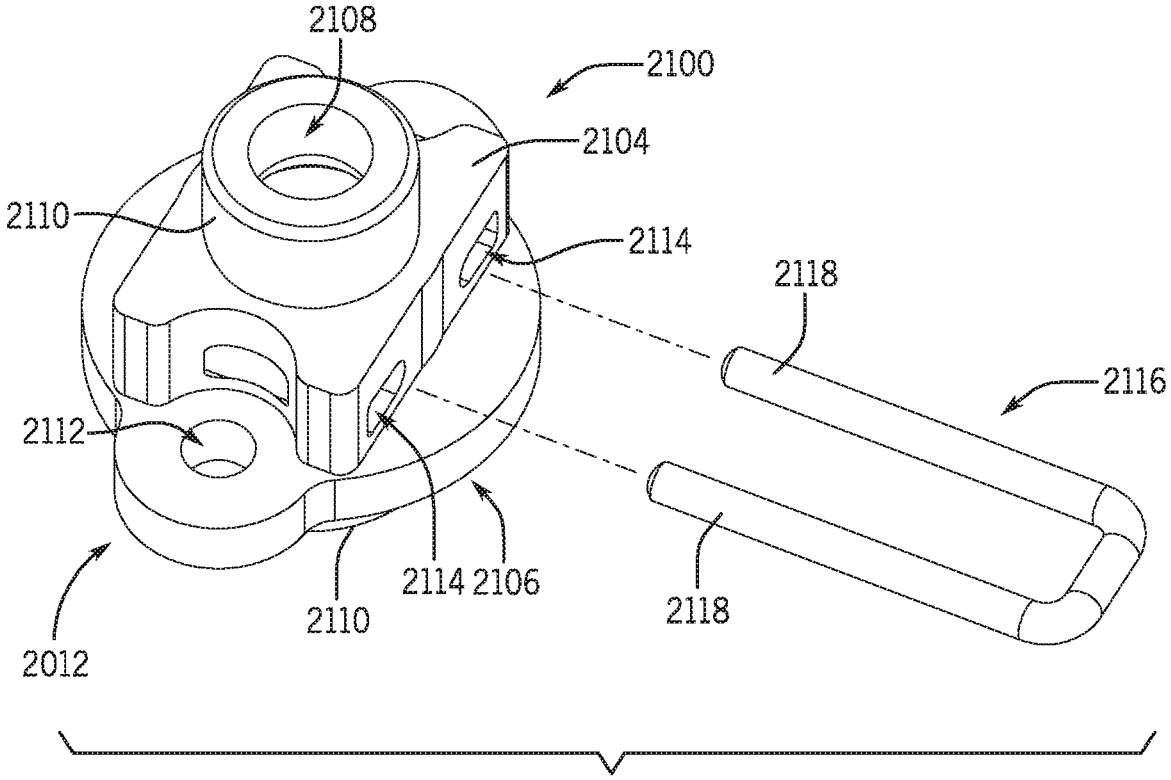
FIG. 105 is an exploded view of another quick release assembly.
Figure 106:
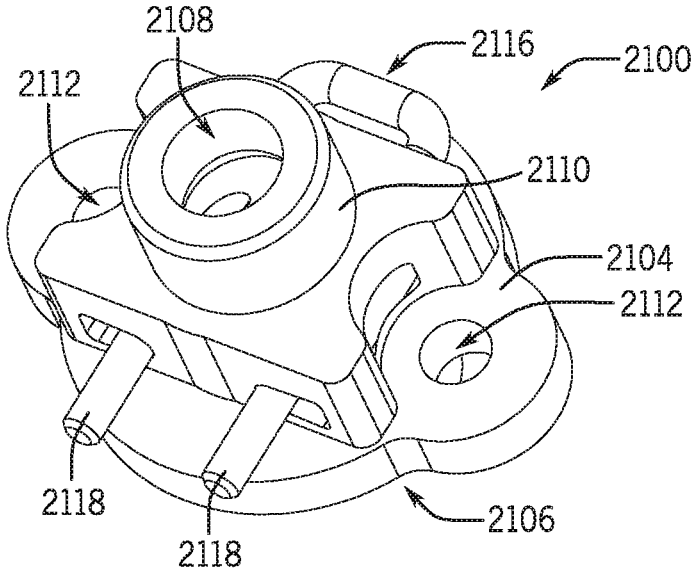
FIG. 106 is a perspective view of the assembled quick release assembly shown in FIG. 105.

Referring now to FIGS. 105 and 106, a quick release assembly 2100 is shown according to another exemplary embodiment. The assembly 2100 includes a body 2102 defining an upper surface 2104, a lower surface 2106, and a bore 2108 extending vertically through the body 2102 from the upper surface 2104 to the lower surface 2106. According to an exemplary embodiment, the bore 2108 is substantially the same as or corresponds to the opening 1242 discussed in FIG. 50 and is configured to receive a locator projection 1238 therein. The upper surface 2104 and the lower surface 2106 each include a projection 2110 extending vertically outward therefrom, further defining the bore 2108. It should be understood that with respect to FIGS. 105 and 106, the term "vertically" corresponds to the axial direction defined by the bore 2108 and the term "laterally" corresponds to the radial direction defined by the bore 2008. According to an exemplary embodiment, when the assembly 2100 is installed on the cover 1226, the projection 2110 on the upper surface 2104 is received in the receiving opening 1243 in order to locate the assembly 2100 in the cover 1226. The upper surface 2104 further defines a plurality of openings 2112 corresponding to the mounting openings 1260 formed in the cover 1226. In this configuration, a fastener (e.g., a screw) is passed through the openings 2112 and received in the mounting openings 1260 in order to couple the body 2102 of the assembly 2100 to the cover 1226.

The body 2102 defines at least one channel 2114 (i.e., a slot), which extends laterally through the bore 2108. Specifically, as shown in FIG. 105, the body 2102 defines two channels 2114, although more or fewer channels 2114 may be used. The assembly 2100 further includes an interference pin 2116 received in the at least one channel 2114, which is configured to engage a protruding portion of the locator projection 1238 (e.g., the gasket 1241, the end 1239, or other portion) with an interference fit. The interference pin 2116 includes two legs 2118 joined at a first end of each leg 2118. Each channel 2114 is configured to receive one of the legs 2118 therein. The legs 2118 then extend through the bore 2108 and are biased toward the axis of the bore 2108. The legs 2118 are flexible and configured to deflect radially outward relative to the bore 2108 as locator projection 1238 is received therein and engages the legs 2118. Interaction between the legs 2118 and a portion of the locator projection 1238 that suddenly increases in diameter provides an interference fit, locking the locator projection 1238 in the bore 2108. This configuration prevents the locator projection 1238 from being withdrawn from the bore 2108 until substantial force is applied to the docking station 1230 in the vertical direction relative to the bore 2108, thereby forcing the legs 2118 radially outward and overcoming the interference fit.

Figure 107:
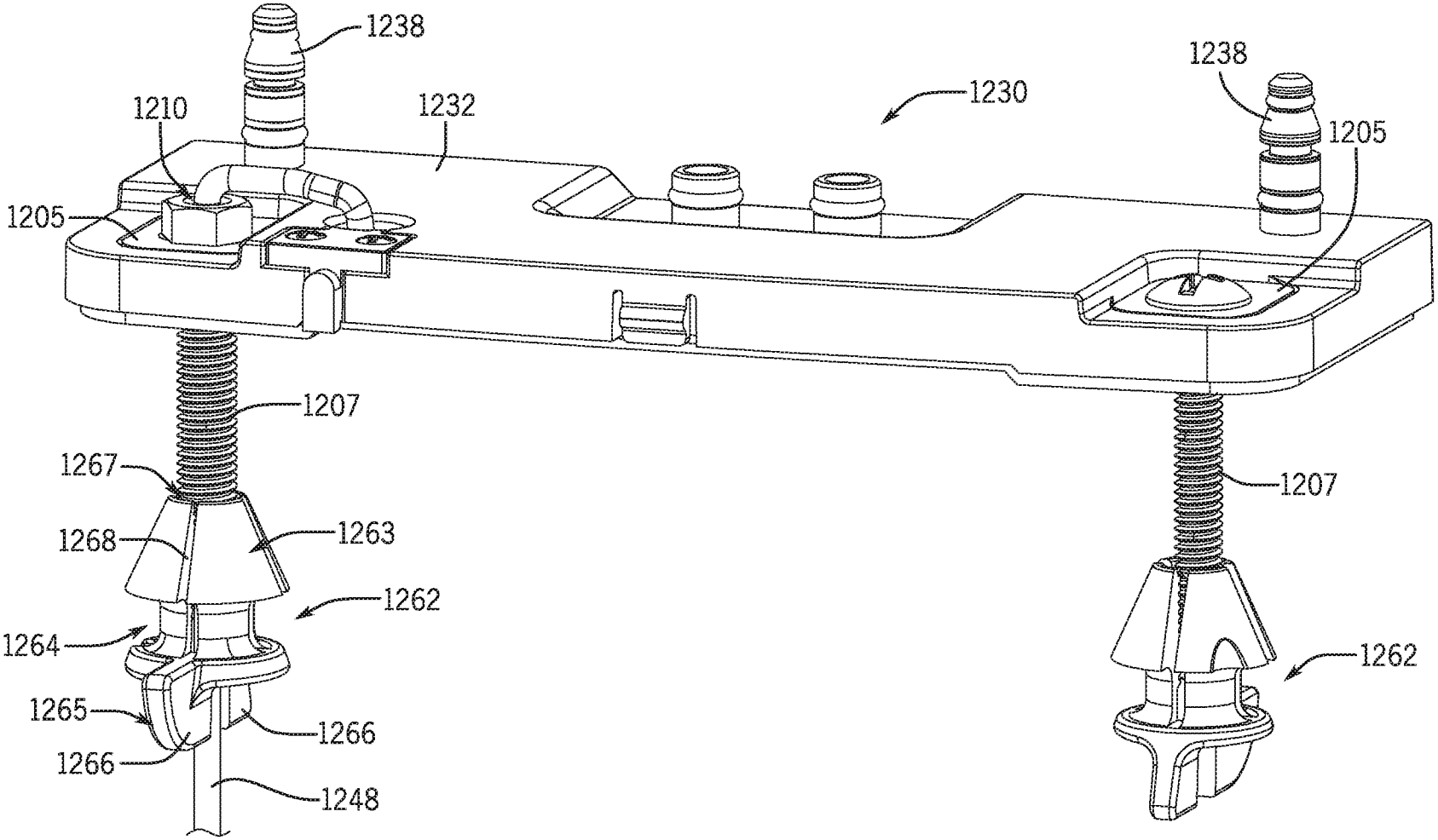
FIG. 107 is a perspective view of a docking station.

Referring now to FIG. 107, the docking station 1230 is shown according to another exemplary embodiment. The fastener 1207 receives the first electrical wire 1248 therethrough, as described with respect to FIG. 48. A nut 1262 is received on and threadably engages the fastener 1207 in order to secure the docking station 1230 to a toilet. The nut 1262 defines an upper portion 1263 having a conical shape, a lower portion 1265 defining opposing wings 1266 (e.g., as in a conventional wing nut), and a substantially cylindrical intermediate portion 1264 disposed between the upper portion 1263 and the lower portion 1265. A threaded bore 1267 extends axially through the entire nut 1262, from the upper portion 1263 through the lower portion 1265 and is configured to receive and threadably engage the fastener 1207. The conical upper portion 1263 increases in diameter moving toward the lower portion 1265. In this configuration, when the docking station 1230 is coupled to a toilet, the upper portion 1263 of the nut 1262 is received in a corresponding hole defined by a toilet and axially centers the nut 1262 within the hole, thereby preventing lateral motion of the docking station 1230 with respect to the toilet.

A channel 1268 is formed vertically along the nut 1262, extending along the entire nut 1262, from the upper portion 1263 through the lower portion 1265. Before the nut 1262 is received on the fastener 1207, the first electrical wire 1248 is passed radially through the channel 1268 and received in the threaded bore 1267. The nut 1262 may then be moved along the first electrical wire 1248 toward the fastener 1207 for coupling thereto. In this configuration, the first electrical wire 1248 may be installed in the docking station 1230 and the toilet without having to first feed the first electrical wire 1248 through the nut 1262, thereby increasing flexibility of docking station 1230 installation on the toilet.

Figure 53:
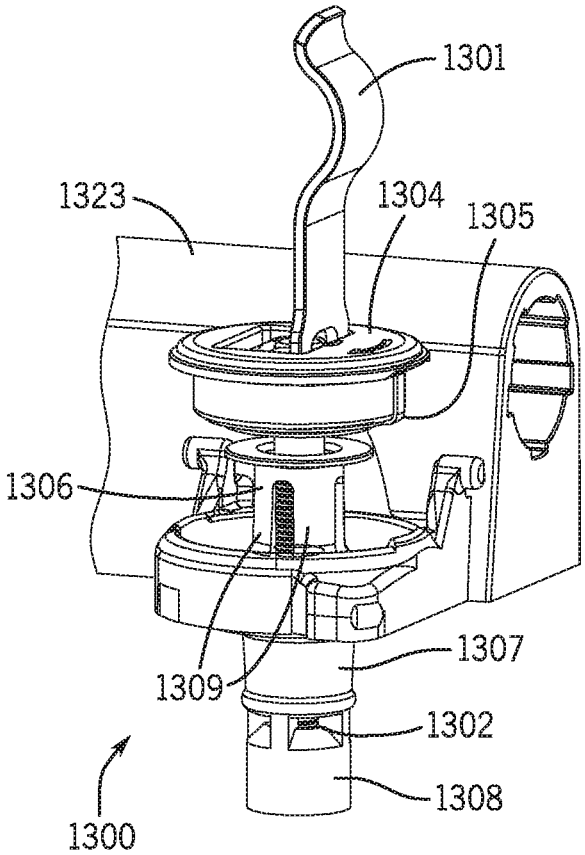
FIG. 53 is an exploded perspective view of the toilet seat hinge shown in FIG. 52.
Figure 54:
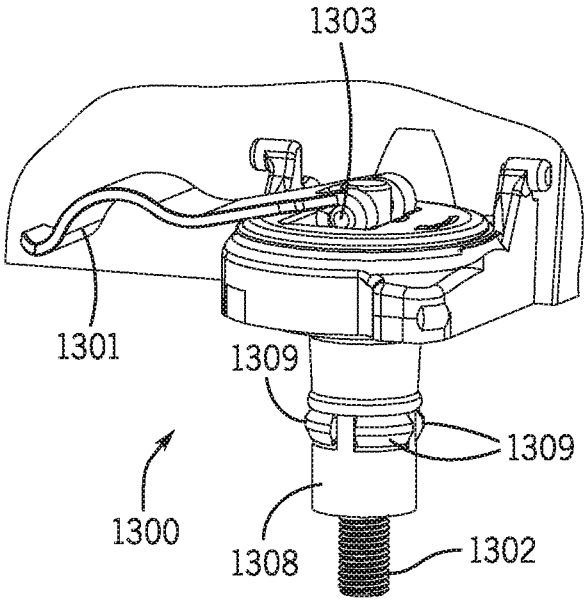
FIG. 54 is a perspective view of the toilet seat hinge shown in FIG. 52.
Figure 55:
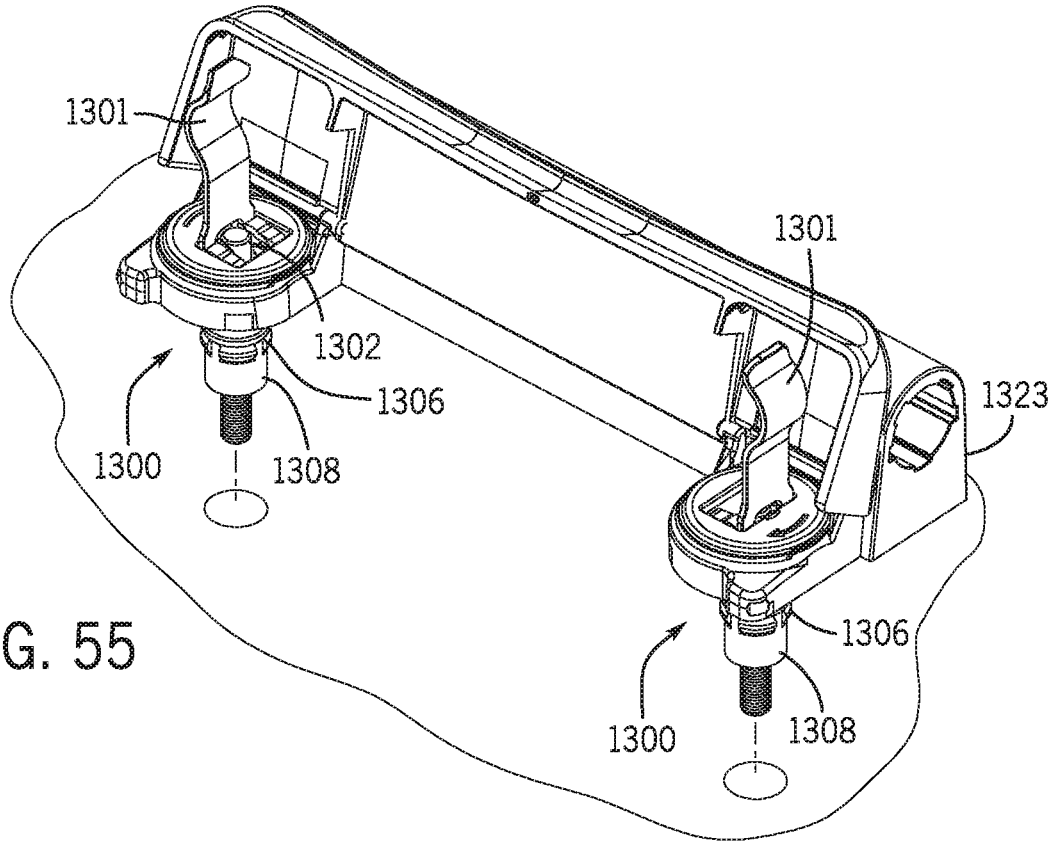
FIGS. 55-58 are perspective views of the toilet seat hinge shown in FIG. 52 with a hinge base in various stages of assembly.
Figure 56:
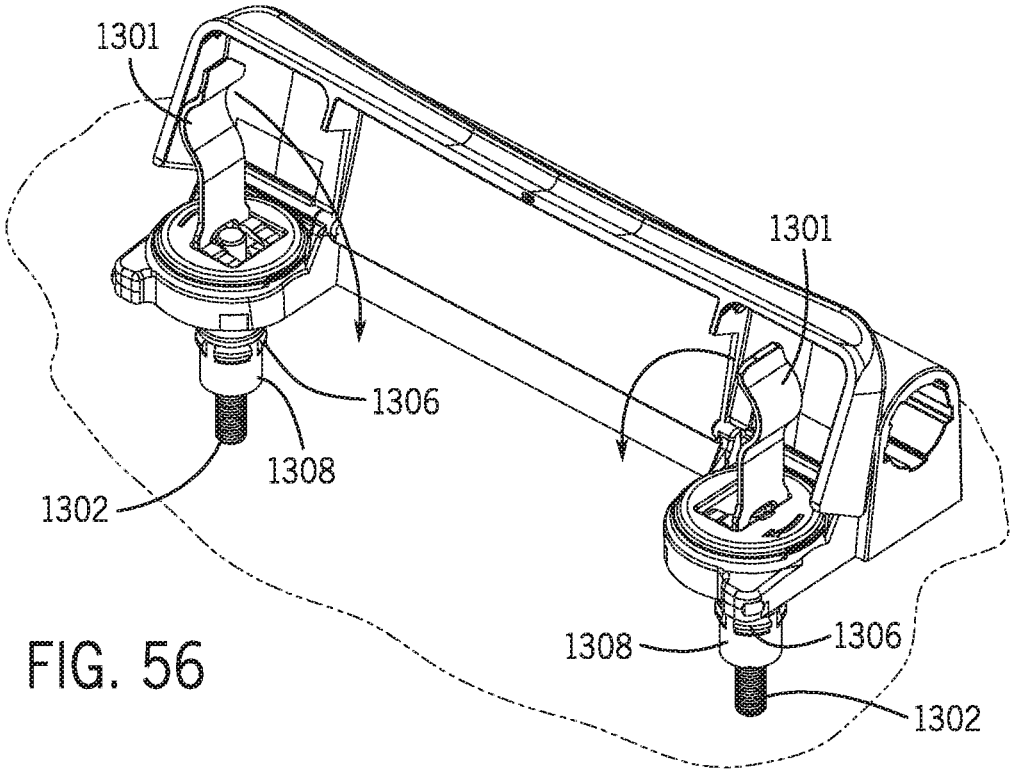
Figure 57:
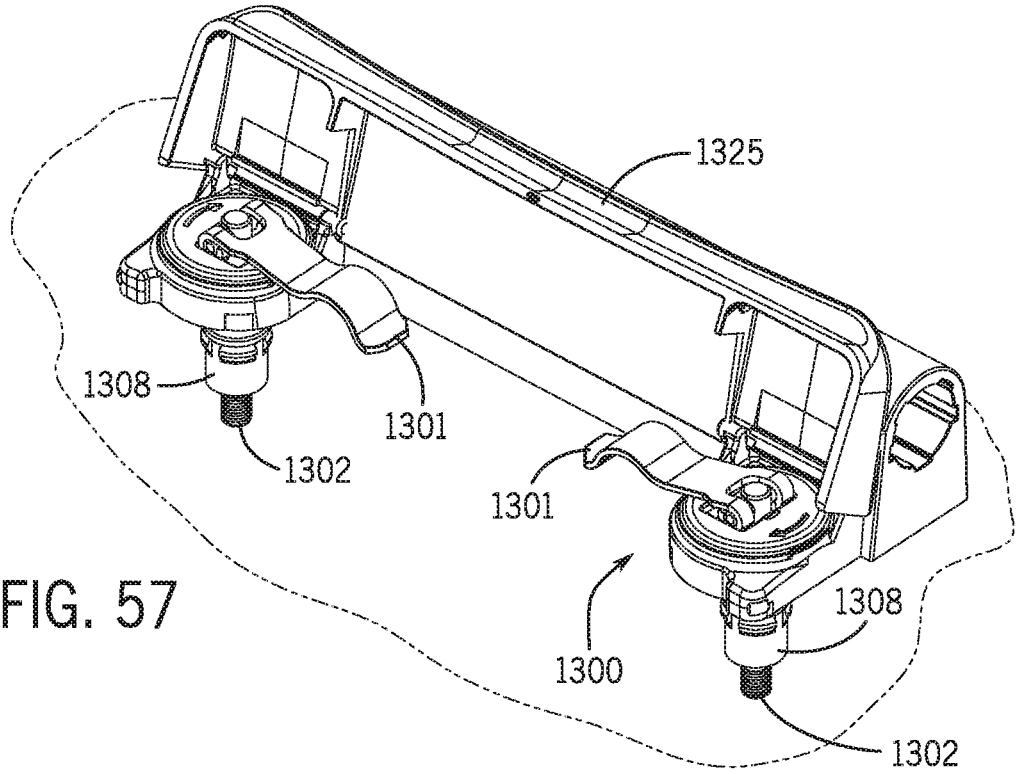
Figure 60:
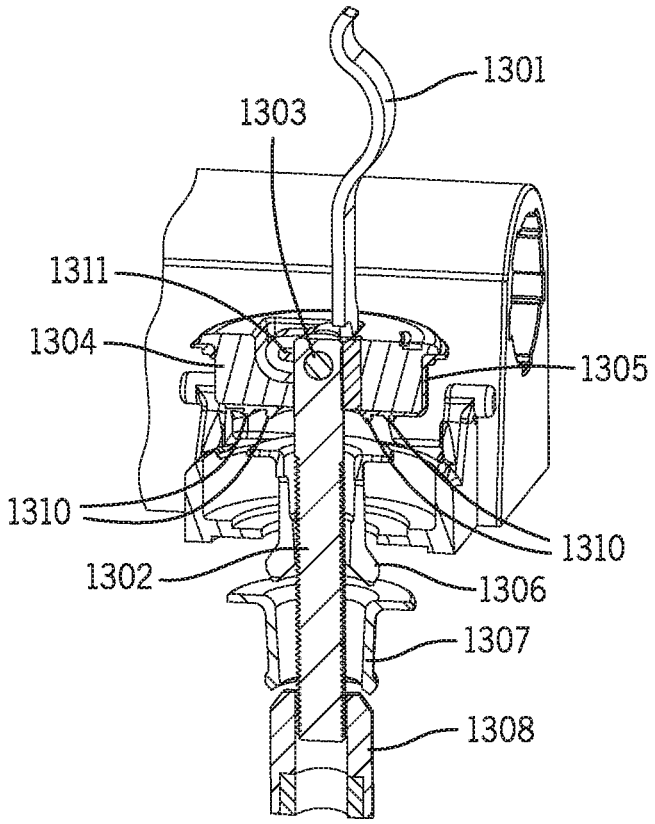
FIG. 60 is a cross-sectional exploded perspective view of the toilet seat hinge shown in FIG. 52.
Figure 61:
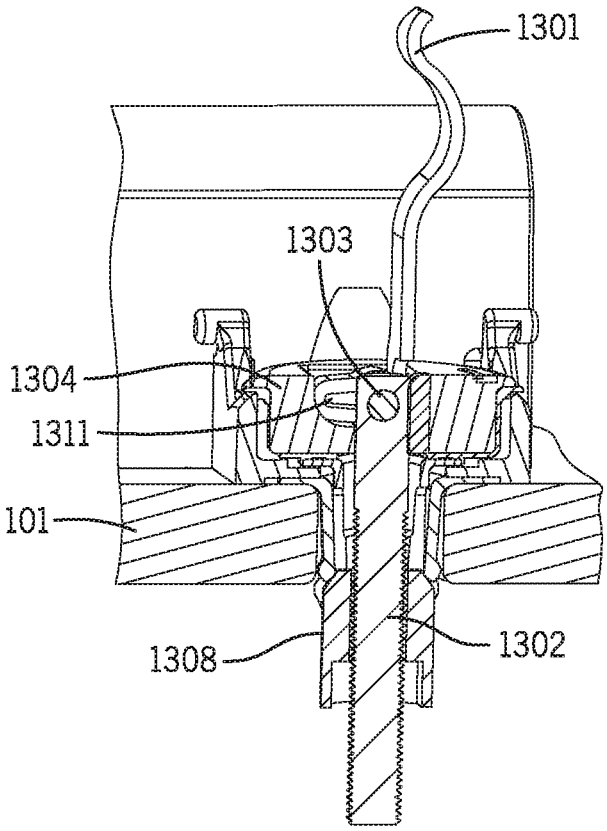
FIG. 61 is a cross-sectional perspective view of the toilet seat hinge shown in FIG. 52.
Figure 62:
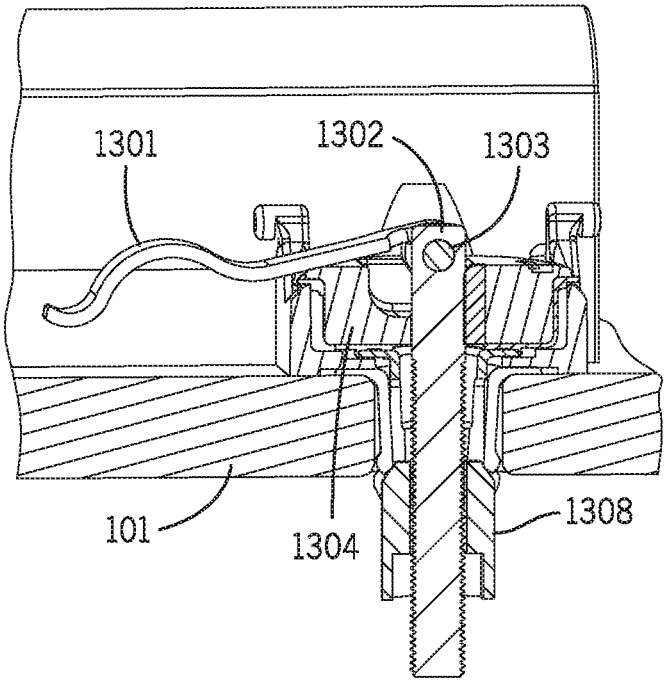
FIG. 62 is a cross-sectional perspective view of the toilet seat hinge shown in FIG. 52.

FIGS. 52-63 illustrate an exemplary embodiment of a hinge assembly 1300 that is configured to mount a hinge base 1323 to a pedestal of a toilet. As shown best in FIG. 52, the hinge assembly 1300 includes a cam lever 1301, a cam screw 1302, a cam lever pin 1303 extending through the cam screw 1302 and the cam lever 1301, a cam mount 1304 with an overmold rubber gasket 1305, a semi-rigid sleeve 1306 that is inserted from the top into the hinge base 1323, a gasket or viscoelastic sleeve 1307 (e.g., rubber-like sleeve) that is inserted over the semi-rigid sleeve 1306 to retain the assembly 1300 to the hinge base 1323, and an anchor/nut 1308 (e.g., anchor nut) that threads to the cam screw 1302 to secure the assembly 1300 in place. As shown in FIGS. 53 and 54, the cam lever 1301 is rotatable about the cam lever pin between a non-locking position (FIGS. 53 and 61) and a locking position (FIGS. 54 and 62). As shown in FIG. 55, the cam levers 1301 are in the non-locking (e.g., upright) position, and the installation begins with insertion of the expandable anchors (e.g., the semi-rigid sleeve 1306 and the viscoelastic sleeve 1307) through the seat post holes in the toilet (e.g., vitreous). Then, the cam levers 1301 (and connected components) are rotated downward to lift the bottom anchor nut 1308 to expand the sleeves 1306, 1307 to the toilet's associated seat post hole diameter, as shown in FIGS. 56 and 57. As the anchor nut 1308 lifts, flexible features 1309 (e.g., fingers) of the semi-rigid plastic sleeve 1306 (FIG. 54) are moved into contact with the vitreous (not shown), in which the flexible features 1309 create a vertical constraint and clamp pressure in the fastener system due to frictional forces on the vitreous (e.g., the seat post holes).

Figure 58:
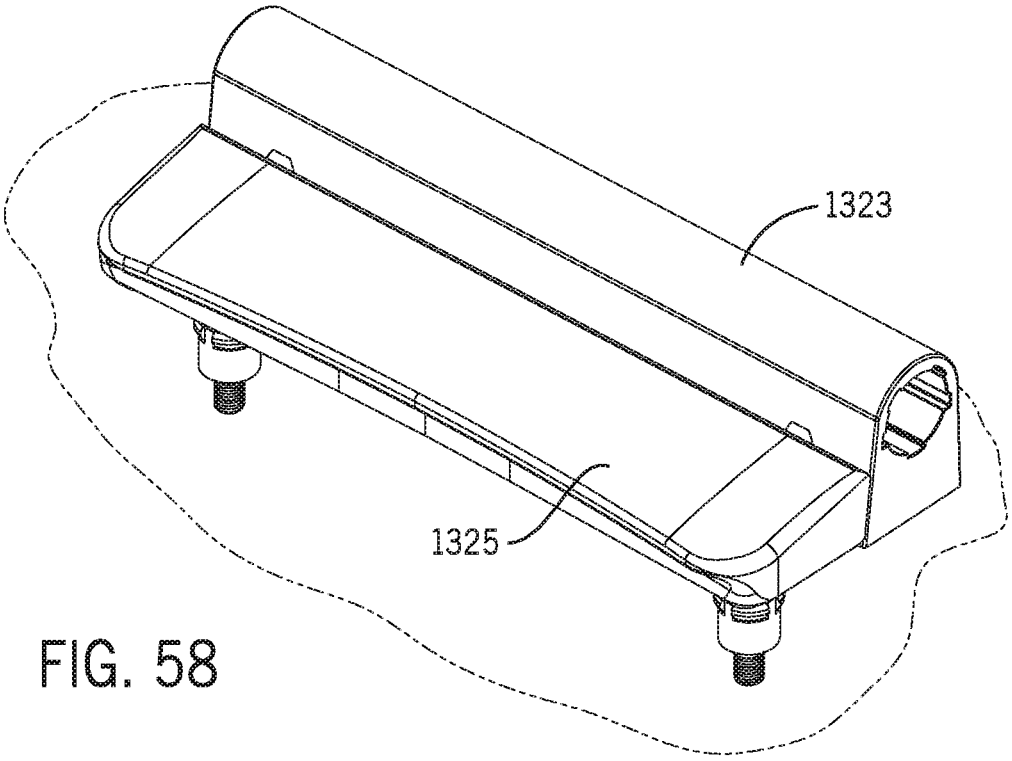
Figure 59:
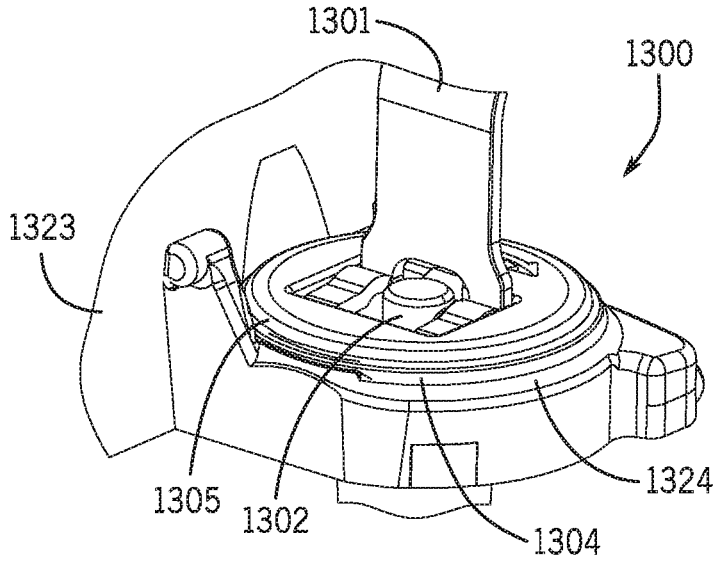
FIG. 59 is a perspective view of the toilet seat hinge shown in FIG. 52.

Prior to locking the cams inwardly, torque resistance increases due to compression of the flexible rubber-like crush ribs 1310 (see FIG. 60) and the recess geometry provides feedback to the user to limit the system from being over tightened. The flexible rubber-like crush ribs 1310 shown in FIG. 60 create torsional resistance due to friction to indicate the system is approaching proper hand tightness. As shown in FIG. 59, the recess/interlocking geometries (e.g., between the mount 1304 and/or the gasket 1305 and the cup 1324 in the hinge base 1323 that receives them) limit the vertical compression to ensure proper vertical pin 1303 movement when the cam levers 1301 are closed. FIG. 57 shows the cam levers 1301 closed (e.g., in the locking position). In the locking position, the cam lever 1301 is configured to go past the horizontal plane, as shown in FIG. 54, to require a counter rotation force to cam past and release from the locked position. A locking cam 1311 of the cam lever 1301 is shown in FIG. 60 as extending beyond the axis of rotation of the pin 1303, such that when the cam lever 1301 is rotated into the locking position, the locking cam 1311 engages and compresses the mount 1304 to create a locking force. The illustrated cam lever 1301 includes two locking cams 1311, one on each side of the cam screw 1302. The cam lever pin 1303 location relative to the cam mount 1304 creates the vertical translation through contact between each locking cam 1311 and the cam mount 1304, which creates the forces for securing the assembly 1300 in place. FIGS. 61 and 62 show the relative vertical translation of the cam screw 1302 from the contact between the locking cams 1311 of the cam lever 1301 and the cam mount 1304. As shown in FIG. 58, after the cam levers 1301 are closed, an aesthetic hinge cover 1325 is rotated closed for a clean appearance that keeps dirt and debris outside of the hinge assembly. It is noted that the hinge cover 1325 can be configured according to the one-piece (e.g., unitary) hinge base disclosed below in, for example, FIGS. 97-100.

Figure 63:
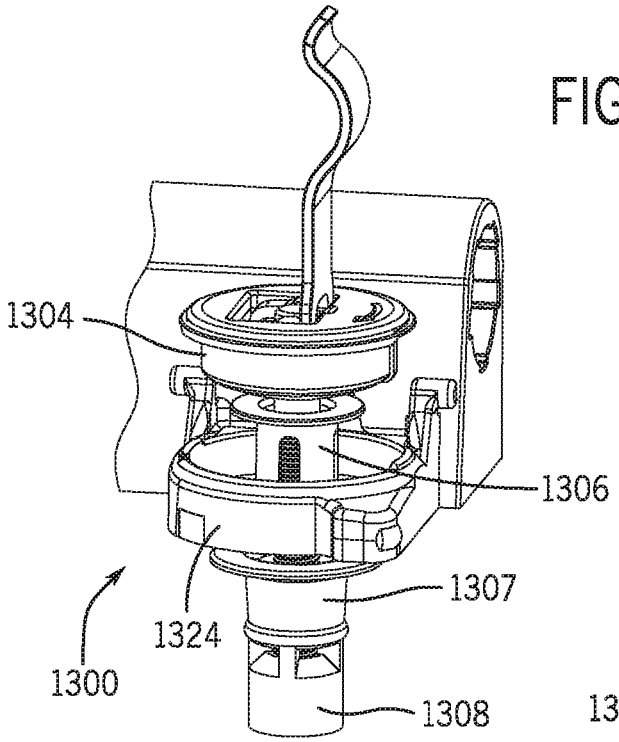
FIG. 63 is a perspective view of the toilet seat hinge shown in FIG. 52.
Figure 64:
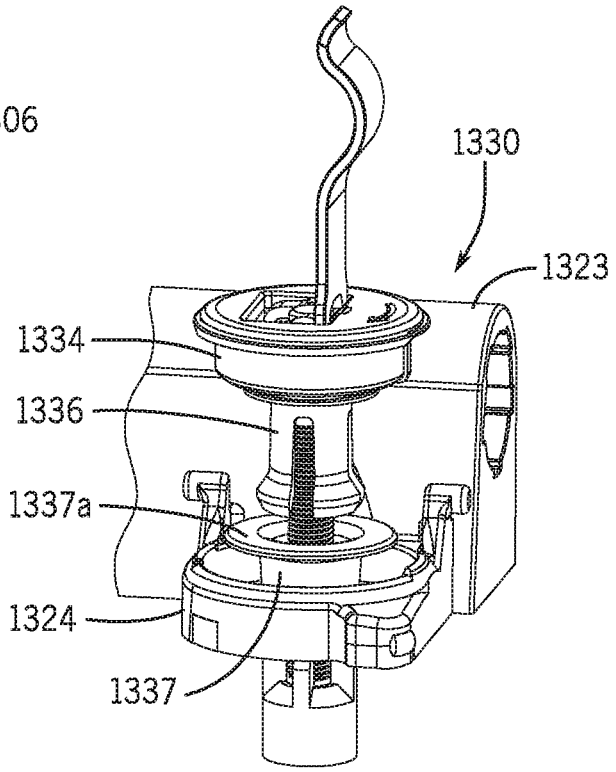
FIG. 64 is a perspective view of an embodiment of a toilet seat hinge.
Figure 65:
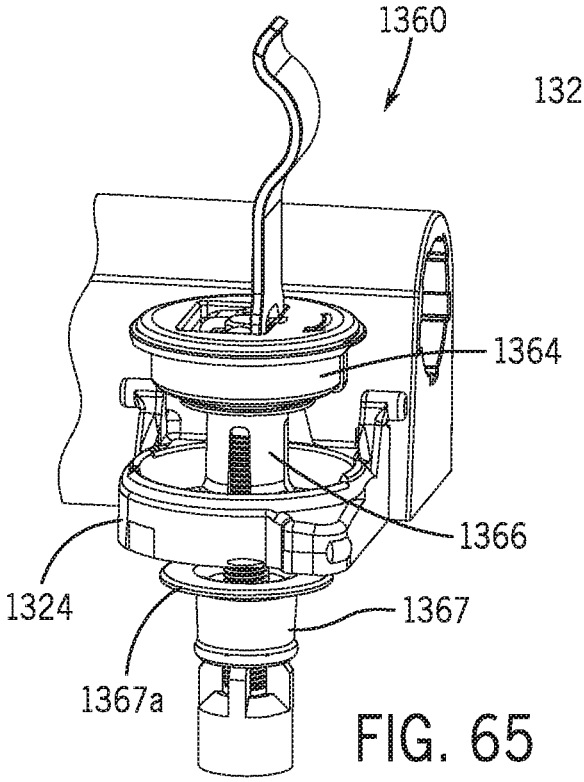
FIG. 65 is a perspective view of an embodiment of a toilet seat hinge.
Figure 66:
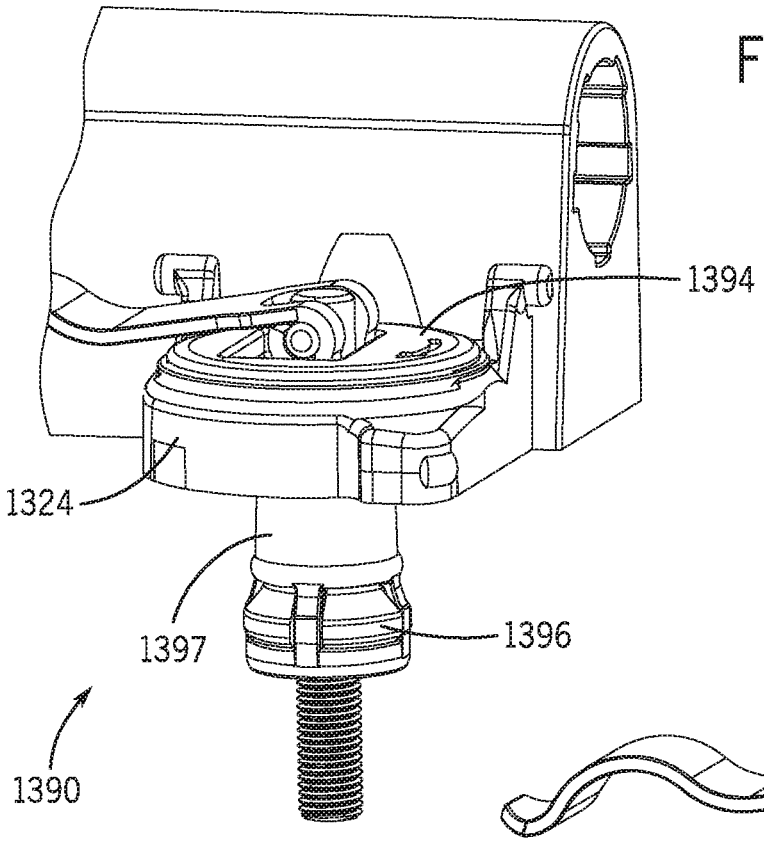
FIG. 66 is a perspective view of an embodiment of a toilet seat hinge with a hinge base.
Figure 67:
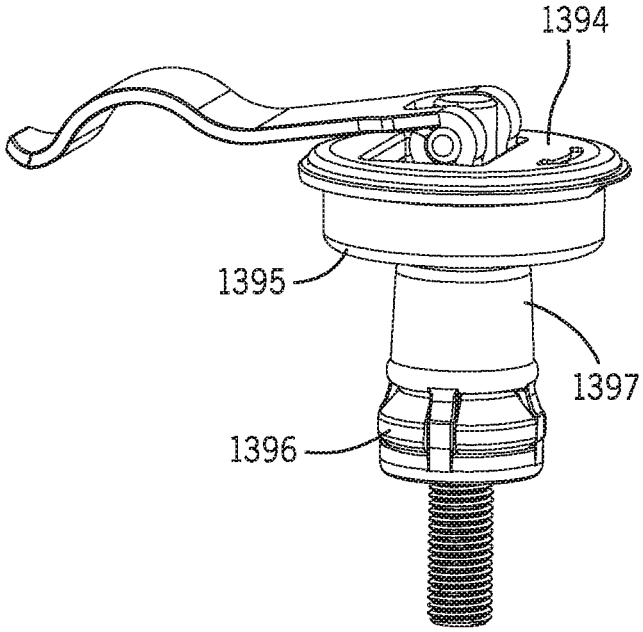
FIG. 67 is a perspective view of the toilet seat hinge shown in FIG. 66.
Figure 68:
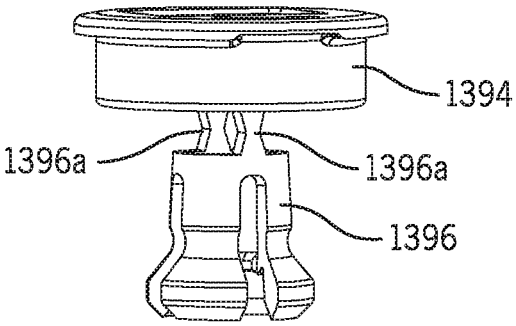
FIG. 68 is a perspective view of a sleeve of the toilet seat hinge shown in FIG. 66.
Figure 69:
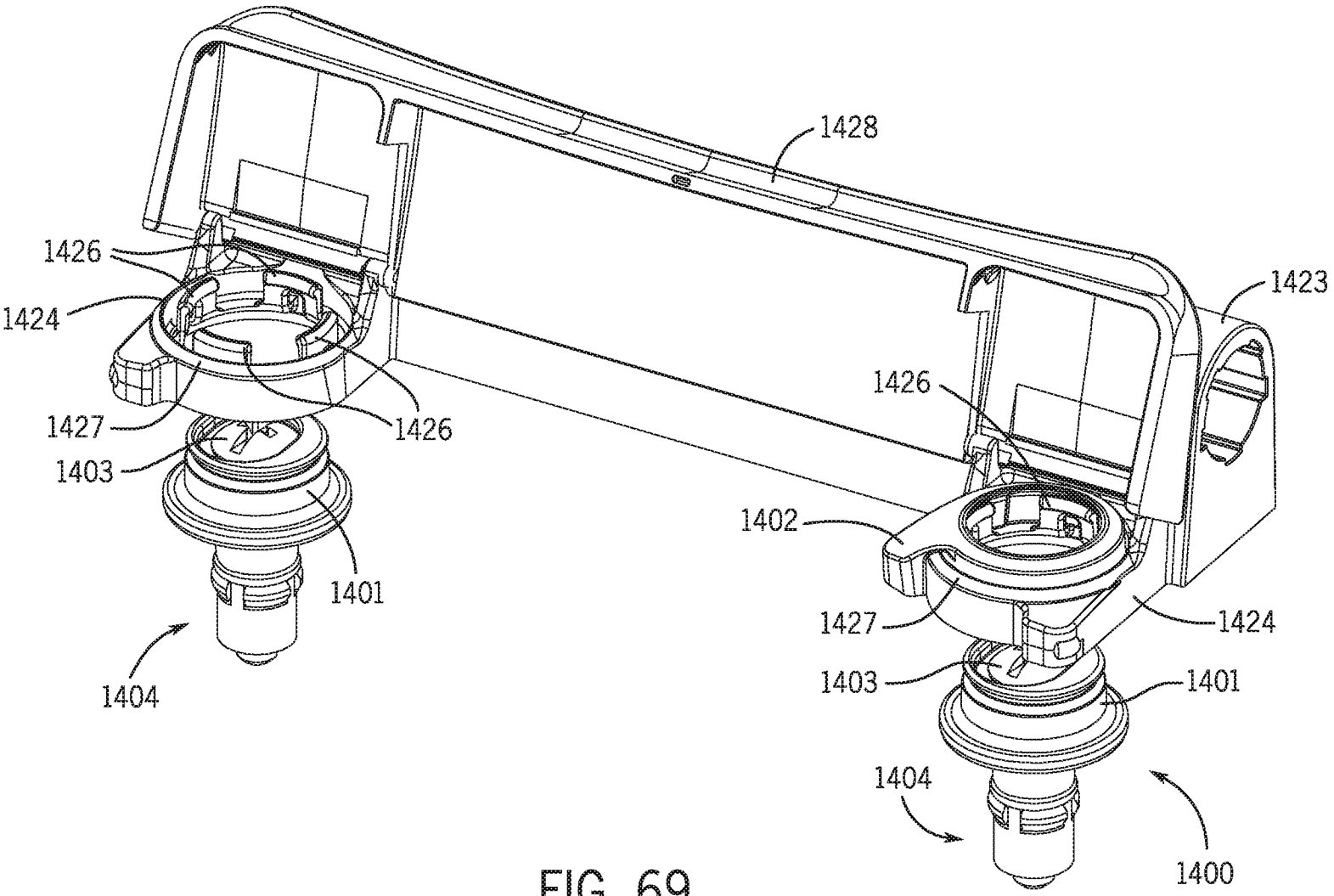
FIG. 69 is a perspective view of an embodiment of a toilet seat hinge with a hinge base.

As shown in FIG. 63, a top of the viscoelastic sleeve 1307 is coupled to the bottom (e.g., underside) of the hinge mount or cup 1324 of the hinge base 1323, which advantageously enables the cam assembly to stay attached to the hinge assembly and ship together prior to installation. FIGS. 64-68 illustrate alternative variants to the assembly 1300 shown in FIG. 63. The assembly 1330 shown in FIG. 64 has a top 1337*a* of the viscoelastic sleeve 1337 coupled to the top (e.g., topside) of the hinge mount 1324 of the hinge base 1323, and the semi-rigid sleeve 1336 is integral with (e.g., co-molded, overmolded onto, etc.) the cam mount 1334. The remaining components/parts of the assembly 1330 are the same as those in the assembly 1300. The assembly 1330 advantageously reduces the number of parts, which reduces the piece cost and assembly cost/time. This arrangement also enables the cam assembly to be a loose assembly that does not have to be assembled prior to shipment of the seat assembly. The assembly 1360 shown in FIG. 65 has the top 1367*a* of the viscoelastic sleeve 1367 below the hinge mount 1324 so that the top 1367*a* couples to the underside of the bottom of the hinge mount 1324, and the semi-rigid sleeve 1366 is integrally formed with (e.g., co-molded onto, is the same part as, etc.) the cam mount 1364. This arrangement enables the cam assembly to stay attached to the hinge assembly and ship together prior to install, while lowering the cost. The assembly 1390 shown in FIGS. 66-68 has a unitary (e.g., integral) semi-rigid sleeve 1396 and cam mount 1394, which can be formed (e.g., molded) as one part. The viscoelastic sleeve 1397 and the mount gasket 1395 are integrally formed (e.g., molded together) with the mount gasket material (e.g., to form one entire "boot") or can be made via a two-shot molding and bonded onto the cam mount. As shown in FIG. 68, the co-molded semi-rigid sleeve 1396 can be molded with sacrificial "runner-like" geometries, such as the webs 1396*a* shown, for molding, which could be designed to break after the rubber overmold (e.g., viscoelastic sleeve 1397, mount gasket 1395) is applied to allow for lateral (e.g., side-to-side, fore-and-aft) adjustability in the final assembly. This arrangement enables the cam assembly to have a reduced number of parts and the assembly can ship together prior to installation or separately depending on when the cam screw is inserted (sleeve will collapse if screw is missing).

Figure 70:
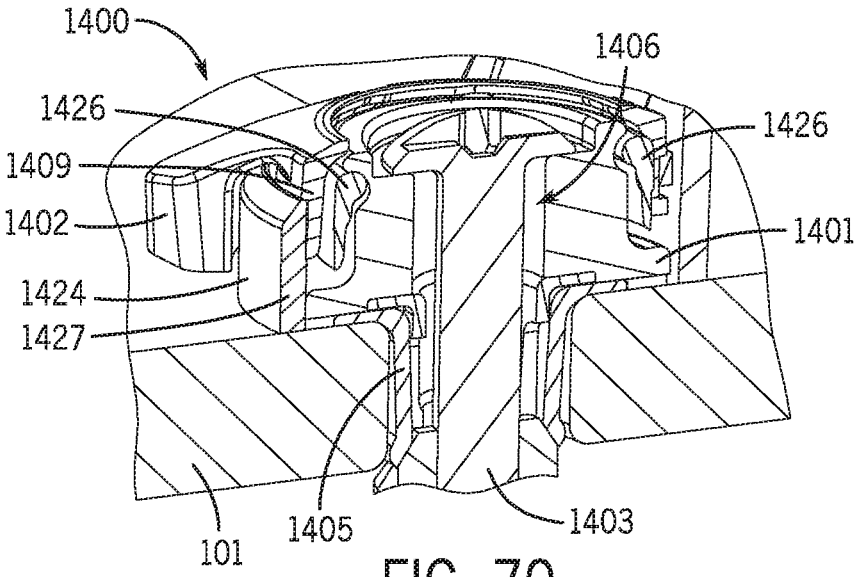
FIG. 70 is a cross-sectional perspective view of the toilet seat hinge shown in FIG. 69.
Figure 71:
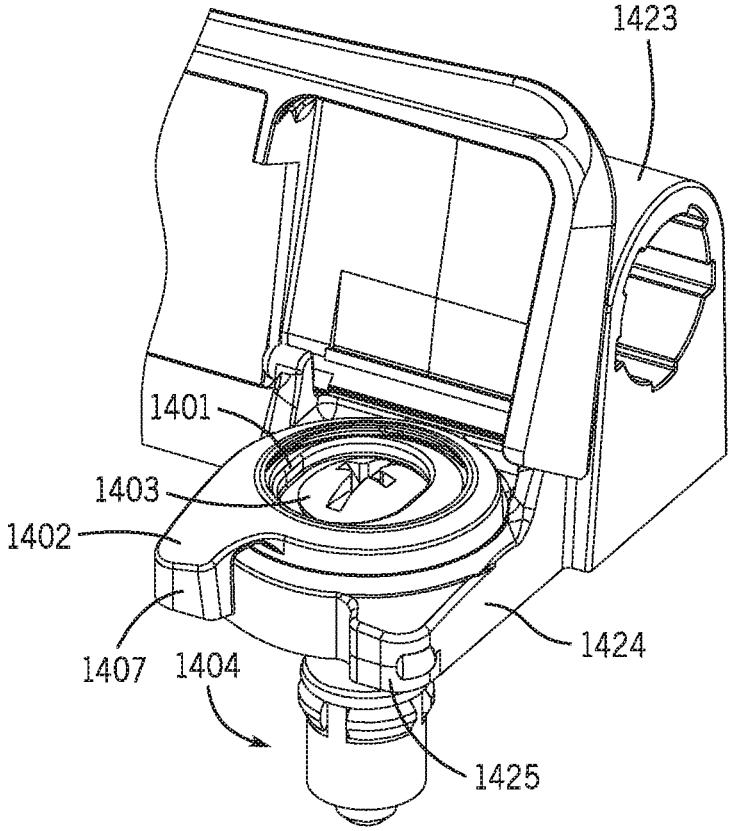
FIG. 71 is a perspective view of the toilet seat hinge and hinge base shown in FIG. 69.
Figure 72:
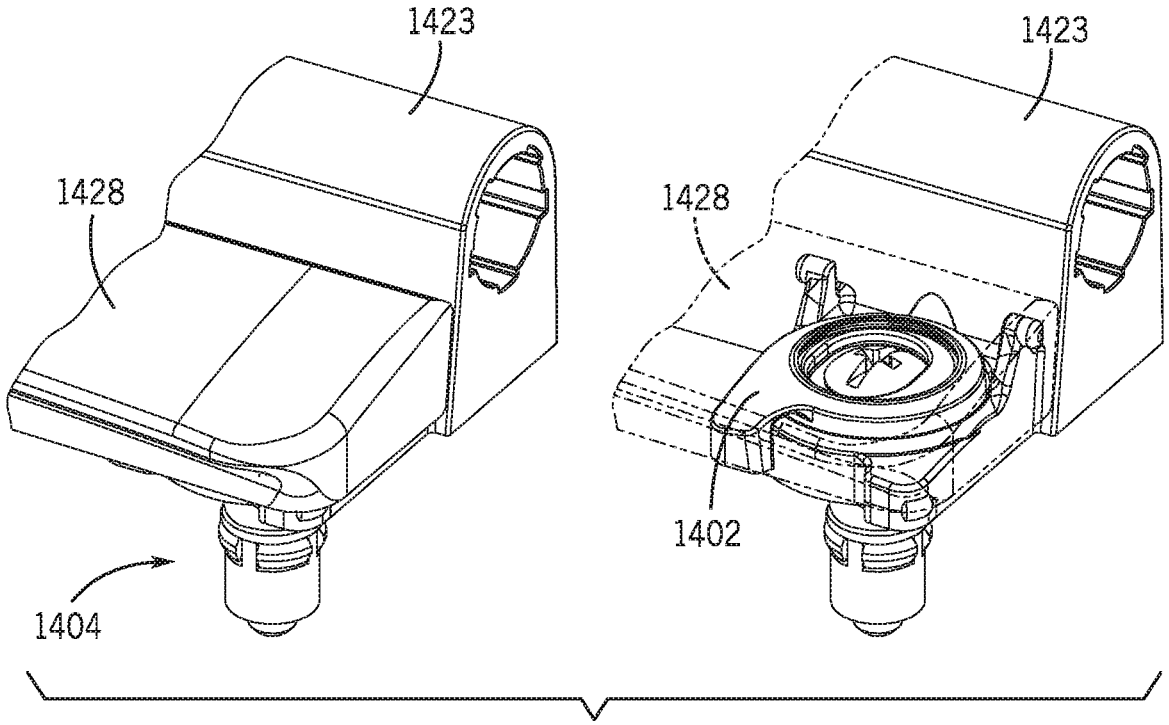
FIG. 72 is a perspective view of the toilet seat hinge and hinge base shown in FIG. 69.
Figure 73:
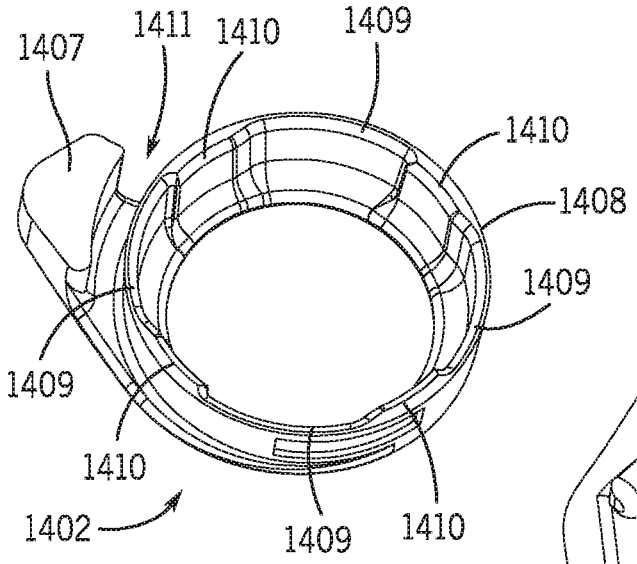
FIG. 73 is a perspective view of a lock cap of the toilet seat hinge shown in FIG. 69.
Figure 74:
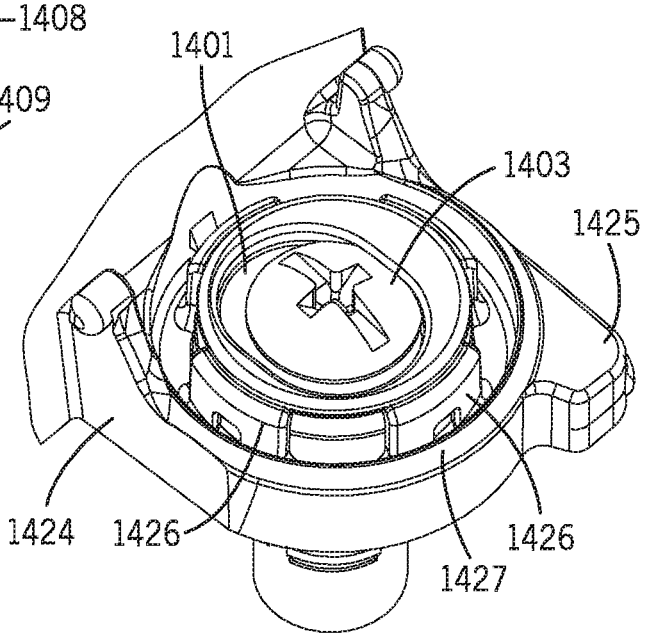
FIG. 74 is a perspective view of the toilet seat hinge and hinge base shown in FIG. 69.

FIGS. 69-74 illustrate an exemplary embodiment of a hinge assembly 1400 that is configured to mount a hinge base 1423 to a pedestal of a toilet. As shown, the hinge assembly 1400 includes a hinge mount 1401, a lock cap 1402, a fastener 1403, and an anchor 1404. As shown in FIG. 70, a flexible gasket 1405 (e.g., including a rubber or rubber-like material) can be applied under the hinge mount 1401, such as on the topside and inside of the post holes/walls of the toilet base/bowl 101 (e.g., the vitreous) to resist movement and allow for a secure and lesser clamp load installations. To install the seat, the hinge mount 1401 is located in a mount or cup 1424 of the hinge base 1423 with the fastener 1403 extending through a bore 1406 in the hinge mount 1401 (see FIG. 70) and with the fastener 1403 threaded to the anchor 1404. Then the lock cap 1402 is rotated closed (e.g., in the counterclockwise direction as shown in FIG. 71) so that a finger 1407 of the lock cap 1402 moves toward a finger 1425 of the hinge base 1423, in which the varying thickness in the annular vertical wall 1408 of the lock cap 1402 aligns and blocks one or more flexible or compliant features, shown in FIG. 69 as cantilevered tabs 1426, of the hinge base 1423 from being moved to a position that would allow the hinge mount 1401 and lock cap 1402 to be removed. Thus, the hinge mount 1401 is thereby retained by and secured to the hinge base 1423, such that the hinge mount 1401 cannot be moved vertically relative to the hinge base 1423. As shown in FIG. 73, the annular vertical wall 1408 of the lock cap 1402 includes thin sections 1409 and thick sections 1410 at various (e.g., alternating) locations circumferentially around the wall 1408. When the thin sections 1409 of the wall 1408 are located between (e.g., aligned radially with) the tabs 1426 and an outer wall 1427 of the cup 1424, then the lock cap 1402 can be removed axially (e.g., vertically, along the longitudinal axis of the threaded portion of the fastener 1403) from the cup 1424 of the hinge base 1423. When the thick sections 1410 of the wall 1408 are located between the tabs 1426 and the outer wall 1427 of the cup 1424, then the lock cap 1402 is retained in place axially (i.e., the lock cap 1402 resists being removed or moved axially), thereby retaining the hinge mount 1401 in place as well. Also shown in FIG. 73, the lock cap 1402 includes a channel 1411 between the finger 1407 and the wall 1408 for receiving the outer wall 1427 of the cup 1424. As shown in FIGS. 71 and 72, the hinge cover 1428 of the hinge base 1423 can be rotated to the covered position (i.e., covering the hinge assembly) to provide an aesthetic improvement. The hinge cover 1428 and the lock cap 1402 can be configured such that moving the hinge cover 1428 to the covered position can force the lock cap 1402 to fully close or close far enough to be fully secured in the event that the lock cap 1402 was not fully rotated. This ensures the seat is secured even when an installer does not rotate the cap lock 1402 far enough to be fully secured. When in the covered position, the hinge cover 1428 also prevents the twist lock cap 1402 from accidently rotating toward the open (e.g., non-locking) position to prevent the lock cap 1402 and assembly form becoming unsecured.

Figure 112:
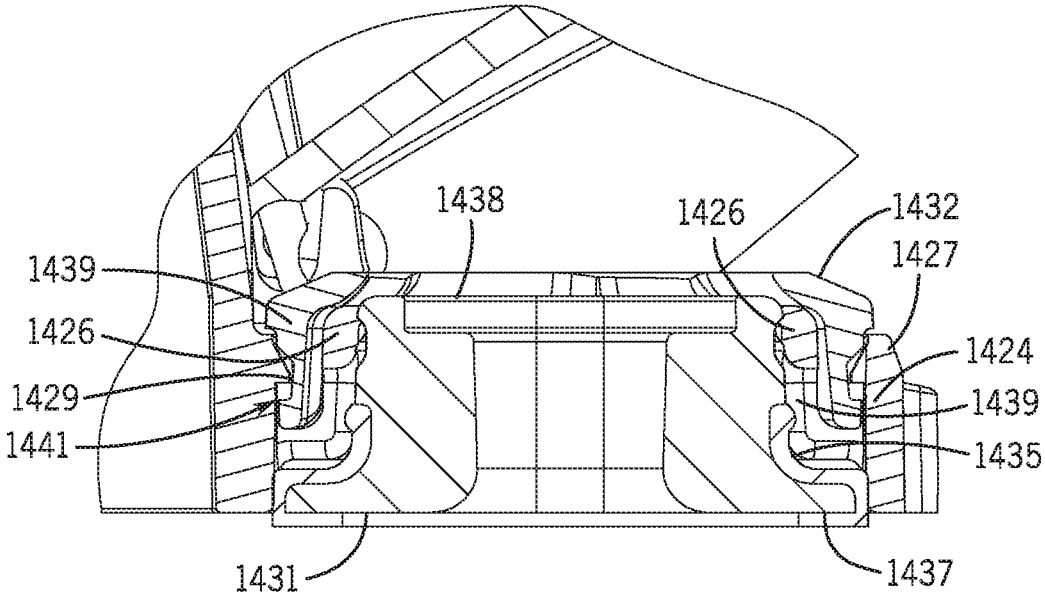
FIG. 112 is a side cross-sectional view of the toilet seat hinge shown in FIG. 111 in a non-locking position.
Figure 113:
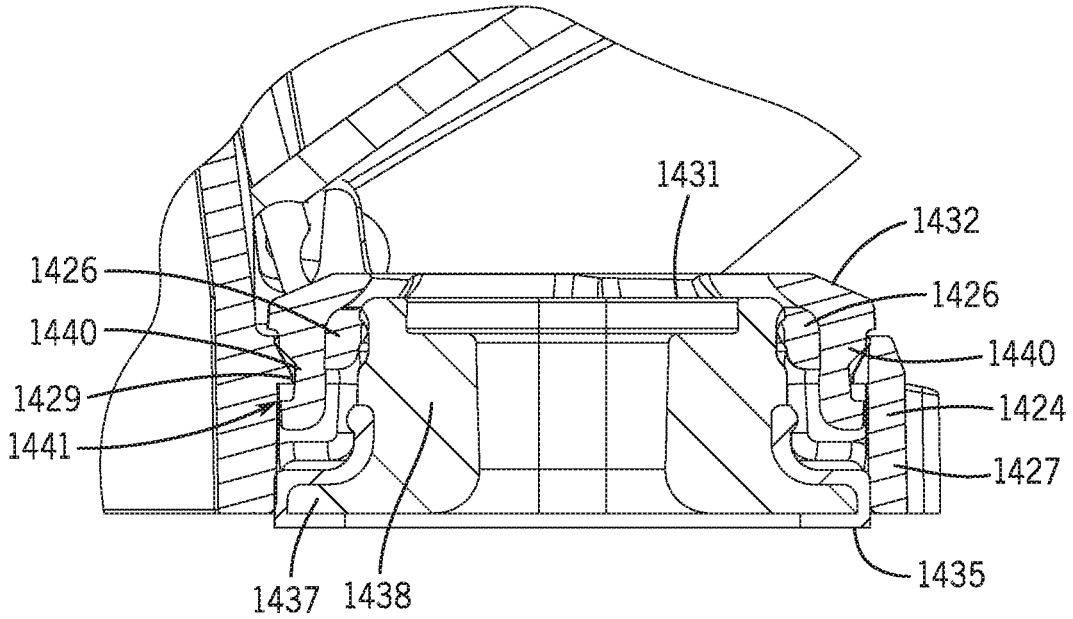
FIG. 113 is a side cross-sectional view of the toilet seat hinge shown in FIG. 111 in a locking position.

FIGS. 111-116 illustrate an exemplary embodiment of a hinge assembly 1430 that is configured to mount to a toilet pedestal. The hinge assembly 1430 includes the hinge base 1423 having two spaced apart cups 1424 along with a hinge lock configured to secure each cup 1424 to the toilet pedestal. Each hinge lock includes a hinge mount 1431, a lock cap 1432 (e.g., lock cover), a fastener such as the fastener 1403 (not shown for clarity), an anchor such as the anchor 1404 (not shown for clarity), and a flexible gasket 1435 (e.g., including a rubber or rubber-like material, such as a TPE), which is disposed on the hinge mount 1401, such as by overmolding. Each hinge mount 1431 has an annular base 1437 and a shoulder 1438, which extends upwardly from a top of the base 1437 and has a size (e.g., diameter) that is smaller than the base 1437, such that the portion of the base 1437 that extends radially beyond the shoulder 1438 is received under the tabs 1426 of the cup 1424 and the shoulder 1438 extends between the tabs 1426 upon installation. The hinge mount shown in FIG. 112 is in a non-locking position, in which thin sections 1439 of the lock cap 1432 are disposed between the tabs 1426 and outer wall 1427. The hinge mount shown in FIG. 113 is in a locking position, in which thick sections 1440 of the lock cap 1432 are disposed between the tabs 1426 and the outer wall 1427. One or more locking features, such as detents, can be employed to further retain the thick sections 1440. As shown in FIG. 113, each detent 1429 extends radially inward, such as from the outer wall 1427, to engage an associated recess 1441 in the lock cap 1432. Rotating the lock cap 1432 by a predetermined angular rotation moves the hinge mount from the non-locking position to the locking position.

Also shown in FIGS. 112 and 113, the gasket 1435 extends around at least a portion of each of a bottom, a side wall, and a top of the base 1437 and a side wall of the shoulder 1438 of the hinge mount 1431. The gasket 1435 is configured to create user feedback during assembly/installation and a compression fit when rotating the lock cap 1432 into contact and compression/flexure of flexible features (e.g., tabs 1426) of the hinge base 1423. The gasket 1435 also acts as a spring to lessen lift force by flexing the tabs outward when unlocked as well as absorbing tolerances (e.g., "slop") within the assembly 1430.

Figure 114:
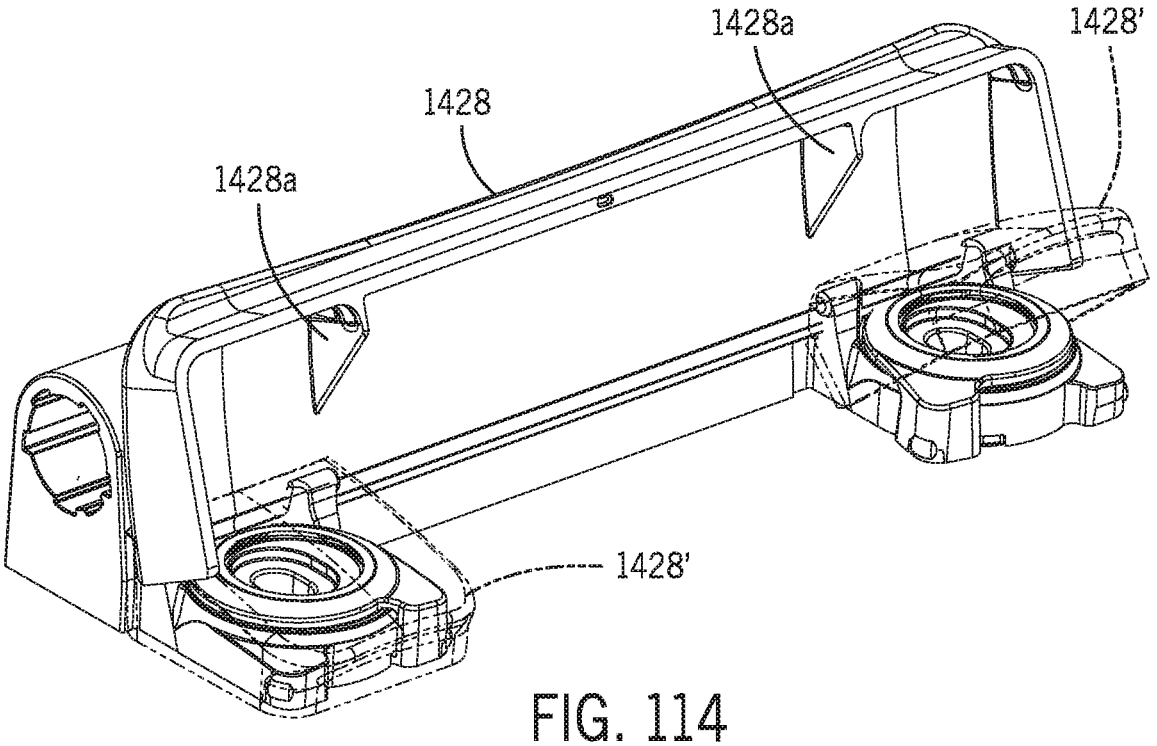
FIG. 114 is a perspective view of the toilet seat hinge with both a one-piece cover and two-piece covers.
Figure 115:
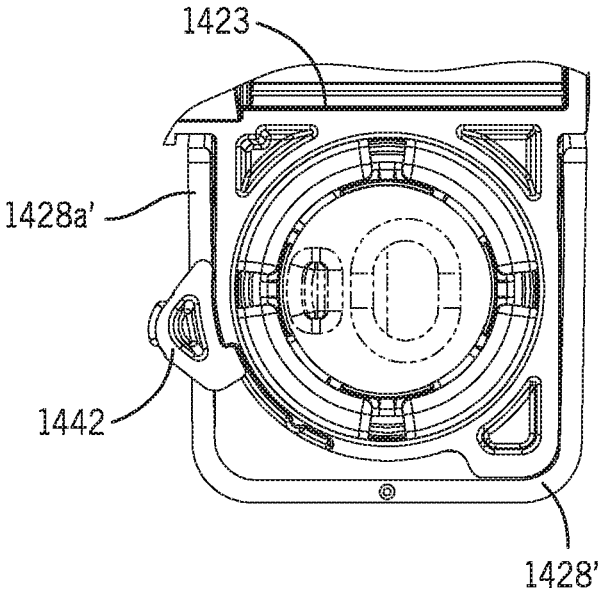
FIG. 115 is a top cross-sectional view of the toilet seat hinge shown in FIG. 114 in a non-locking position.
Figure 116:
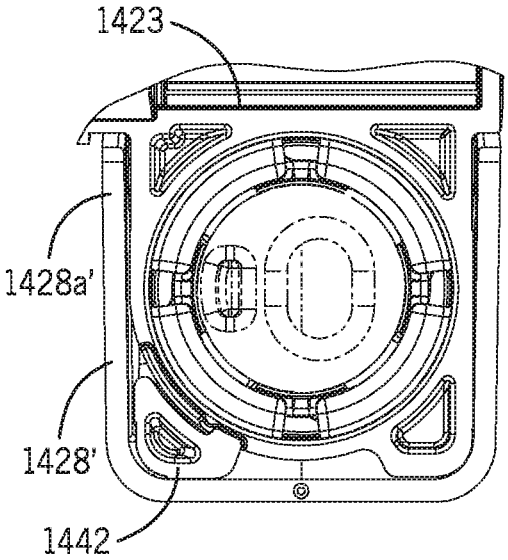
FIG. 116 is a top cross-sectional view of the toilet seat hinge shown in FIG. 114 in a locking position.

FIG. 114 shows both a single hinge cover 1428 design, which is configured to cover both hinge locks and both cups 1424, as well as two independent hinge covers 1428', each of which covers one hinge lock and one cup 1424. Regardless of the single or dual design, the hinge covers 1428, 1428' can be configured to have "poke-yoke" features that help ensure each hinge lock is in the locked position and installed correctly. As shown, the single hinge cover 1428 includes a vertical wall **1428*a* that extends down from a top wall and is positioned to contact and move a finger 1442 (see FIG. 115) from a non-locking position to a locking position during closing of the hinge cover 1428. Similarly, as shown in FIGS. 115 and 116, an inner side wall 1428*a*' of each cover 1428' is configured to contact and move the finger 1442 from the non-locking position (FIG. 115) to the locking position (FIG. 116) upon closing the cover 1428'. For example, the finger 1442 can have a ramped surface that rotates the lock cap 1432 toward the locking direction in response to force from closing the cover 1428'. In this way, if the installer does not full close or lock the lock cap, closing the cover 1428, 1428' can fully close and lock the lock cap 1432. Also shown in FIG. 116, the finger 1442 has a generally triangular shape to nest in a corner of the cover 1428'**.

Figure 117:
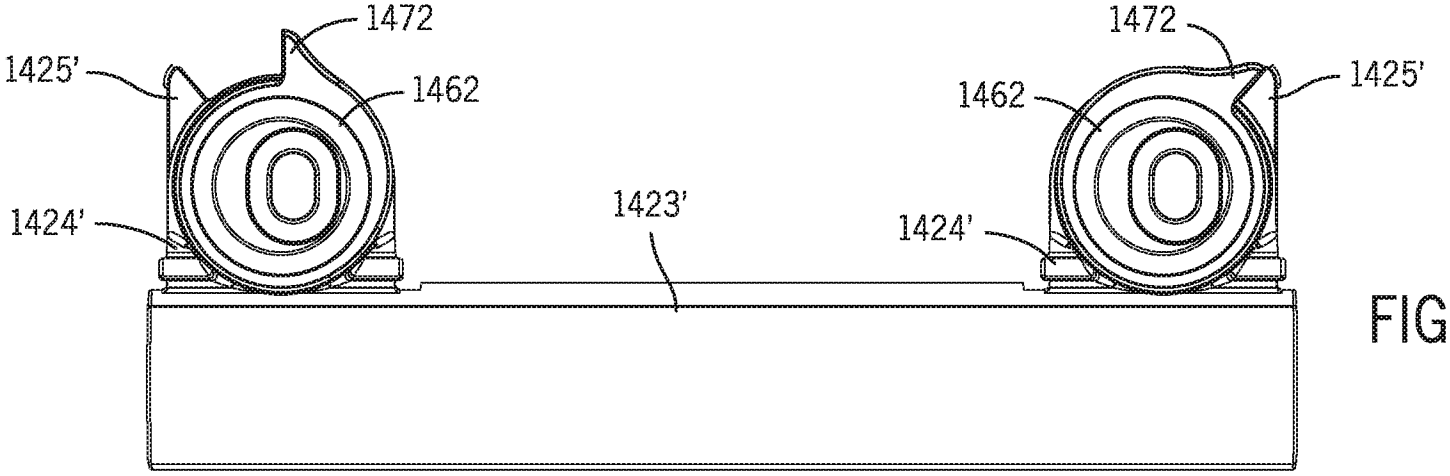
FIG. 117 is a top view of an embodiment of a toilet seat hinge.

FIG. 117 illustrates another embodiment of a toilet seat hinge 1460 that is similar to the hinge assembly 1430, except that the finger 1472 of the lock cap 1462 of the hinge 1460 is configured to move from a separated position relative to the finger 1425' of the cup 1424' of the hinge base 1423' (shown in the left hinge lock) to a nested position (e.g., in contact) with the finger 1425' (shown in the right hinge lock). In this configuration, the front wall of the cover 1428, 1428' can be configured to contact each finger 1472 when the finger 1472 is in a non-locking position to move the finger 1472 of the lock cap 1462 toward the locking or nested position.

Figure 119:
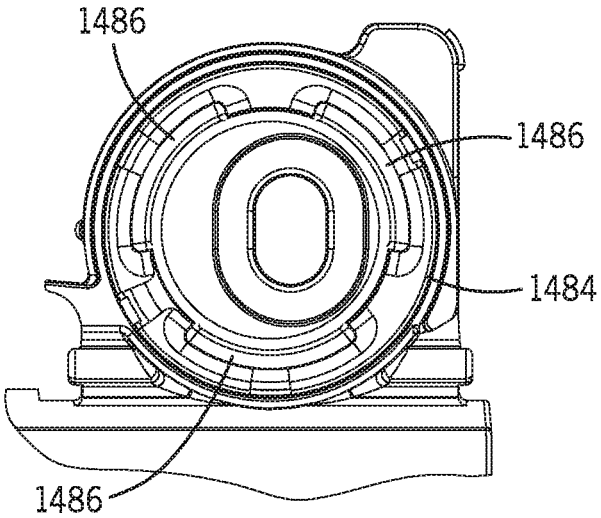
FIG. 119 is a top view of the toilet seat hinge shown in FIG. 117 with the lock cap removed.
Figure 118:
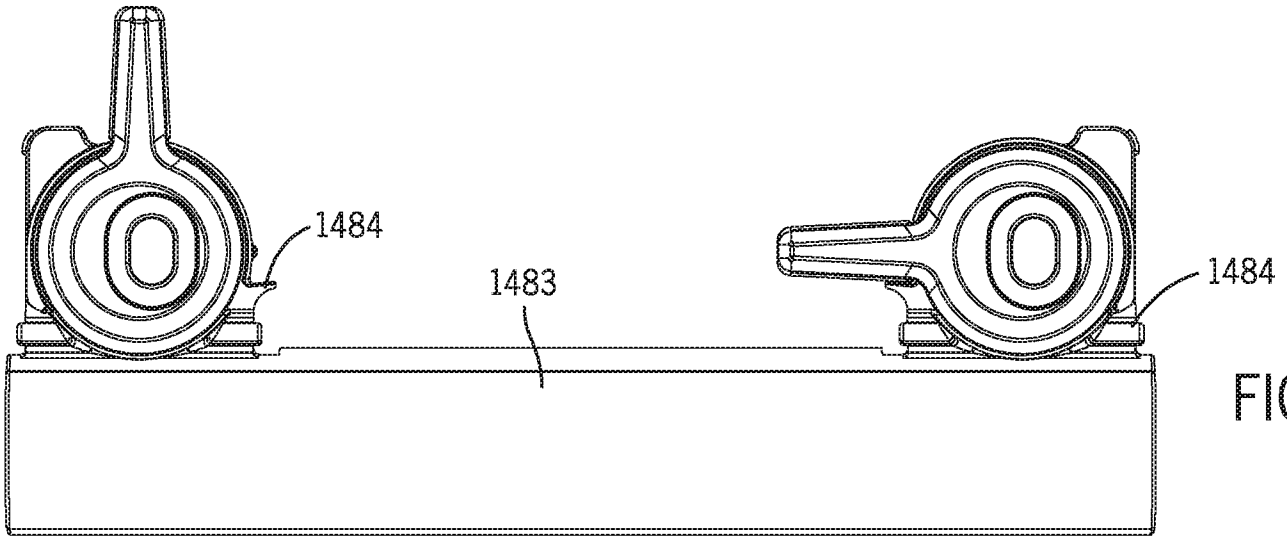
FIG. 118 is a top view of an embodiment of a toilet seat hinge.

FIGS. 118 and 119 illustrates another embodiment of a toilet seat hinge 1490 that is similar to the hinges 1430, 1460, except each cup 1484 of the hinge base 1483 has three cantilevered tabs 1486 (rather than four), which changes the rotational angle necessary to move each hinge lock from the non-locking position to the locking position. For example, depending on the number of tabs, the system or hinge can be configured to rotate ninety degrees, one-hundred and eighty degrees, or another rotational angle.

Figure 75:
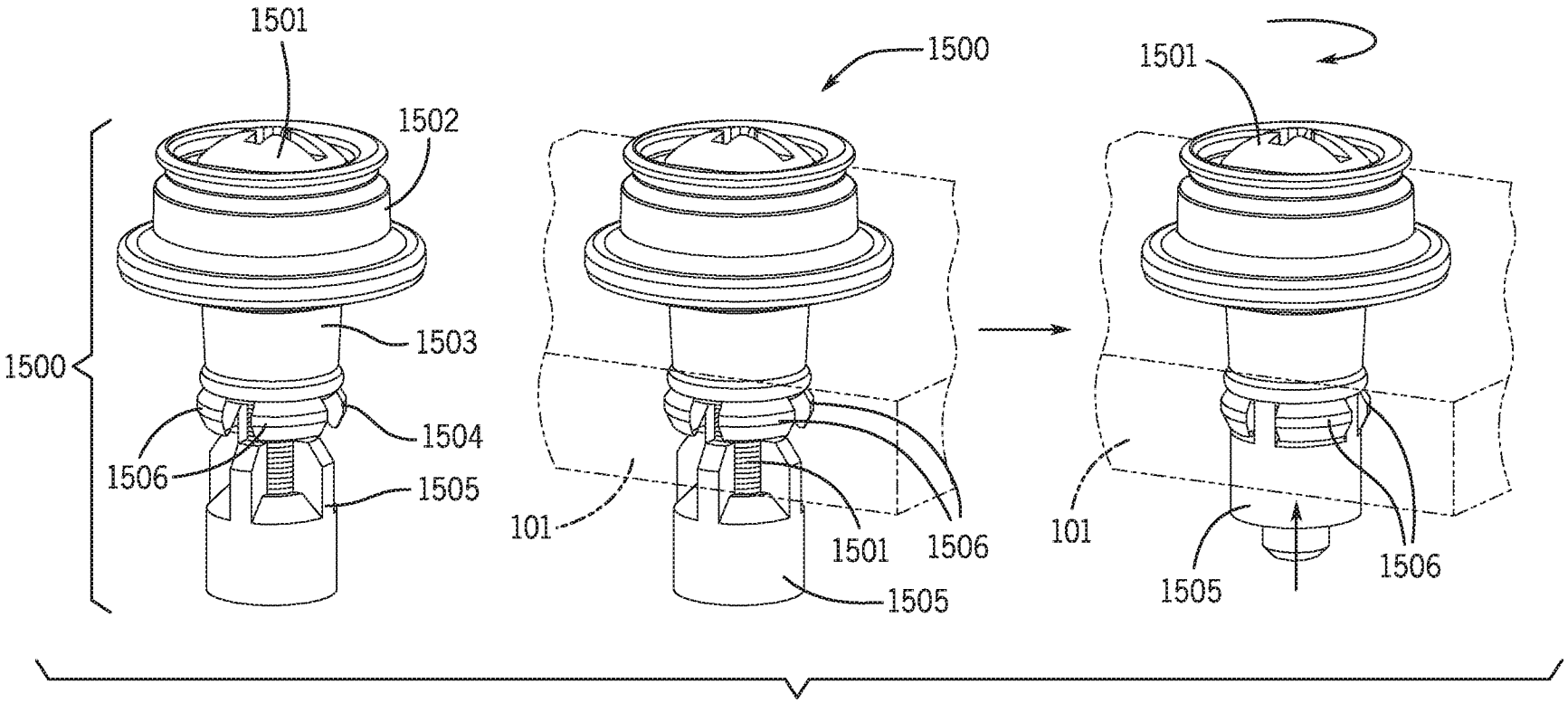
FIG. 75 is a perspective view of an embodiment of an assembly for mounting a toilet seat hinge to a toilet.

FIG. 75 illustrates an exemplary embodiment of an assembly 1500 (e.g., mounting assembly) that is configured to secure a hinge base to a toilet pedestal. As shown, the hinge assembly 1500 includes a screw 1501, a hinge mount 1502, a flexible mount gasket 1503, a semi-rigid mount sleeve 1504, and an anchor 1505, which includes threads or an inserted threaded nut. The mount gasket 1503 can be formed separately or integrally formed (e.g., overmolded) with one or more of the other components of the assembly 1500. The expandable anchor assembly (e.g., flexible mount gasket 1503, semi-rigid mount sleeve 1504) is inserted into the vitreous 101 through the seat post hole from the top. The mount gasket 1503 provides resistance via friction and resists the mount sleeve 1504 from rotating, which also prohibits the anchor 1505 from rotating. The hinge mount 1502 is configured to nest in a mount of the hinge base, such that when the screw 1501 is tightened, the anchor 105 moves vertically (along the threads of the screw 1501) and flexes the mount's flexible features (e.g., fingers 1506) radially while collapsing the expandable anchor assembly. The radially expanded anchor will either create interior compression on the vitreous or provide vertical compression if the contact area/reaction force is below the underside of the vitreous seat post hole.

Figure 76:
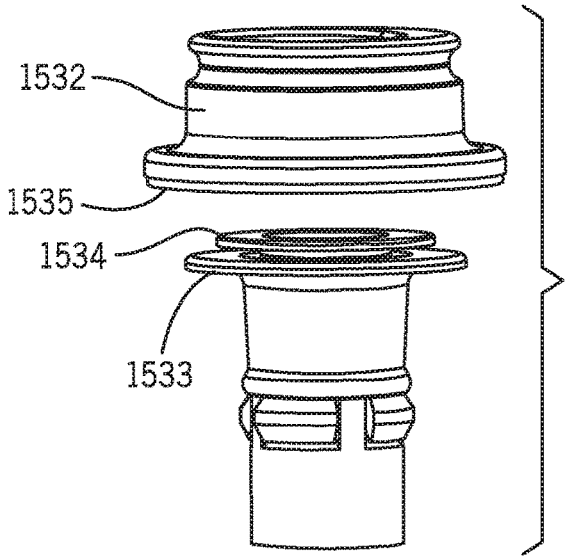
FIG. 76 is a perspective view of an embodiment of an assembly for mounting a toilet seat hinge to a toilet.
Figure 77:
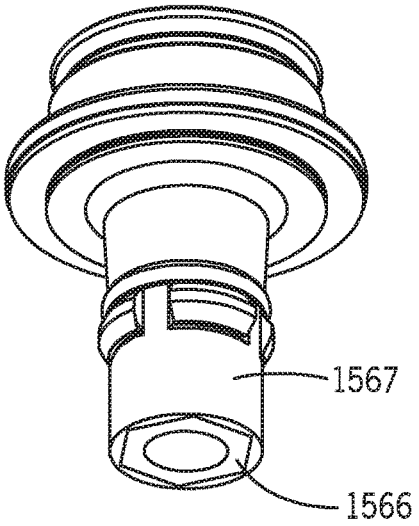
FIG. 77 is a perspective view of an embodiment of an assembly for mounting a toilet seat hinge to a toilet.
Figure 78:
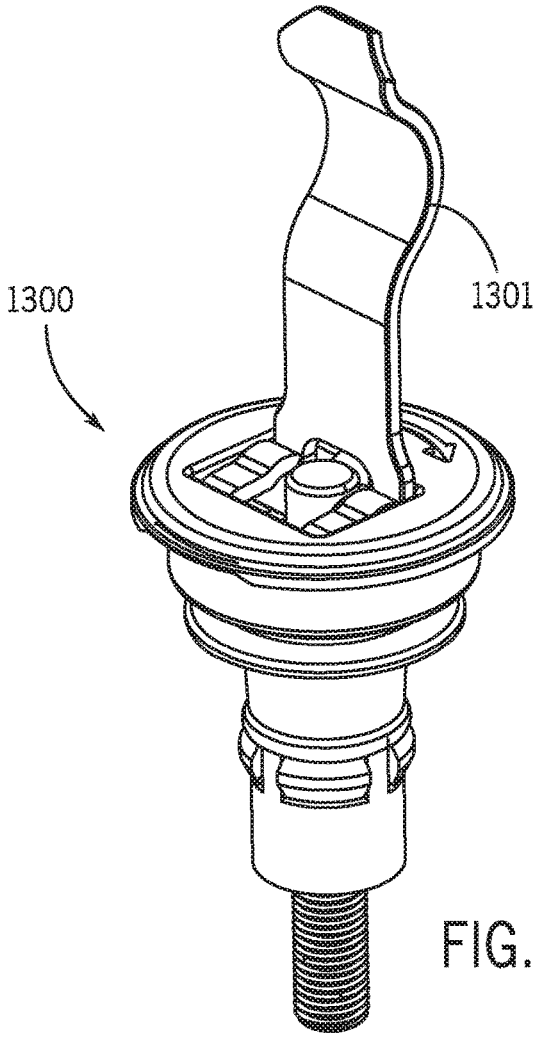
FIG. 78 is a perspective view of an embodiment of an assembly for mounting a toilet seat hinge to a toilet.

FIGS. 76-78 illustrate alternative variants to the assembly 1500 shown in FIG. 75. As shown in FIG. 76, the hinge mount 1532 is formed (e.g., molded) separately from the sleeve 1534 and gasket 1533 for ease of manufacturability and to increase seat fit adjustability. A gasket 1535 can be formed onto a bottom of the hinge mount 1532 or formed separately then coupled thereto. As shown in FIG. 77, an inserted nut 1566 is placed within a bottom end of an anchor 1567 instead of molded-in threads, such that the nut 1566 is prevented from rotating relative to the anchor 1567. Internal threads of the nut 1566 thread to a screw (not shown) to move the nut 1566 and anchor 1567 along the threads to clamp the assembly to a toilet base. As shown in FIG. 78, the cam latch assembly (e.g., the assembly 1300 shown in FIG. 52) can replace the mount and screw to create a "tool-less" solution since the cam lever 1301 can be rotated by an installer by hand (i.e., without needing a tool).

Figure 82:
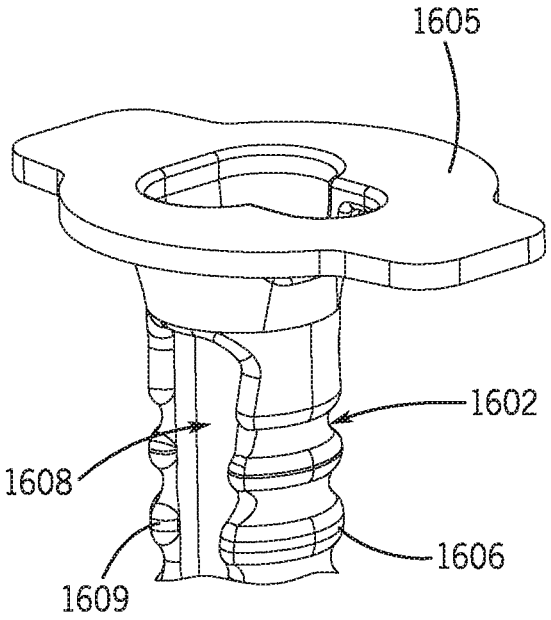
FIG. 82 is a perspective view of part of the mounting assembly shown in FIG. 79.

FIGS. 79-82 illustrate an exemplary embodiment of an assembly 1600 (e.g., mounting assembly) that is configured to mount or secure a hinge base to a pedestal of a toilet, as well as allow for routing of an electric power wire (e.g., a low voltage wire) through the assembly 1600. As shown, the assembly 1600 includes a hinge mount 1601, a mount gasket and/or sleeve 1602, a screw 1603, and an anchor 1604. The hinge mount 1601 nests within a mount or cup of a hinge base; and the mount sleeve 1602 has a base 1605, which rests on the topside of the vitreous and/or a mount of a hinge base, and a flexible/compressible longitudinally elongated section 1606, which extends through a hole 104 in the toilet base 101 (e.g., vitreous). The anchor 1604 is rotatably coupled to a laterally elongated section 1607 at the bottom end of the section 1606 or to the section 1606 directly. As shown in FIG. 82, the base 1605 of the mount sleeve 1602 forms a "boot" that receives a bottom of the hinge mount 1601. During installation, the suspended anchor 1604 is rotated such that the longer end of the nut aligns with the seat's post hole axis (and the longitudinally elongated section 1606) and is passed through the blind hole 104 in the toilet base 101. The flexible gasket material allows the assembly to "buckle" due to one or more slots 1608 and/or one or more scalloped/arcuate features, such as corrugations 1609, in the elongated section 1606 of the mount gasket. When the gasket material bends, the flexible material expands outwardly or along the scalloped/arcuate features, which creates a protection barrier between the wire and screw.

Figure 79:
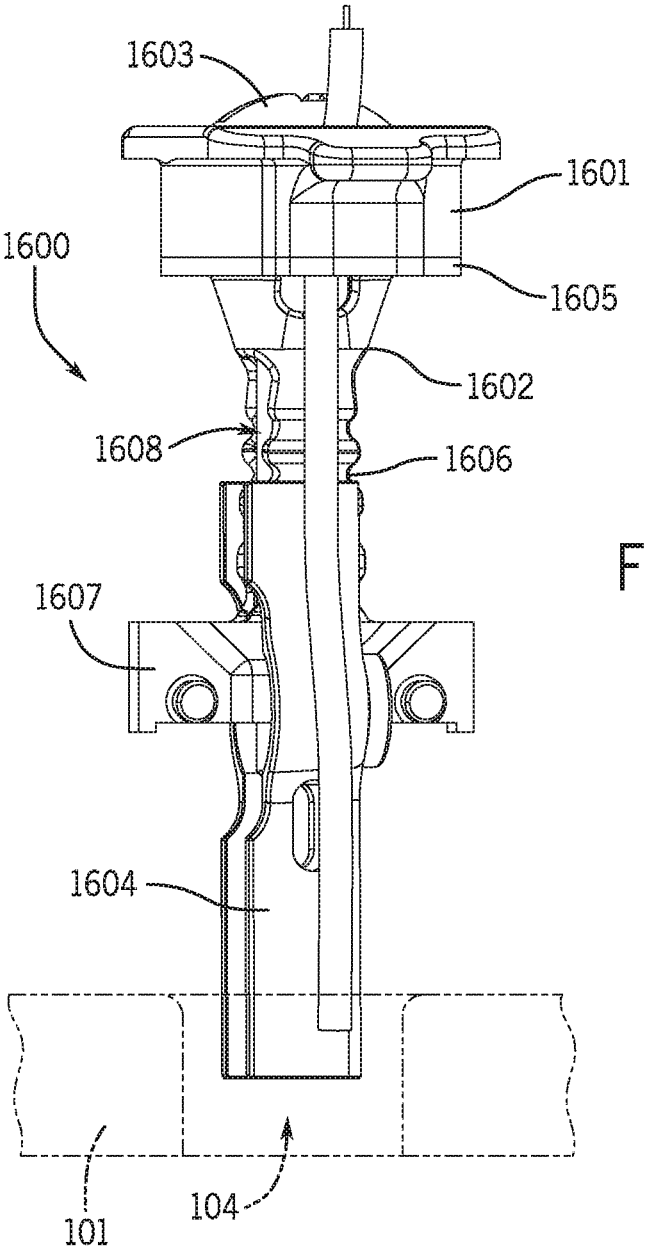
FIG. 79 is a plan view of an embodiment of an assembly for mounting a toilet seat hinge to a toilet.
Figure 80:
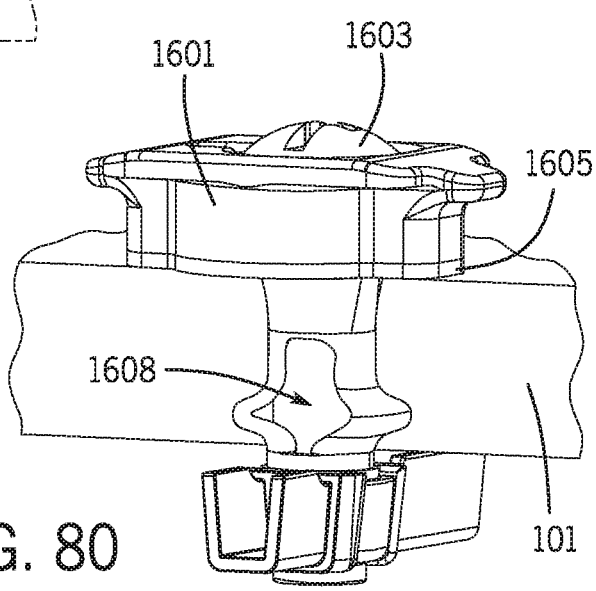
FIG. 80 is a perspective view of the mounting assembly shown in FIG. 79.
Figure 81:
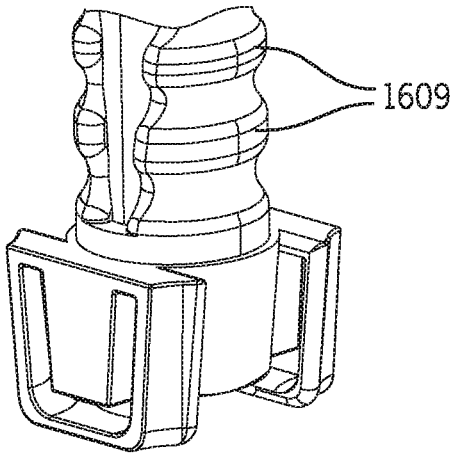
FIG. 81 is a perspective view of part of the mounting assembly shown in FIG. 79.
Figure 83A:
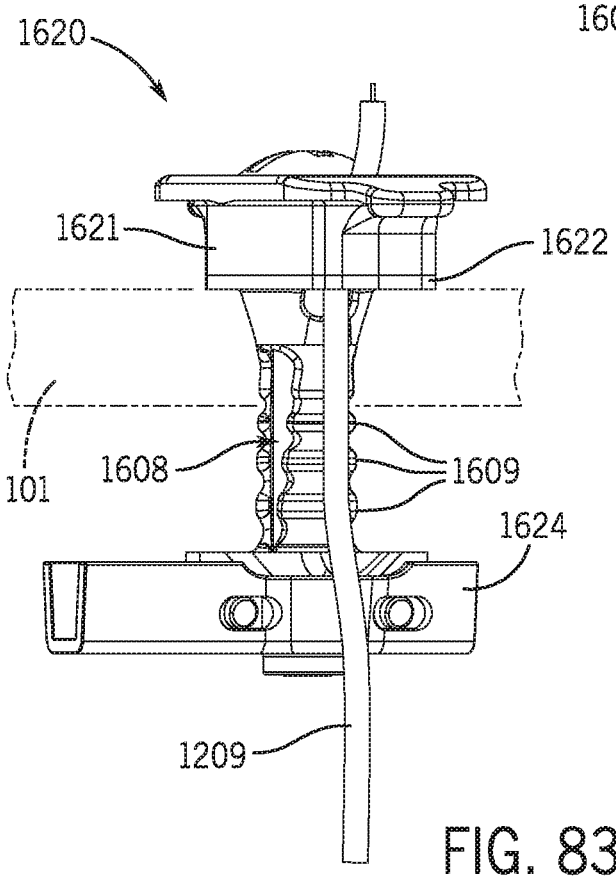
FIGS. 83A-83D are plan views of alternative embodiments of the mounting assembly shown in FIG. 79.
Figure 83B:
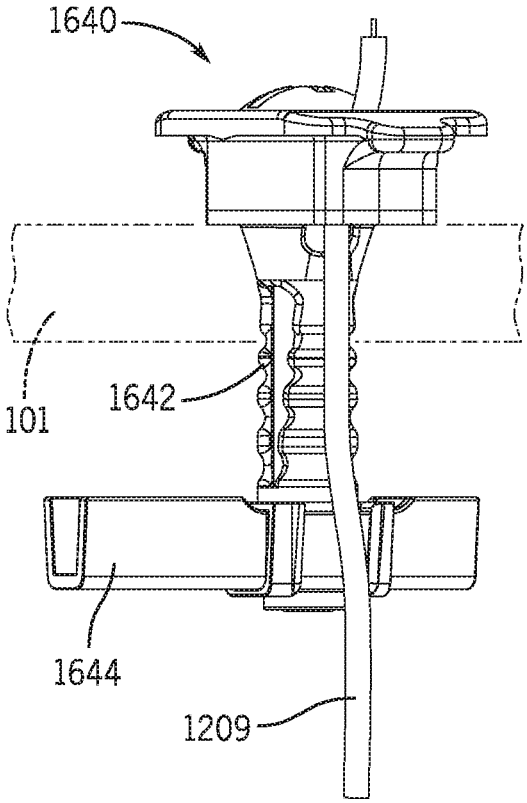
Figure 83C:
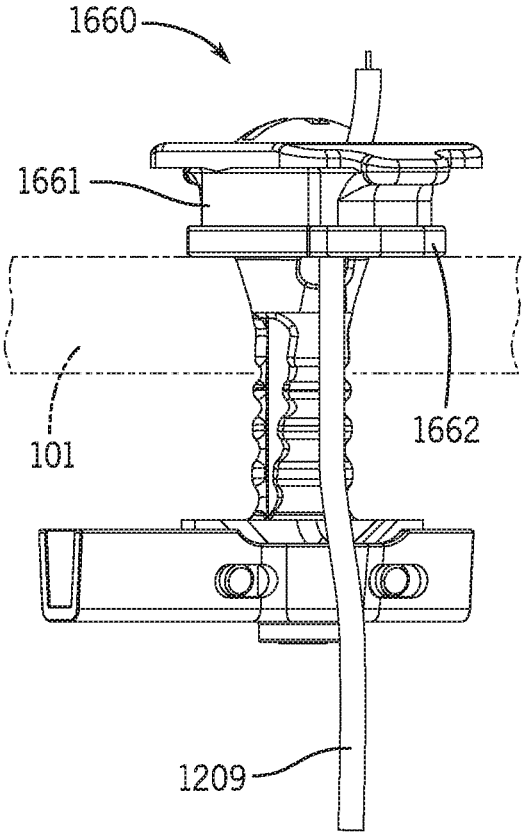
Figure 83D:
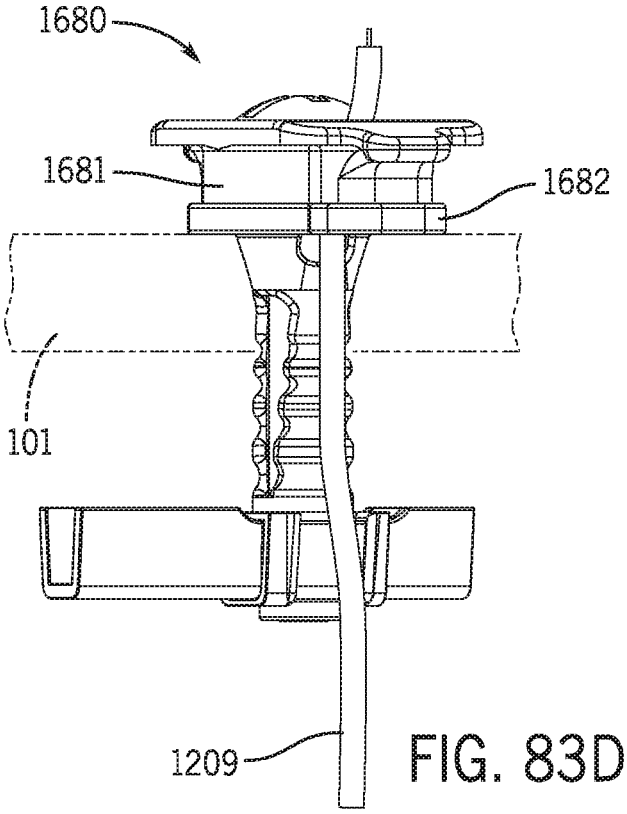

FIGS. 83A-83D illustrate alternative variants to the assembly 1600 shown in FIG. 79. As shown in FIG. 83A, the assembly 1620 includes a hinge mount 1621 and a mount gasket 1622, which are coupled (e.g., bonded) together, and a nut 1624, which is assembled post forming (e.g., molding). This arrangement enables a secure installation due to grip of the gasket to the vitreous and allows for removal of the gasket for reinstallation (e.g., by pulling up to release from the nut). As shown in FIG. 83B, the hinge assembly 1640 is the same as the hinge assembly 1620, except the anchor 1644 and the gasket 1642 are integrally formed (e.g., co-molded, insert molded, etc.) together. This arrangement creates only one part but is more difficult to remove, as it is removed by pushing up or destroying/damaging (e.g., tearing) the gasket 1642. As shown in FIG. 83C, the assembly 1660 is the same as the assembly 1620, except removes the bonded gasket 1662 from the hinge mount 1661. This arrangement is the easiest to manufacturer, but requires post assembly of the nut and multiple parts during assembly. As shown in FIG. 83D, the assembly 1680 is the same as the assembly 1640, except removes the bonded gasket 1682 from the hinge mount 1681. This arrangement enables an easy to removal process (e.g., by pushing through the post hole) and is easier to manufacture the nut assembly.

Figure 84:
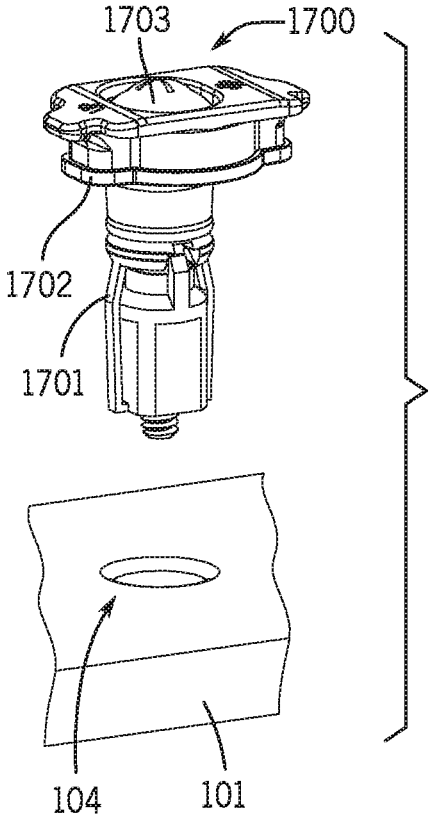
FIG. 84 is a perspective view of an embodiment of an assembly for mounting a toilet seat hinge to a toilet.
Figure 85:
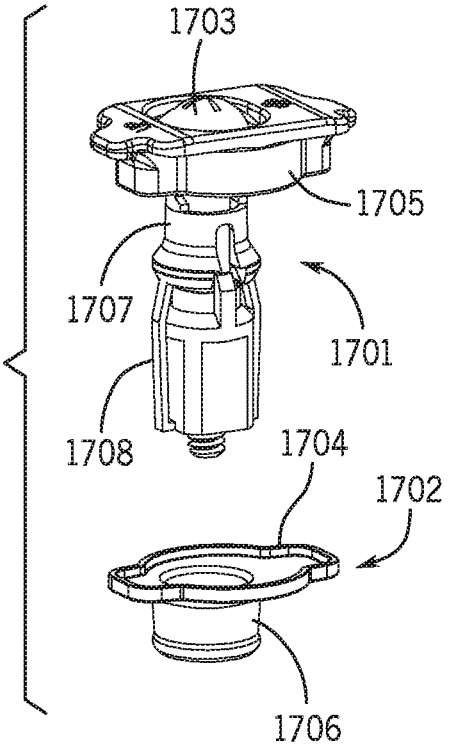
FIG. 85 is an exploded perspective view of the mounting assembly shown in FIG. 84.

FIGS. 84-87 illustrate an exemplary embodiment of an assembly 1700 (e.g., mounting assembly) that is configured to secure a seat assembly (e.g., a hinge base thereof) to a toilet pedestal or bowl. The illustrated assembly 1700 includes an integrated mount and expandable anchor assembly 1701, a gasket 1702, and a screw 1703. As shown in FIG. 84, the gasket 1702 can be inserted over (or overmolded onto) the mount and anchor assembly 1701, such that the gasket 1702 and the mount and anchor assembly 1701 are inserted through the hole 104 in the toilet base 101 from a top side of the vitreous (e.g., through a seat post hole from the same direction). As shown in FIG. 85, the gasket 1702 includes a base portion 1704, which is configured to receive the bottom of the mount portion or mount 1705 of assembly 1701, and a sleeve portion 1706, which extends downwardly form the base portion 1704 and is configured to receive and encircle a top portion 1707 of the anchor 1708 of assembly 1701. The gasket 1702 can include or be made of TPE or similar material, such that the gasket 1702 can flex and stretch to aid assembly over the assembly 1701 and to provide "grip-tight" sealing of the mount to the vitreous. The gasket 1702 lessens the required clamp load for a secure installation and contains the expansion sleeve, such as when the tethered runner features a snap during assembly.

Figure 86:
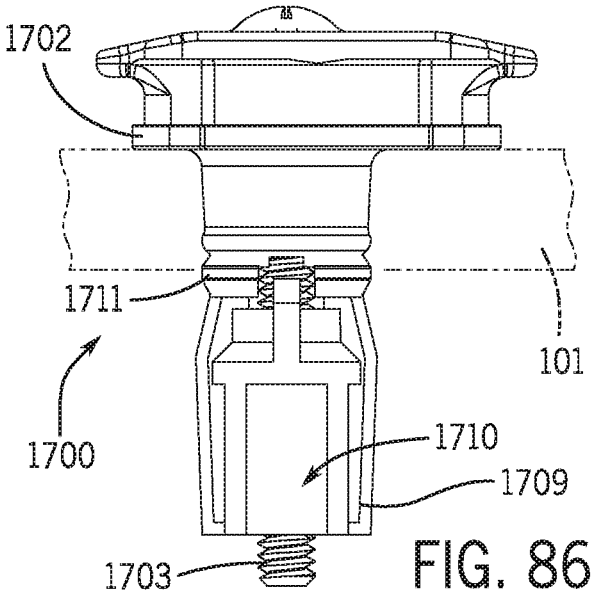
FIG. 86 is a plan view of mounting assembly shown in FIG. 84.
Figure 87:
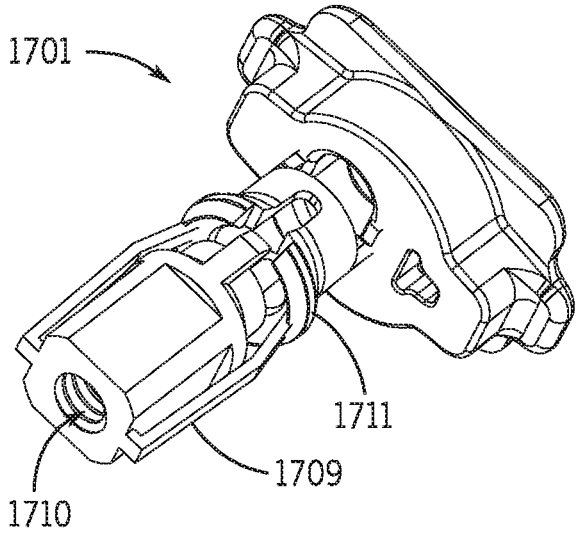
FIG. 87 is a perspective view of part of the mounting assembly shown in FIG. 84.

As shown in FIGS. 86 and 87, a bottom portion 1709 of the integrated mount and anchor assembly 1701 has molded in threads 1710, such that the bottom portion 1709 acts as the nut that forces the expansion sleeve 1711 into compression with the vitreous 101 when the screw 1703 is threaded to the threads 1710 by moving the bottom portion 1709 upwardly (e.g., as the screw 1703 is tightened). Thus, the bottom portion 1709 moves relative to the expansion sleeve 1711 until the bottom portion 1709 contacts the sleeve 1711, then the bottom portion 1709 moves and expands the sleeve 1711 into contact with the vitreous 101.

Figure 89:
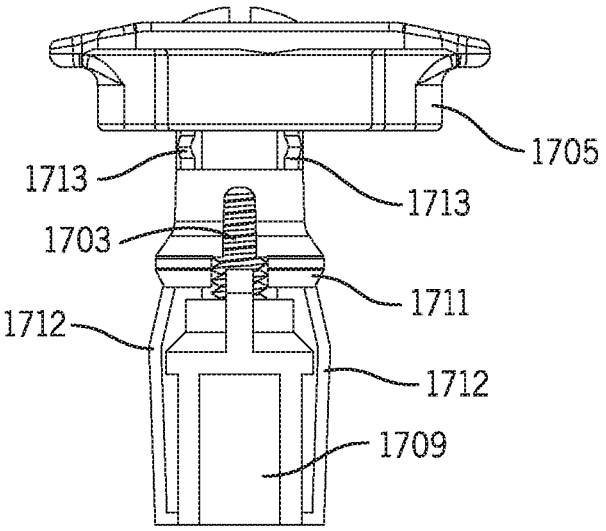
FIG. 89 is a plan view of part of the mounting assembly shown in FIG. 84.
Figure 90:
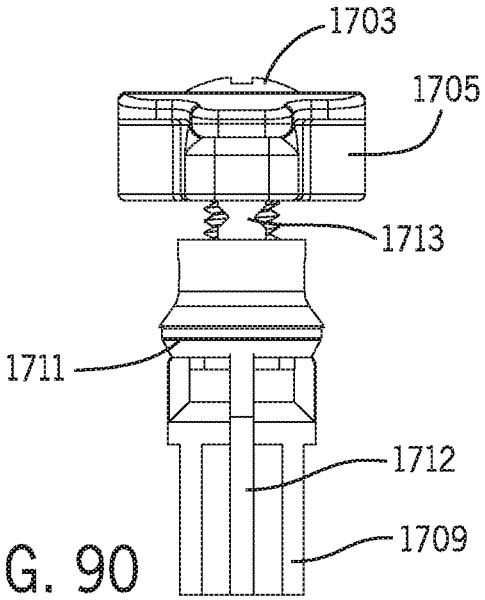
FIG. 90 is a plan view of part of the mounting assembly shown in FIG. 84.
Figure 91:
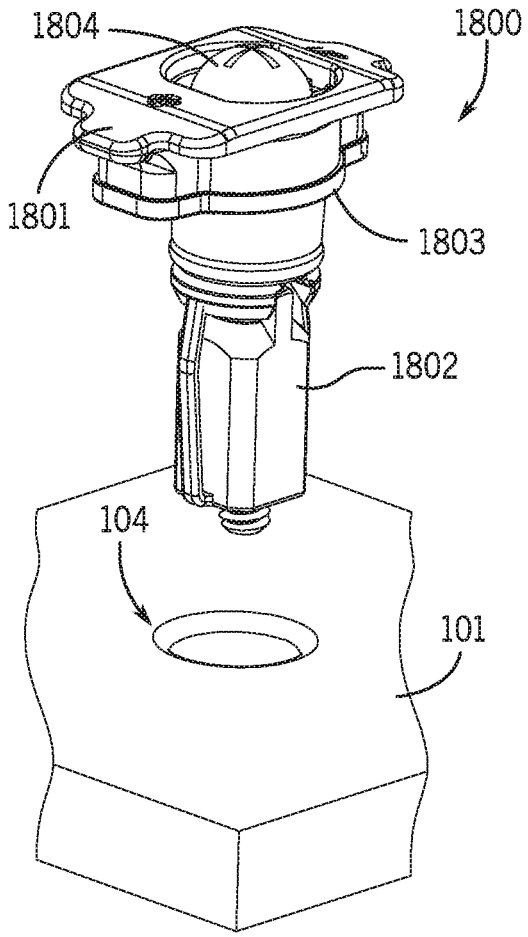
FIG. 91 is a perspective view of an embodiment of an assembly for mounting a toilet seat hinge to a toilet.
Figure 92:
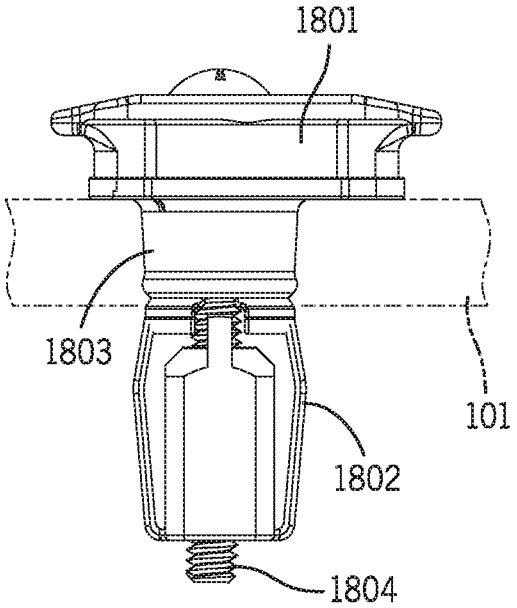
FIG. 92 is a plan view of the mounting assembly shown in FIG. 91.
Figure 93:
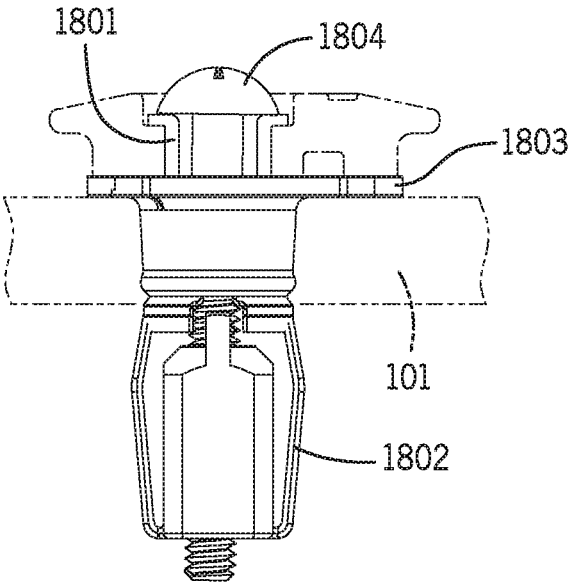
FIG. 93 is a plan view of the mounting assembly shown in FIG. 91.
Figure 94:
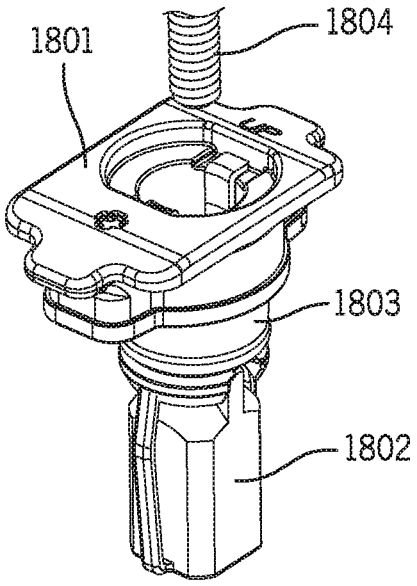
FIG. 94 is a perspective view of the mounting assembly shown in FIG. 91.

FIG. 89 shows that the expansion sleeve 1711 and the (threaded) bottom portion 1709 are coupled via one or more runners 1712. Each runner 1712 is shown as a thin strip of material connected to the sleeve 1711 at one end and the bottom portion 1709 at the other end, and each runner 1712 is provided for molding and for retaining the parts of the integrated mount and anchor assembly 1701 together prior to assembly and during installation. FIGS. 89 and 90 also show that the integrated mount and anchor assembly 1701 can optional include one or more second runners 1713 (e.g., sleeve's tethered runners). Each second runner 1713 is shown as a thin strip of material extending between a top of the sleeve 1711 and a bottom of the mount 1705 that aids molding and allows the screw 1703 to shift laterally (e.g., side-to-side, fore-and-aft) relative to the mount 1705 to allow for seat fit adjustability/tolerances.

Figure 88:
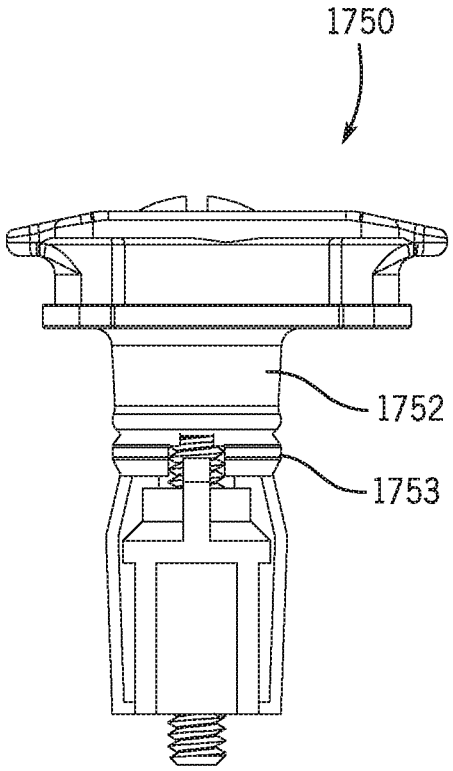
FIG. 88 is a plan view of alternative embodiment of the mounting assembly shown in FIG. 84.

FIG. 88 illustrates an alternative variant to the assembly 1700 shown in FIG. 84. As shown, the hinge assembly 1750 includes an integrated gasket 1752 and sleeve 1753 (with the mount and anchor assembly) formed through a process (e.g., two-shot molding, insert molding, etc.). For example, the gasket 1752 can be overmolded onto the sleeve 1753. Overmolding the gasket 1752 on a rotary transfer core pin mold would remove the gasket assembly process and enable material adhesion through compatible resin specification.

Figure 95:
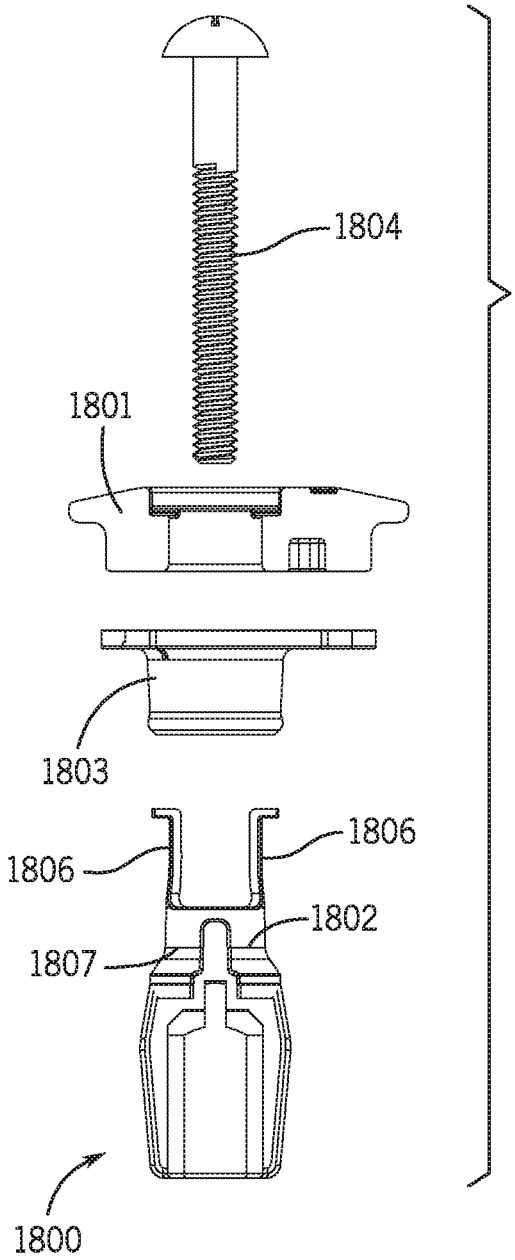
FIG. 95 is an exploded plan view of the mounting assembly shown in FIG. 91.

FIGS. 91-95 illustrate an exemplary embodiment of a mounting assembly 1800 that is configured to secure a toilet seat assembly to a portion of toilet bowl 101. As shown, the mounting assembly 1800 includes a mount 1801, an anchor assembly or expandable anchor 1802, a gasket 1803, and a screw 1804. That is, the mount 1801, the gasket 1803, and the expandable anchor 1802 have been decoupled into separate components. This arrangement is easier to manufacture, is easier to assemble the gasket onto the nut assembly (e.g., the gasket assembles from the top and over flexible features), and allows for improved lateral (e.g., side-to-side, fore-and-aft) adjustability through the recess in the mount relative to the vertical hanging support features. As shown in FIG. 95, the anchor 1802 includes arms 1806 extending upwardly from a top of an expansion sleeve 1807, where the arms 1806 can be received in the gasket 1803 to couple the gasket 1803 and the anchor 1802 together.

Figure 96:
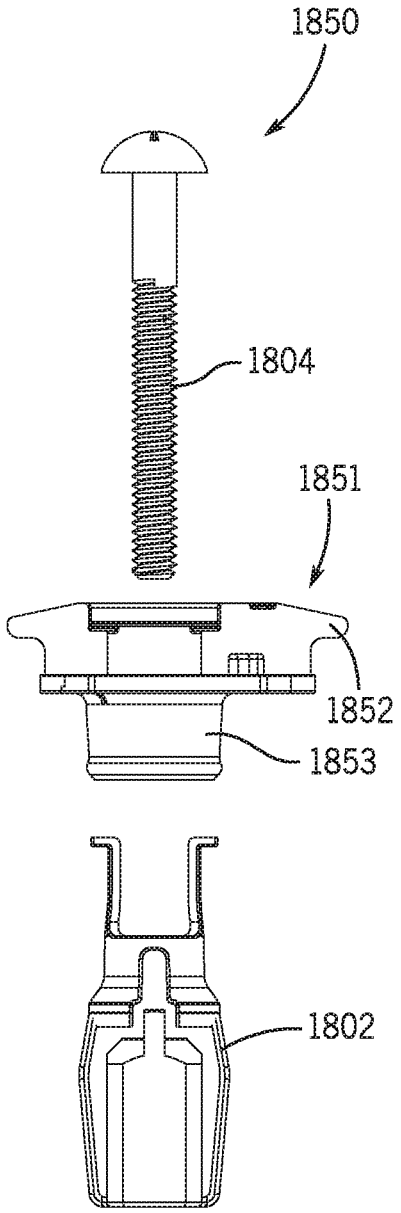
FIG. 96 is an exploded plan view of an alternative embodiment of the mounting assembly shown in FIG. 91.
Figure 97:
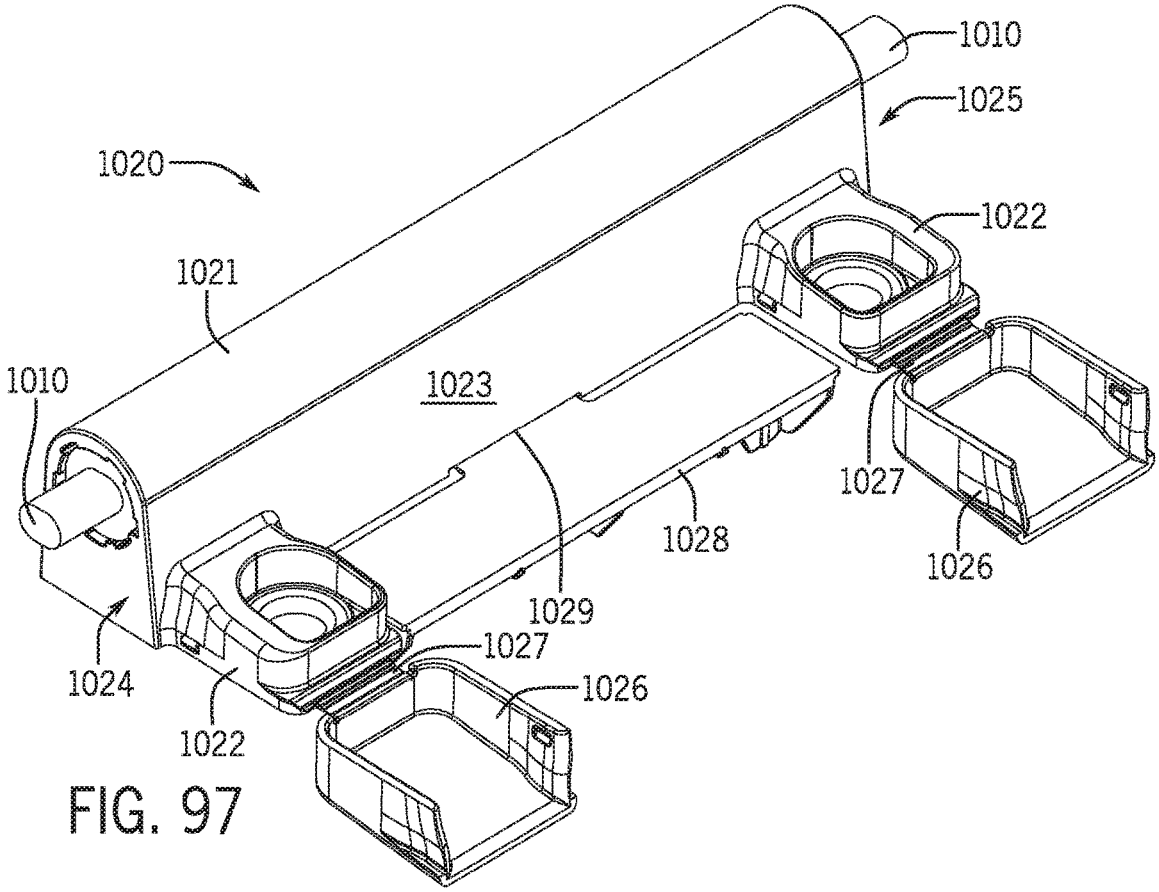
FIG. 97 is a perspective view of an embodiment of a hinge base.
Figure 98:
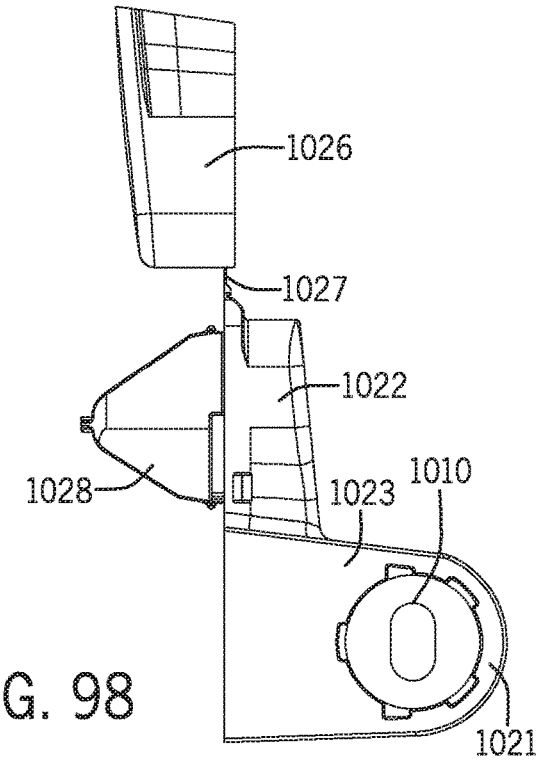
FIG. 98 is a side view of the hinge base shown in FIG. 96.
Figure 99:
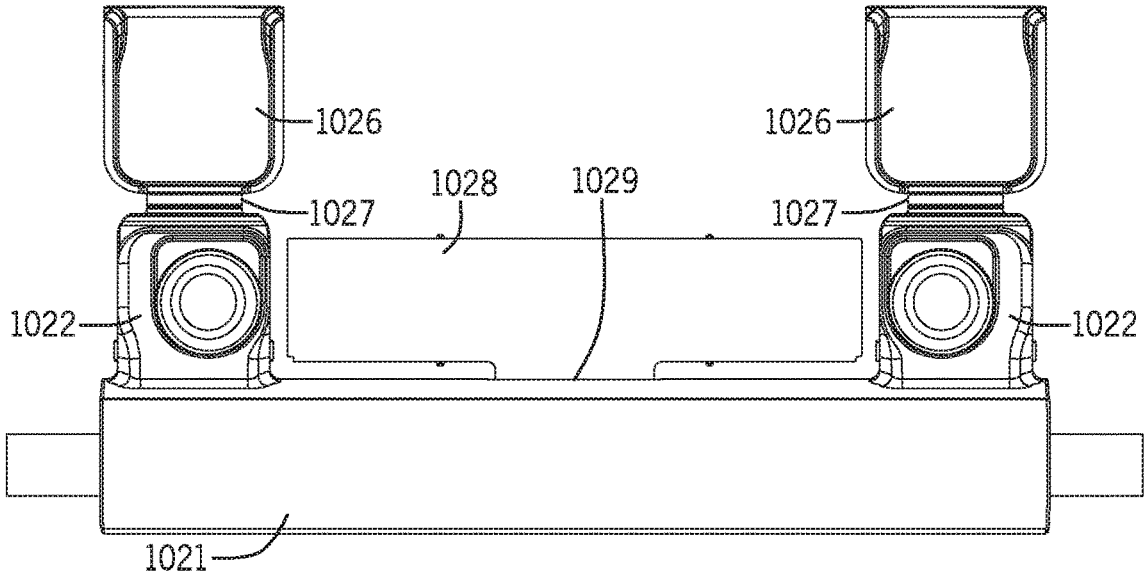
FIG. 99 is a top view of the hinge base shown in FIG. 96.

FIG. 96 illustrates an alternative variant to the mounting assembly 1800. As shown, the mounting assembly 1850 includes an integrated mount and gasket, the anchor 1802, and the screw 1804. The integrated mount and gasket includes a mount portion 1851, which is the same as the mount 1801, and a gasket portion 1853, which is the same as the gasket 1803. The rubber like gasket portion 1853 (e.g., gasket/sleeve) can be integrally formed with/onto the mount portion 1851 through a process (e.g., two-shot molding, insert molding, etc.). Overmolding the gasket portion 1853 onto the mount portion 1851 removes the gasket assembly process and allows for secure gasket fit during the seat installation process.

FIGS. 97-100 illustrate an exemplary embodiment of a one-piece (e.g., unitary) hinge base 1020 that includes a base member 1021, first and second mounts 1022 extending from a front wall 1023 of the base member 1021 proximate first and second opposite ends 1024, 1025, a first cover 1026 coupled to the first mount 1022 through a first living hinge 1027, a second cover 1026 coupled to the second mount 1022 through a second living hinge 1027, and a bottom cover 1028 coupled to the base member 1021 (e.g., a bottom of the front wall 1023) through a third living hinge 1029. It is noted that when installed with a toilet, the front wall 1023 typically faces rearward toward a toilet tank, if provided, although the front wall 1023 could be configured to face forward toward the bowl. The base member 1021, each mount 1022, and/or each cover 1026 can be made according to any of the embodiments disclosed herein. The illustrated base member 1021 includes the front wall 1023, sides, a top wall, and a rear wall. Each illustrated mount 1022 includes a cup having a rear coupled to the front wall 1023, an opening to receive a mounting assembly or hinge lock assembly and a front coupled to the associated living hinge 1027. Each illustrated cover 1026 includes front coupled to the associated living hinge 1027, opposing sides, and a top interconnected with the sides and front. Each cover can include one or more posts extending away from an underside of the top, where each post engages an associated bore in the associated mount 1022 to secure the cover in the closed position with the mount 1022. A pivot member 1010 is located in each side of the base member 1021 to pivotally couple a seat and/or a seat lid to the hinge base 1020. The bottom cover 1028, as shown, extends between the first and second mounts 1022 and, therefore, has a lateral length or width that is shorter than a lateral length or width of the base member 1021 due to the mounts 1022. This arrangement advantageously places the living hinge 1029 on the same side of the base member 1021 as the mounts 1022, so that if the mounts 1022 face rearward (e.g., away from the bowl and toward a tank) in an installed position with a toilet (e.g., pedestal), then the living hinge 1029 is relatively concealed from view by users of the toilet, which is advantageous from an aesthetics perspective. Alternatively, the bottom cover 1028 and living hinge 1029 can be molded on the side of the base member 1021 that is opposite to the mounts 1022. For this arrangement, the lateral length of the bottom cover 1028 can extend up to (or beyond) the lateral length of the base member 1021 to thereby give the bottom cover 1028 up to the same size "footprint" as the base member 1021.

The first and second living hinges 1027 allow for the first and second covers 1026 to remain coupled to the base member 1021 during shipping and installation, while allowing each cover 1026 to be rotated to a covering (e.g., closed) position onto the associated mount 1022. The third living 1029 hinge allows for the bottom cover 1028 to remain coupled to the base member 1021 during shipping and installation for ease, while allowing the bottom cover 1028 to be rotated to an installation position under the base member 1021 and on the toilet pedestal or bowl (e.g., an upper surface of the vitreous). The entire unitary hinge base 1020 can be formed of a common material. Alternatively, one or more of the living hinges 1027, 1029 can be formed using a material that is different than the material of the base member 1021, the bottom cover 1028, and/or the mounts 1022. For example, the base member 1021, the bottom cover 1028, and/or the mounts 1022 can include a material having a relatively high strength (which often results in lower flexibility), whereas each living hinge 1027, 1029 can include a material that has a relatively higher flexibility. In this way the load bearing parts of the unitary hinge base advantageously are made of a stronger material (e.g., higher strength material) and the living hinges are made of a more flexible material to allow the relative movement of the mount covers/bottom cover relative to the base. The two different materials can be formed, for example, using a two-shot molding technique, where all of the elements made with a first material (e.g., the higher strength material) are formed in a first shot (e.g., injection of the first material) and all of the elements made with the second material (e.g., the higher flexibility material) are formed in a second shot (e.g., injection of the second material), such as by overmolding. Moreover, the unitary hinge bases disclosed herein (e.g., hinge base 1020) can be made using more than two materials with more than two shots or injections of the more than two materials.

Figure 100:
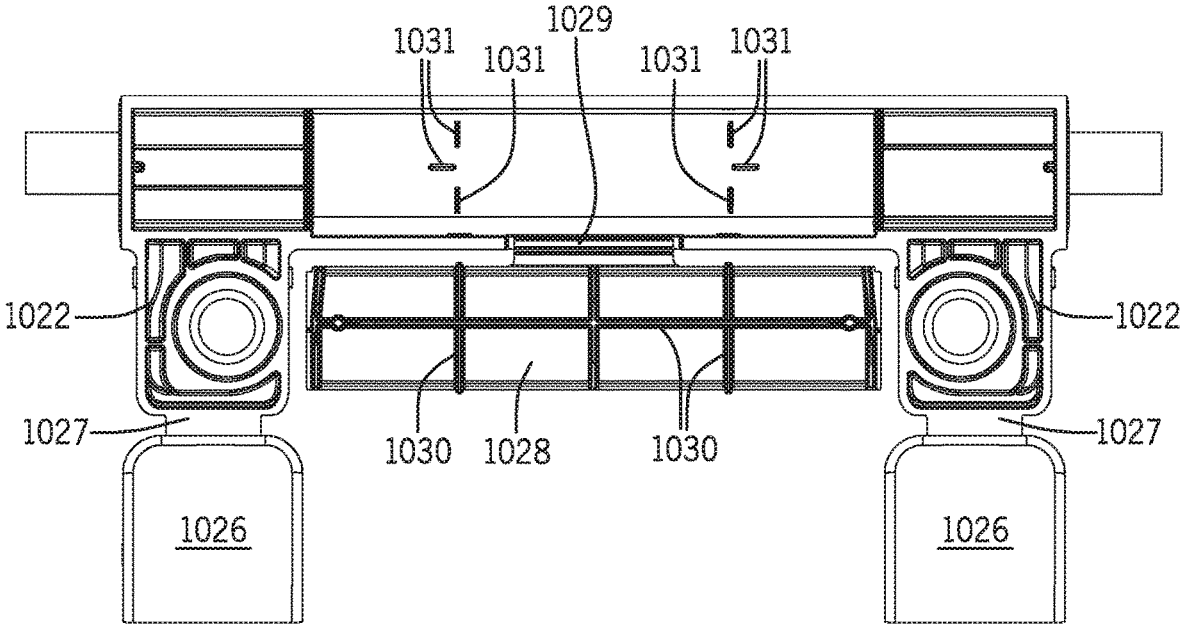
FIG. 100 is a bottom view of the hinge base shown in FIG. 96.

The various elements of the unitary hinge base 1020 can include features that couple (e.g., detachably couple) two or more of the elements of the base 1020 together. As shown in FIG. 100, the bottom cover 1028 includes a series of ribs 1030 that engage notched ribs 1031 (e.g., ribs that includes notches or are separated by notches/recesses) of the base member 1021 to retain the bottom cover 1028 is a closed/engaged position with the base member 1021.

Figure 101:
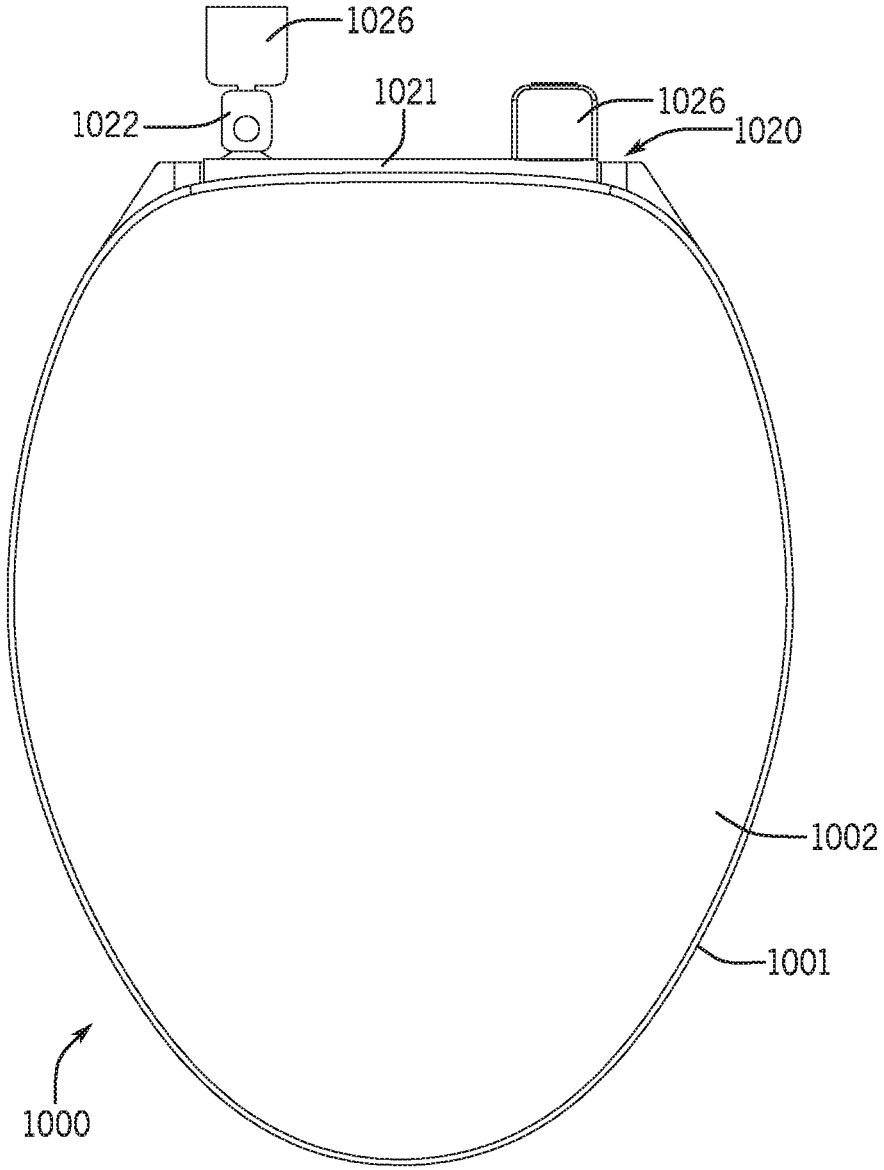
FIG. 101 is a top view of a toilet seat assembly having the hinge base shown in FIG. 96.

FIG. 101 illustrates an exemplary embodiment of a seat assembly 1000 that includes the unitary hinge base 1020 (shown in FIGS. 97-100) with a seat 1001 and a lid 1002 pivotally coupled thereto. The seat assembly 1000 can be secured to a toilet pedestal by securing each mount 1022 with a mounting assembly or hinge lock, such as any of the embodiments disclosed herein.

FIGS. 57 and 58 illustrate a hinge base 1323 having a single hinge cover 1325 that covers both mounts 1324 (e.g., cups). The single hinge cover 1325 can be coupled to the base member of the hinge base 1323 using one or more living hinges, such as or similar to those described above for the hinge base 1020.

Figure 108:
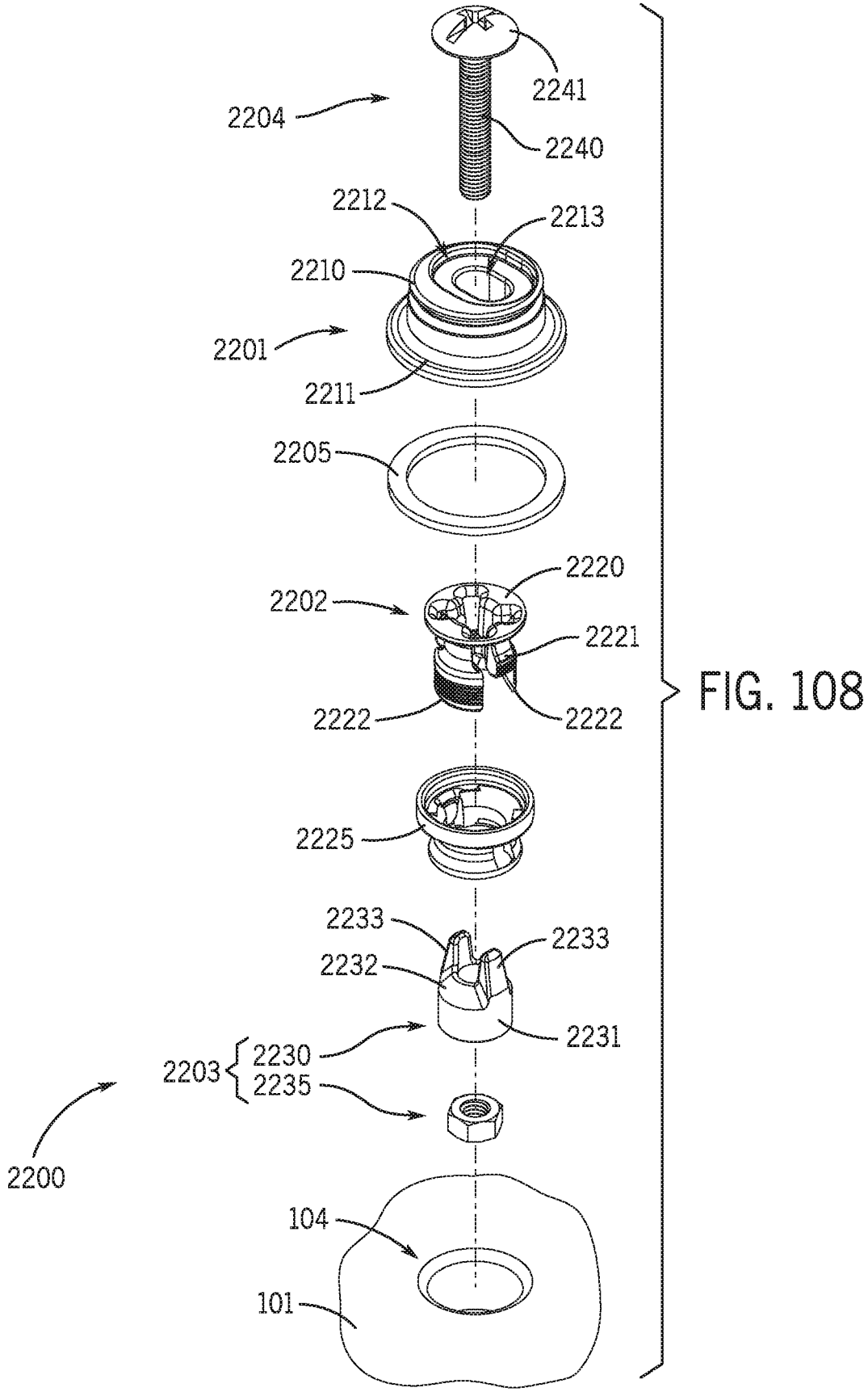
FIG. 108 is an exploded perspective view of an embodiment of an anchor assembly.
Figure 109:
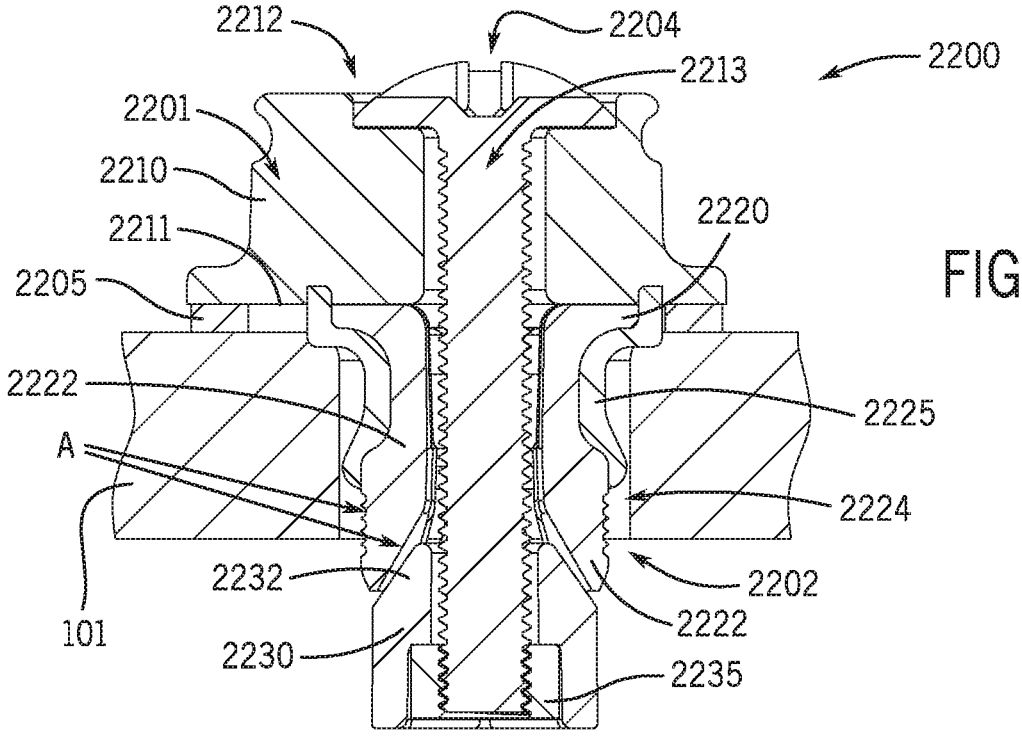
FIG. 109 is a side cross-sectional view of the anchor assembly shown in FIG. 108 in a first position.
Figure 110:
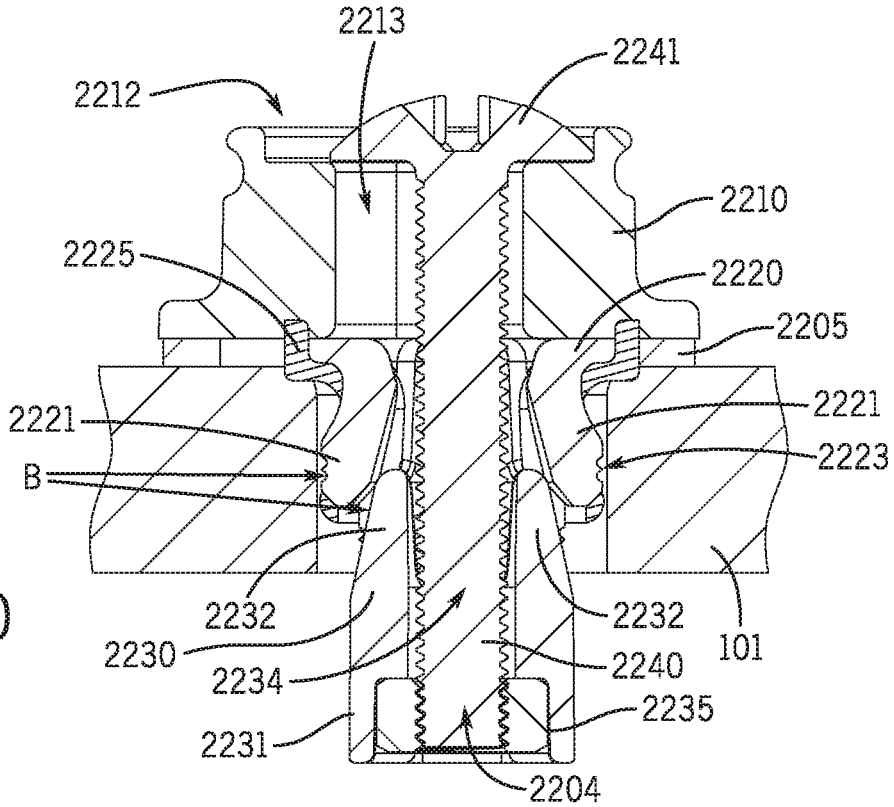
FIG. 110 is a side cross-sectional view of the anchor assembly shown in FIG. 108 in a second position.
Figure 111:
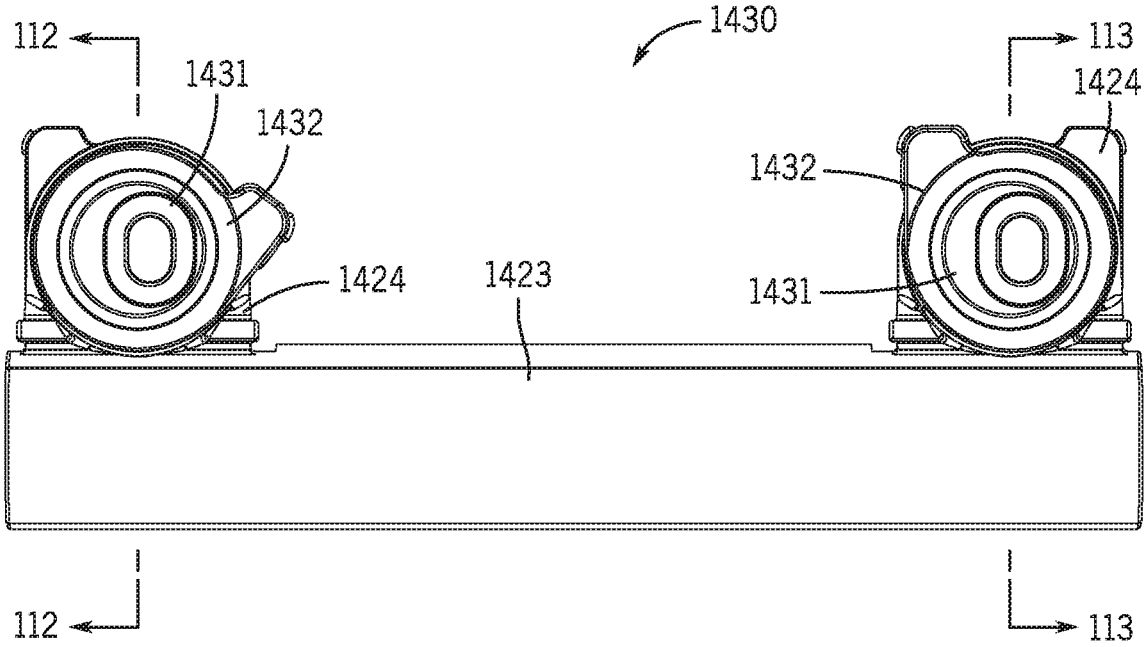
FIG. 111 is a perspective view of an embodiment of a toilet seat hinge.

FIGS. 108-110 illustrate an exemplary embodiment of an anchor assembly 2200 for connecting a toilet seat assembly (e.g., a hinge thereof) to a toilet (e.g., a toilet base). The anchor assembly 2200 is configured to enable "top mount" installation anchoring system that can universally fit with any quick release mount disclosed herein or otherwise, as well as any standard hinge base (not shown), such as the hinge bases disclosed herein. The illustrated anchor assembly 2200 includes a mount 2201, an expandable sleeve 2202, a nut anchor 2203, and a fastener 2204.

The illustrated mount 2201 includes a body 2210 having a bottom 2211 that sits on an upper surface (e.g., upper surface 111) of a toilet base, a recessed pocket 2212 in a top, and a through bore 2213 extending through the body 2210 (i.e., from the top to the bottom). The through bore 2213 can be slotted, cylindrical, or have other suitable shapes. The mount 2201 can be received in or integrally formed with a hinge body, a docking station or other element of a seat assembly, or can be a standalone part. The mount 2201 can have configurations or features of other embodiments disclosed herein.

The illustrated expandable sleeve 2202 includes an annular base 2220, a first pair of fingers 2221 (e.g., short fingers)

extending downwardly from the base 2220 in a cantilevered arrangement to provide flexibility (e.g., flexure or elastic deformation of the fingers under loading), and a second pair of fingers 2222 (e.g., long fingers) extending downwardly from the base 2220 in a cantilevered arrangement to provide flexibility. The first pair of fingers 2221 oppose one another; and the second pair of fingers 2222 oppose one another with each finger 2222 being provided between the first pair of fingers 2221 (circumferentially around the base 2220). For example, the fingers 2221 can be offset circumferentially by one-hundred and eighty degrees and each finger 2222 can be offset circumferentially by ninety degrees from each of the fingers 2221 and offset circumferentially by one-hundred and eighty degrees from the other finger 2222. The fingers (e.g., fingers 2221, fingers 2222) can include helical or annular grooves 2223, 2224 that, if provided, cooperate with the vitreous and/or other components to improve retention.

The expandable sleeve 2202 can optionally include an outer layer 2225 that can be configured to increase friction. For example, the outer layer 2225 can be overmolded onto (or formed separately then coupled to) the base 2220 and/or one or more of the fingers. As shown, the outer layer 2225 is provided around and below the base 2220, around the portions of the long fingers 2222 between the base 2220 and the grooves 2224, and around the short fingers 2221 except the grooves 2223. The outer layer 2225 can include, for example, a TPE or similar material.

The illustrated nut anchor 2203 includes an anchor body 2230 having a generally cylindrical bottom 2231, a generally frusto-conical top 2232, and two fingers 2233 extending upwardly from the top 2232 are two fingers 2233, which are shown on opposite sides of the top 2232. An outer surface of each finger 2233 tapers inwardly moving away from the top 2232, and each finger 2233 extends beyond the top 2232 to engage the sleeve 2202, as discussed below. A central bore 2234 extends through the anchor body 2230 for receiving the fastener 2204. The illustrated nut anchor 2203 also includes a nut 2235 disposed in a bore in the bottom 2231 of the anchor body 2230. Rotation of the nut 2235 relative to the anchor body 2230 is prevented by the portion of the bottom 2231 defining the bore. For example, the bore can have a hex shape that compliments a hex shape of the outside of the nut 2235. Internal threads of the nut 2235 thread to threads of the fastener 2204. Alternatively, the nut 2235 can be integrally formed with the anchor body 2230, such that the bottom 2231 of the anchor body 2230 has a threaded opening for threading to the fastener 2204.

The fastener 2204 is shown as a screw having a threaded body 2240 and a head 2241 disposed at one end of the body 2240. The head 2241 is received in the recessed pocket 2212 of the mount 2201 and the threaded body 2240 extends through the through bore 2213, through an opening in the annular base 2220, and through the central bore 2234 to thread to the internal threads of the nut anchor 2203 (e.g., threads of the nut 2235, threads in the bottom 2231). It is noted that the fastener 2204 can be configured differently and still function as described herein.

The anchor assembly 2200 can optionally include a gasket 2205 disposed between the mount 2201 and the toilet base 101. As shown, the gasket 2205 has an annular shape that encircles a top portion of the sleeve 2202 and is located between the bottom 2211 of the mount 2201 and the upper surface 111 of the toilet base (e.g., vitreous). The gasket 2205 is configured to be compressible, such as by having a material (e.g., TPE) that compresses.

During assembly/installation, the anchor assembly 2200 is configured to provide a dual compression force for improved performance. During insertion (e.g., of the sleeve 2202) into the vitreous (e.g., the seat post hole), the outer diameter of the outer layer 2225 creates friction and prevents the anchor assembly (e.g., sleeve, nut anchor, etc.) from spinning to ensure that the nut anchor 2203 lifts and engages expansion sleeve 2202 when the fastener 2204 is rotated. By way of example, the outer layer 2225 can be a TPE material that is "sticky" by having a low durometer (approximately 50-70 Shore A) to allow sufficient grip and provide easy compression. A majority of the compression loading is intended to be on the portion of the sleeve 2202, which is more rigid (e.g., includes a rigid plastic material) to avoid creep (e.g., relaxing over time). The diameter of the vitreous opening and thickness of the vitreous are highly variable and independent, which has led to poor performance of past solutions. To accommodate the range and a semi rigid sleeve material that resists creep, the location (A, B) and reaction angle enables functionality when A or B contact areas create the radial compression. As shown in FIGS. 109 and 110, the anchor assembly is configured to provide primary (e.g., underside) compression surfaces A and secondary (e.g., inside) compression surfaces B during installation. Initial contact begins at compression surfaces A. The lower reaction surface angle (45-55 degrees) spreads the flexible features of the sleeve 2202 at a faster rate than the reaction at surfaces B (70-80 degrees). The faster rate helps create a vertical clamp load to compress the gasket 2205 and allow the fingers 2221, 2222 of the sleeve 2202 to bend and create a vertical constraint on the underside of the vitreous.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the toilets and toilet seat assemblies as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element (e.g., hinge lock, seat component, docking station, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A toilet seat assembly comprising:

a unitary hinge base comprising:

a base member having a plurality of interconnected walls comprising a front wall and defining an open bottom;

a first mount extending from a first portion of the front wall and configured to receive a first hinge lock;

a second mount extending from a second portion of the front wall and configured to receive a second hinge lock;

a cover assembly configured to detachably couple to at least one of the first and second mounts in a covering position;

a first living hinge connecting the cover assembly to the first mount, such that the cover assembly is movable relative to the first mount through the first living hinge; and a second living hinge connecting the cover assembly to the second mount, such that the cover assembly is movable relative to the second mount through the second living hinge; and at least one of a seat and a lid rotatably coupled to the hinge base through at least one pivot member.

2. The toilet seat assembly of claim 1, wherein each living hinge includes a first material, and each of the first mount, the second mount, and the cover assembly includes a second material, which is different than the first material.

3. The toilet seat assembly of claim 1, wherein the unitary hinge base further comprises:

a bottom cover configured to detachably couple to the base member to cover the open bottom;

a third living hinge connecting the bottom cover to the base member, such that the bottom cover is movable relative to the base member through the third living hinge.

4. The toilet seat assembly of claim 3, wherein each living hinge includes a first material; each of the first mount, the second mount, the cover assembly, and the bottom cover includes a second material; the first material has a higher relative flexibility than the second material; and the second material has a higher relative strength than the first material.

5. The toilet seat assembly of claim 3, wherein the bottom cover includes a plurality of ribs that are configured to engage a plurality of notched ribs inside the base member to retain the bottom cover to the base member in a secured position.

6. The toilet seat assembly of claim 5, wherein a side of the bottom cover opposite the plurality of ribs is configured to mount to a toilet pedestal.

7. The toilet seat assembly of claim 1, wherein the cover assembly comprises:

a first cover that detachably couples to the first mount in the covering position; and a second cover that detachably couples to the second mount in the covering position;

wherein each of the first and second covers is independently movable relative to the other cover.

8. The toilet seat assembly of claim 1, wherein the cover assembly comprises a single hinge cover that detachably couples to the first mount and the second mount.

9. The toilet seat assembly of claim 1, wherein the plurality of interconnected walls of the base member includes two side walls, and each side wall has an opening for receiving one of the at least one pivot member.

10. The toilet seat assembly of claim 1, further comprising the first and second hinge locks, wherein each of the first and second hinge locks comprises:

an annular hinge mount received in a cup of the associated first or second mount;

a fastener extending through a bore in the hinge mount and an opening in a toilet pedestal; and a lock cap that is rotatable relative to the hinge mount and the cup between a locking position, in which the hinge mount and the lock cap are secured to the associated mount, and a non-locking position, in which the hinge mount and the lock cap are unsecured.

11. The toilet seat assembly of claim 10, wherein each cup of the first and second mounts includes a plurality of tabs provided inward of an outer wall, and each lock cap includes an annular wall that is rotatable between the tabs and the outer wall of the associated mount, such that thick sections of the annular wall are aligned with the tabs in the locking position, and such that thin sections of the annular wall are aligned with the tabs in the non-locking position.

12. The toilet seat assembly of claim 11, wherein each lock cap includes a finger that is configured to be contacted and moved by the cover assembly toward the locking position from the non-locking position in response to moving the cover assembly toward the covering position.

13. The toilet seat assembly of claim 12, wherein the cover assembly comprises a single hinge cover that detachably couples to the first mount and the second mount, and the single hinge cover includes a vertical wall associated with each of the first and second mounts that is configured to contact and move the finger of the associated lock cap.

14. The toilet seat assembly of claim 12, wherein the cover assembly comprises:

a first cover that detachably couples to the first mount in the covering position, the first cover includes a side wall that is configured to contact and move the finger of the lock cap of the first hinge lock; and a second cover that detachably couples to the second mount in the covering position, the second cover includes a side wall that is configured to contact and move the finger of the lock cap of the second hinge lock;

wherein each of the first and second covers is independently movable relative to the other cover.

15. A toilet comprising:

the toilet seat assembly of claim 1;

a toilet base comprising an upper surface having a first opening and a second opening;

the first hinge lock, which includes a fastener configured to engage the first opening to secure the first mount to the toilet base; and the second hinge lock, which includes a fastener configured to engage the second opening to secure the first mount to the toilet base.

16. A unitary hinge base for a toilet seat assembly, the unitary hinge base comprising:

a base member having a plurality of interconnected walls comprising a front wall and defining an open bottom;

a first mount extending from a first portion of the front wall;

a second mount extending from a second portion of the front wall;

a cover assembly configured to detachably couple to at least one of the first and second mounts in a covering position;

a first living hinge connecting the cover assembly to the first mount, such that the cover assembly is movable relative to the first mount through the first living hinge; and a second living hinge connecting the cover assembly to the second mount, such that the cover assembly is movable relative to the second mount through the second living hinge.

17. The toilet of claim 16, further comprising a bottom cover configured to detachably couple to the base member to cover the open bottom;

a third living hinge interconnecting the bottom cover to the base member, such that the bottom cover is movable relative to the base member through the third living hinge.

18. The toilet of claim 17, wherein each living hinge includes a first material; each of the first mount, the second mount, the cover assembly, and the bottom cover includes a second material; the first material has a higher relative flexibility than the second material; and the second material has a higher relative strength than the first material.

19. The toilet of claim 18, wherein the cover assembly comprises:

a first cover that detachably couples to the first mount in the covering position; and a second cover that detachably couples to the second mount in the covering position;

wherein each of the first and second covers is independently movable relative to the other cover.

20. The toilet of claim 16, wherein the base member, each mount, the cover assembly and each living hinge are integrally formed in a molding process.

* * * * *